US007617563B2

(12) United States Patent
Hertrick et al.

(10) Patent No.: US 7,617,563 B2
(45) Date of Patent: Nov. 17, 2009

(54) LIQUID DISTRIBUTION SYSTEM FOR A CLEANING MACHINE

(75) Inventors: Timothy T. Hertrick, Canton, OH (US); Charles A. Lang, Hartville, OH (US); Edgar A. Maurer, Canton, OH (US); Vincent L. Weber, North Lawrence, OH (US)

(73) Assignee: Healthy Gain Investments Limited, Tortola (VG)

( * ) Notice: Subject to any disclaimer, the term of this patent is extended or adjusted under 35 U.S.C. 154(b) by 778 days.

(21) Appl. No.: 10/165,731

(22) Filed: Jun. 7, 2002

(65) Prior Publication Data

US 2003/0226230 A1 Dec. 11, 2003

(51) Int. Cl.
*A47L 7/00* (2006.01)

(52) U.S. Cl. ..... 15/320; 15/322

(58) Field of Classification Search ..... 15/320, 15/322; *A47L 7/00*

See application file for complete search history.

(56) References Cited

U.S. PATENT DOCUMENTS

| | | | | |
|---|---|---|---|---|
| 3,101,505 | A | 8/1963 | Belicka et al. | 15/320 |
| 4,107,813 | A | 8/1978 | Torres | |
| 4,570,856 | A | 2/1986 | Groth et al. | 239/310 |
| 4,741,069 | A * | 5/1988 | Helm et al. | 15/320 |
| 5,299,608 | A | 4/1994 | Bosyj | 141/285 |
| 5,871,152 | A | 2/1999 | Saney | 239/8 |
| 5,937,475 | A * | 8/1999 | Kasen et al. | 15/320 |
| 6,030,465 | A * | 2/2000 | Marcussen et al. | 15/320 |
| 6,105,203 | A * | 8/2000 | Hueppi et al. | 15/320 |
| 6,158,081 | A | 12/2000 | Kasen et al. | 15/320 |
| 6,167,586 | B1 | 1/2001 | Reed, Jr. et al. | 15/320 |
| 6,247,202 | B1 * | 6/2001 | Lesco et al. | 15/320 |
| 6,279,196 | B2 | 8/2001 | Kasen et al. | 15/320 |
| 6,658,692 | B2 * | 12/2003 | Lenkiewicz et al. | 15/320 |
| 6,671,925 | B2 * | 1/2004 | Field et al. | 15/320 |
| 6,681,442 | B2 * | 1/2004 | Coates et al. | 15/320 |
| 6,684,452 | B2 * | 2/2004 | Lehman et al. | 15/320 |
| 2001/0002500 | A1 | 6/2001 | Kasen et al. | 15/320 |
| 2002/0092115 | A1 | 7/2002 | Zahuranec et al. | 15/320 |
| 2002/0092116 | A1 | 7/2002 | Zahuranec et al. | 15/320 |
| 2002/0092122 | A1 | 7/2002 | Zahuranec et al. | 15/352 |
| 2002/0170137 | A1 * | 11/2002 | Coates et al. | 15/320 |
| 2003/0110588 | A1 * | 6/2003 | Zahuranec et al. | 15/320 |
| 2003/0135952 | A1 * | 7/2003 | Coates et al. | 15/320 |

FOREIGN PATENT DOCUMENTS

| | | |
|---|---|---|
| GB | 486500 | 6/1938 |

* cited by examiner

*Primary Examiner*—David A Redding

(57) ABSTRACT

A cleaning apparatus for cleaning a surface in which cleaning solution is dispensed to the surface and substantially simultaneously extracted along with the dirt on the surface in a continuous operation. The cleaning apparatus comprises a first source for distributing a first liquid onto said surface. An activating device operatively connected to the first source to activate the first source to distribute the first liquid onto the surface. A pump operatively connected to the first source to draw under pressure the first liquid to the surface. A second source for distributing a second liquid onto the surface, wherein the second liquid from the second source is drawn to the cleaning surface by gravity alone.

20 Claims, 38 Drawing Sheets

LIQUID DISTRIBUTION SYSTEM FOR A CLEANING MACHINE

BACKGROUND OF THE INVENTION

1. Field of the Invention

The present invention relates to a liquid distribution system for a cleaning machine.

2. Background Information

It is know to have floor cleaning units that have a liquid distribution system for dispensing detergent to wash the floor and/or clean water to rinse the floor. Often, a clean water supply tank and a detergent supply tank are used. Pumps are used to provide pressure to draw water and/or detergent to the floor. It is desirable to reduce the parts to lower the cost of the liquid distribution system, yet still have good cleaning performance.

Hence, it is an object the present invention to provide a low cost cleaning distribution system that provides good cleaning performance for a cleaning machine.

SUMMARY OF THE INVENTION

The foregoing and other objects of the present invention will be readily apparent from the following description and the attached drawings. A cleaning apparatus for cleaning a surface in which cleaning solution is dispensed to the surface and substantially simultaneously extracted along with the dirt on the surface in a continuous operation. The cleaning apparatus comprises a first source for distributing a first liquid onto said surface. An activating device operatively connected to the first source to activate the first source to distribute the first liquid onto the surface. A pump operatively connected to the first source to draw under pressure the first liquid to the surface. A second source for distributing a second liquid onto the surface, wherein the second liquid from the second source is drawn to the cleaning surface by gravity alone.

BRIEF DESCRIPTION OF THE DRAWINGS

The invention will now be described, by way of example, with reference to the attached drawings, of which.

DETAILED DESCRIPTION OF THE INVENTION

Figure 1:
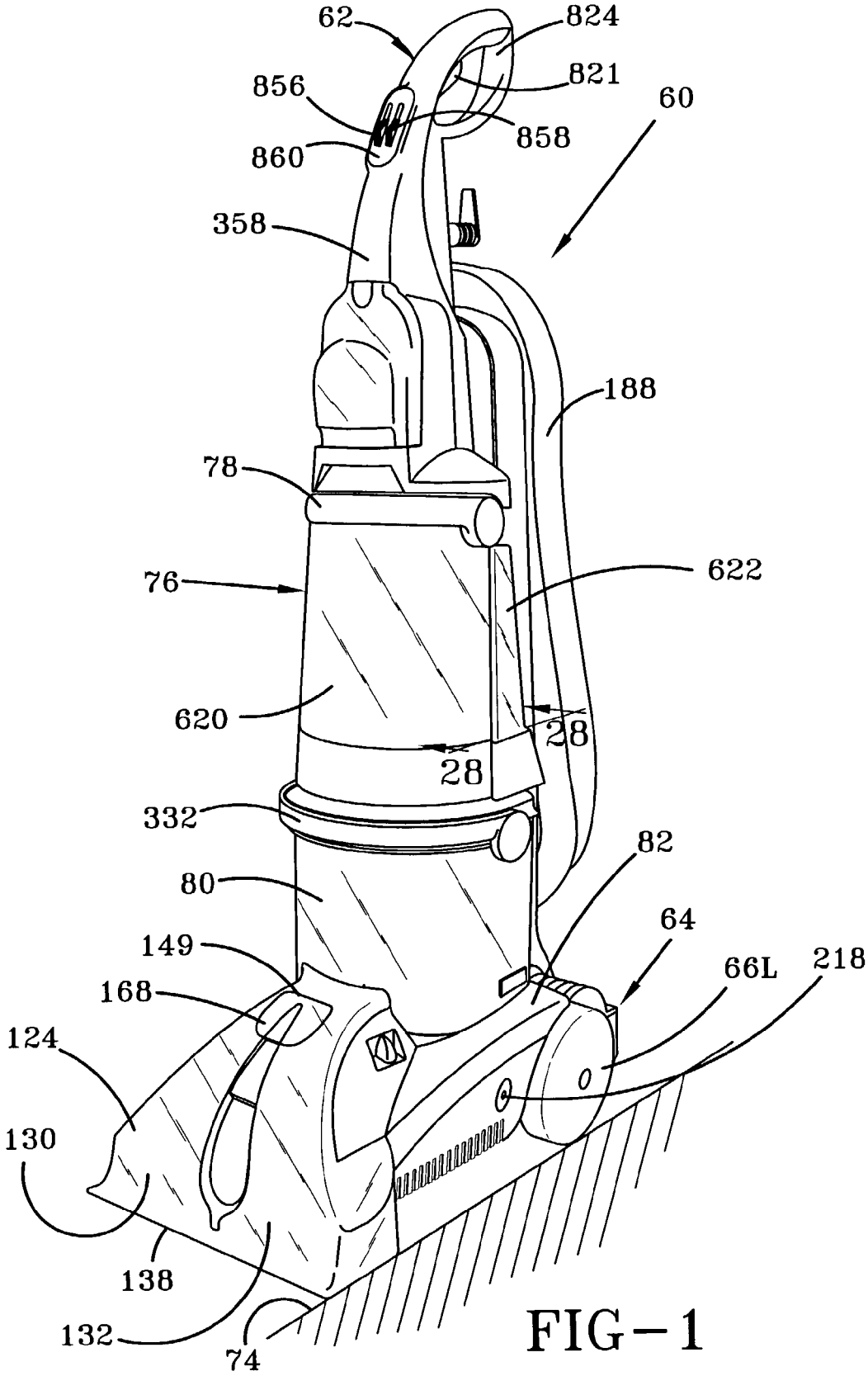
FIG. 1 is a perspective view of a carpet extractor embodying the present invention.
Figure 2:
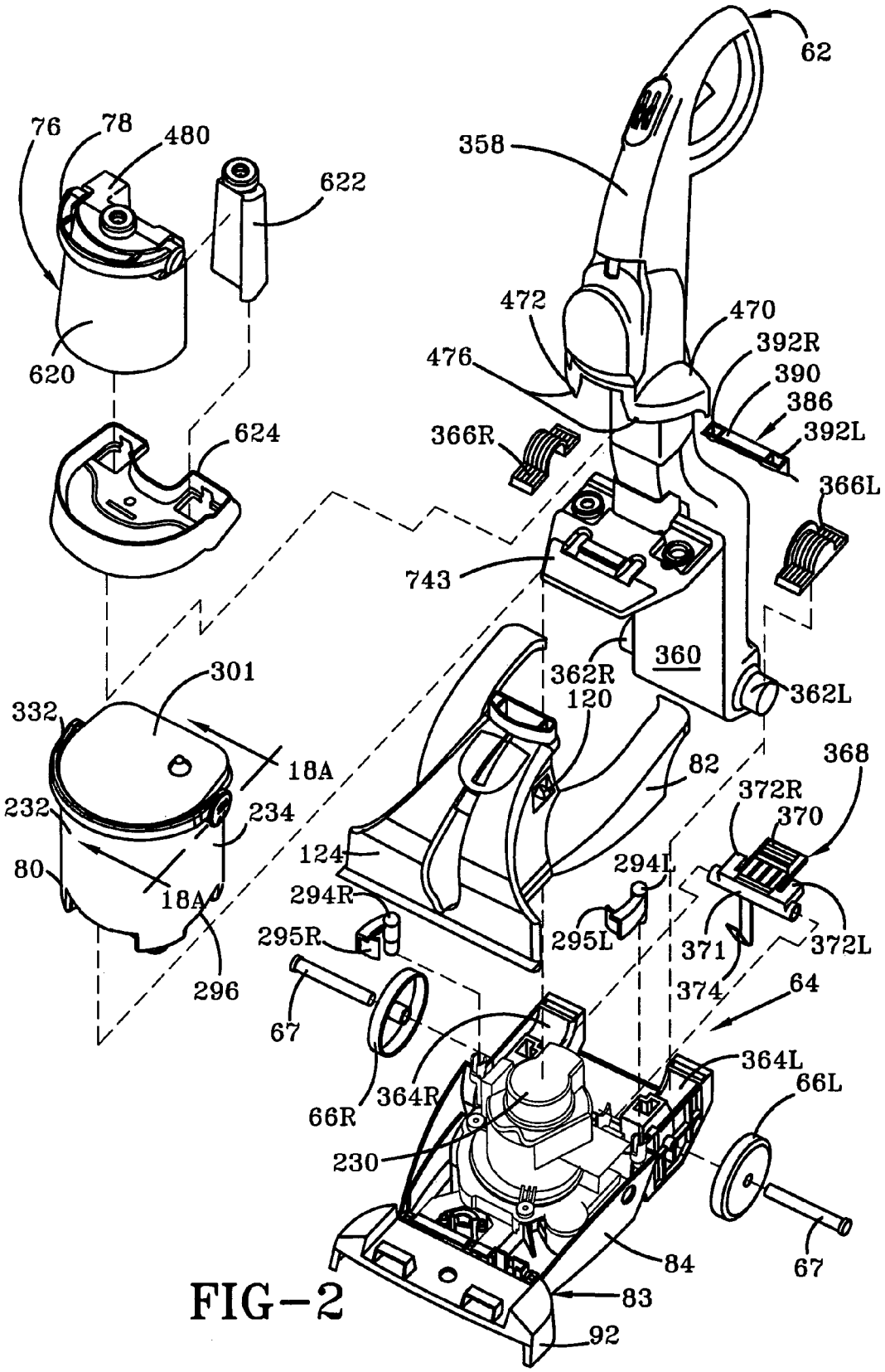
FIG. 2 is an exploded view of a carpet extractor embodying the present invention illustrating the principal elements thereof.

Referring to the drawings, FIG. 1 depicts a perspective view of an upright carpet extractor 60 according to one embodiment of the present invention. The upright carpet extractor 60 comprises an upright handle assembly 62 pivotally connected to the rear portion of the floor-engaging portion or base assembly 64 that moves and cleans along a surface 74 such as a carpet. The base assembly 64 includes a brush assembly 70 (FIG. 3) having a plurality of rotating scrub brushes 72 (FIG. 30) for scrubbing the surface. A supply tank assembly 76 is removably mounted to the handle assembly 62 of the extractor 60 and includes a combination carrying handle and securement latch 78 pivotally connected thereto. A combined air/water separator and recovery tank 80 removably sits atop base assembly 64 and is surrounded by a hood portion 82. As depicted in FIG. 2, the base assembly 64 includes a frame assembly 83 which comprises a generally unitary molded rear body 84 having two laterally displaced wheels 66L, 66R rotatably attached to the rear of the rear body 84 via axles 67.

Figure 3:
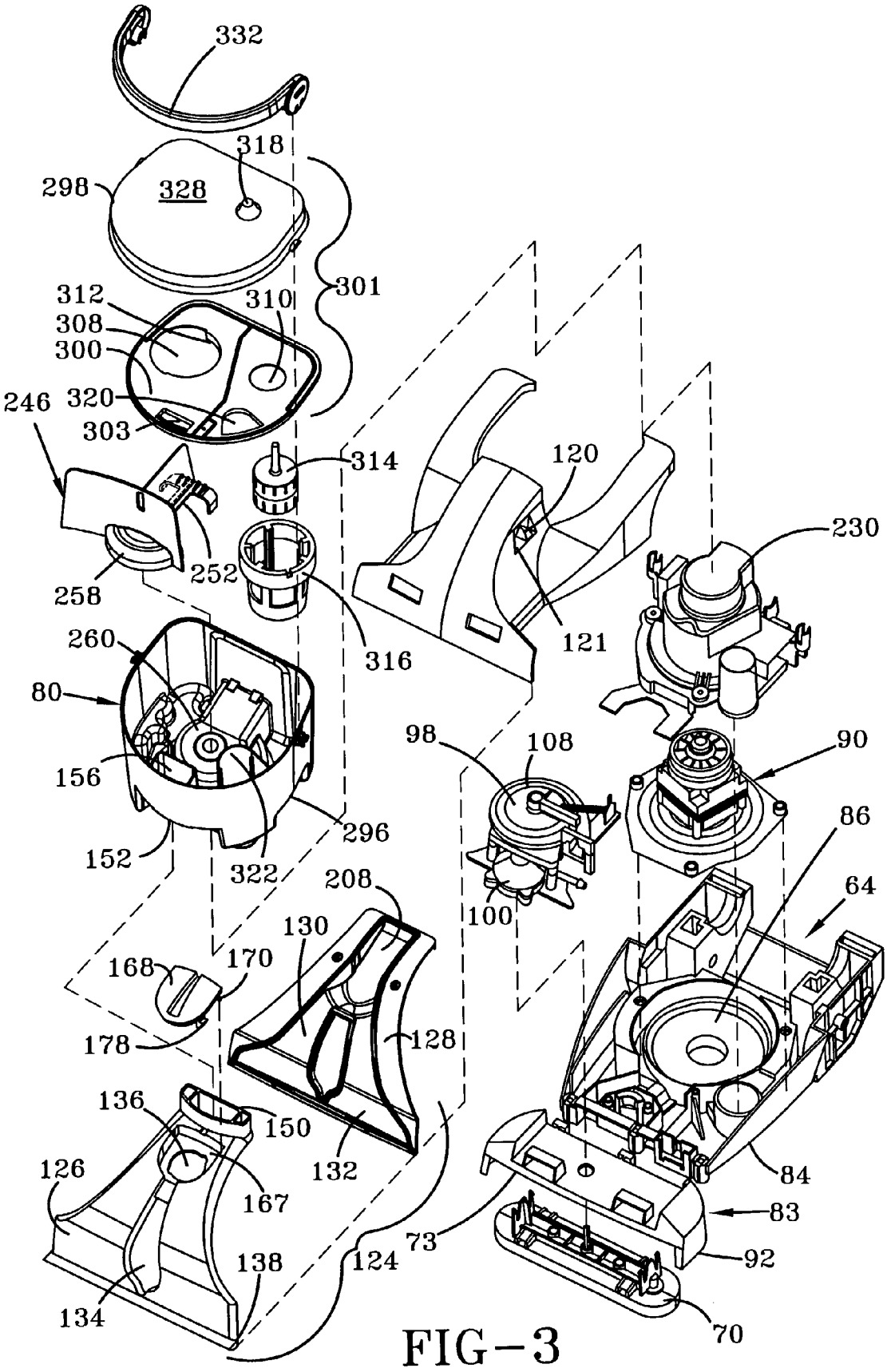
FIG. 3 is an exploded view of the base assembly illustrating the principal elements thereof.

Referring to FIG. 3, integrally molded into the bottom of the rear body 84 is a circular stepped basin 86 receiving therein the motor/fan assembly 90. A suitable motor/fan assembly is shown in U.S. Pat. No. 5,500,977, the disclosure of which is incorporated by reference. An air driven turbine 98 providing motive power for the brush assembly 70 is mounted on the front portion of the rear body 84. The brush assembly 70 is contained in a brush cavity 73 formed in the underside of a front body 92. A suitable brush assembly 70 is taught in U.S. Pat. No. 5,867,857, the disclosure which is incorporated herein by reference. Brush assembly 70 is operated by a suitable gear train (or other known means), not shown, contained in transmission housing 100. A suitable air turbine driven gear train is taught in U.S. Pat. No. 5,443,362, the disclosure of which is incorporated by reference.

Figure 4:
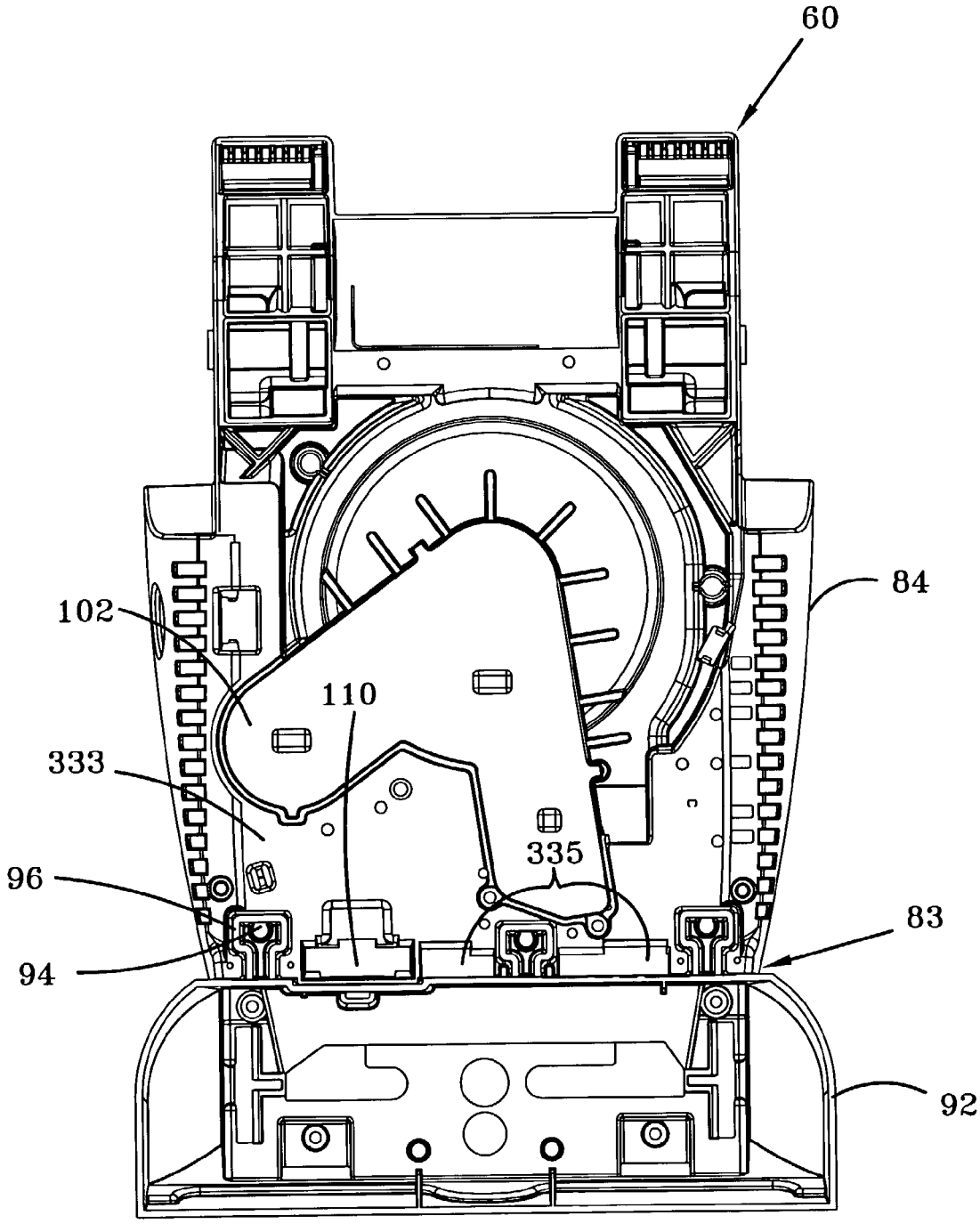
FIG. 4 is a bottom view of the extractor with the suction nozzle, wheels, handle assembly, and the brush assembly removed for illustrative purposes.

Referring now to FIG. 4, the frame assembly 83 also comprises the front body 92, which is secured to rear body 84. In particular, lateral T-shaped tabs 94 extending from the rear of the front body 92 slidably engage complementary journals 96 of the rear body 84. Integrally molded into the underside of rear body 84 of frame assembly 83 (see FIG. 5) is a vacuum manifold 102 having extensions for providing a vacuum source for the turbine 98. The motor fan assembly 90 generally provides suction to manifold 102. Atmospheric air, driving a brush turbine rotor enters by way of turbine inlet 110, passing through a screen (not shown) to filter out the dirt and then passing through the rotor. Positioned within inlet 110 is a throttle valve 114 (FIG. 5) for energizing or de-energizing brush turbine rotor. Such a suitable brush turbine 98 is disclosed in U.S. Pat. No. 5,860,188 which is hereby incorporated by reference.

Figure 5:
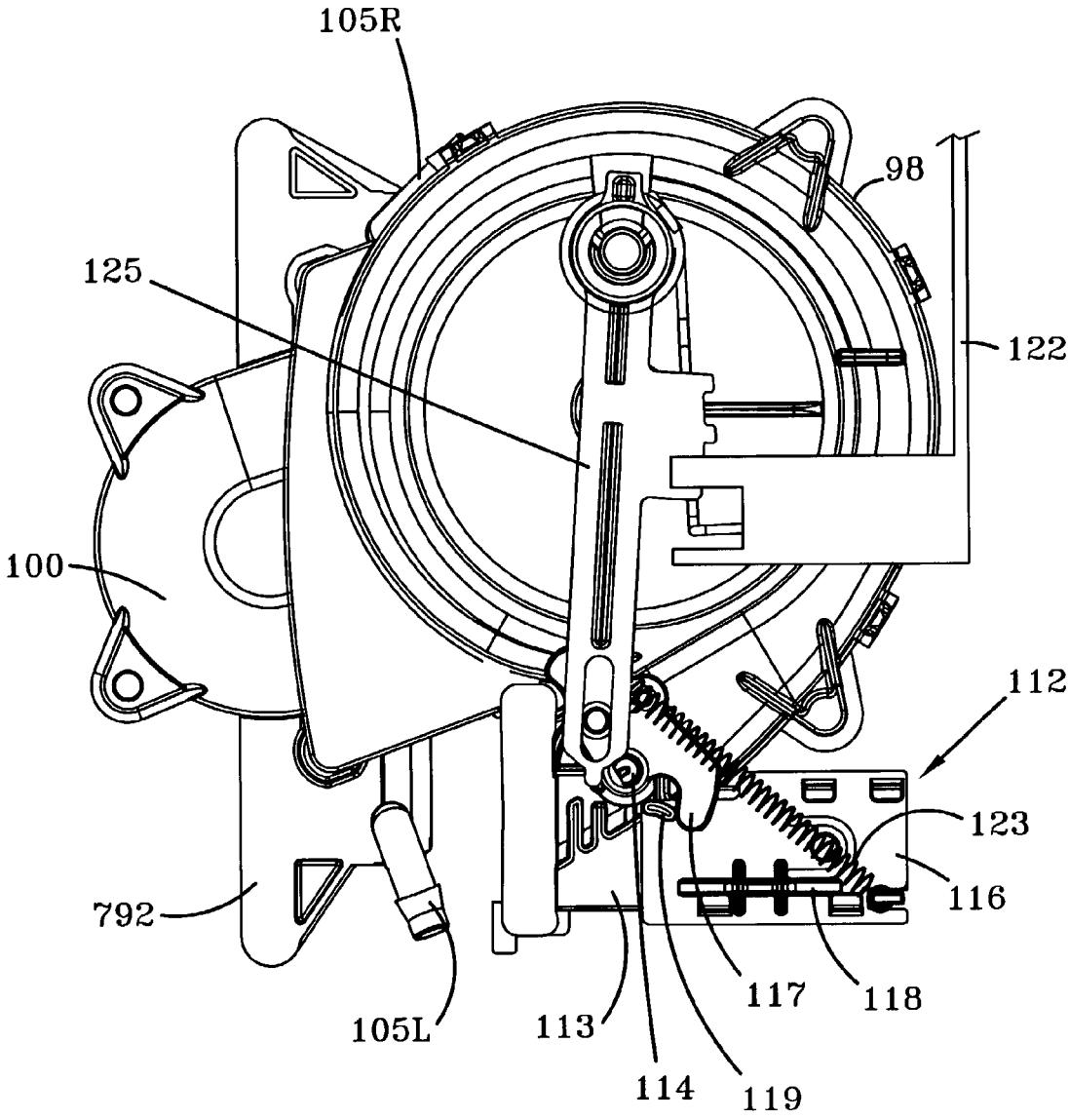
FIG. 5 is a top plan view of the brush drive turbine mounted to the distributor.

Referring now to FIG. 5, a manual override mechanism 112 is provided whereby the operator, operating in the floor-cleaning mode, may selectively close throttle valve 114 thereby de-energizing brush drive turbine 98. Alternatively, the operator may select an intermediate position whereby throttle valve 114 is partially closed thereby reducing the air flow through throttle valve 114 causing brush drive turbine 98 to rotate at a slower speed resulting in slower rotating brushes.

Override mechanism 112 comprises a table 113 integrally molded to the body of brush drive turbine 98 and extending rearwardly having slide 116 slidingly attached thereto. Extending upwardly from slide 116 is lever arm 118 having a conveniently shaped finger cap 120 (FIG. 3) atop thereof. Lever arm 118 extends upward through a suitable opening (not shown) in the hood 82 whereby cap 120 is received within recess 121 in hood 82 as seen in FIG. 3. Referring to FIG. 5, movement of the cap 120 (FIG. 3) in turn moves the lever arm 118 to rotating a bell crank 117, which in turn rotates the shaft of the valve 114, attached thereto. In particular, projecting upward from slide 116 is an arcuate rib 119. As slide 116 is moved rearward by the operator, the rib 119 engages the bell crank 117 rotating the bell crank 117 and throttle valve 114 counterclockwise thereby closing throttle valve 114 and de-energizing brush drive turbine 98. Upon return of the slide 116 to its original position (as illustrated in FIG. 5), a spring 123, secured between the bell crank 117 and the slide 116, causes the bell crank 117 to rotate clockwise, thereby rotating throttle valve 114 to the full open position. Generally as the slide 116 moves from one position to the other, a cantilevered tab releasingly engages concavities in the surface of the table, which corresponds to the open and close position of valve 114. A similar mechanism is disclosed in U.S. Pat. No. 5,860,188, the disclosure of which is incorporated by reference.

Further, when the handle assembly 62 is pivoted in the upright storage position, an actuating rod 122, connected to the handle, links with the lever arm 118 via linking member 125 to turn the brushes off as disclosed by U.S. Pat. No. 5,983,442, the disclosure which is hereby incorporated by reference.

Figure 6:
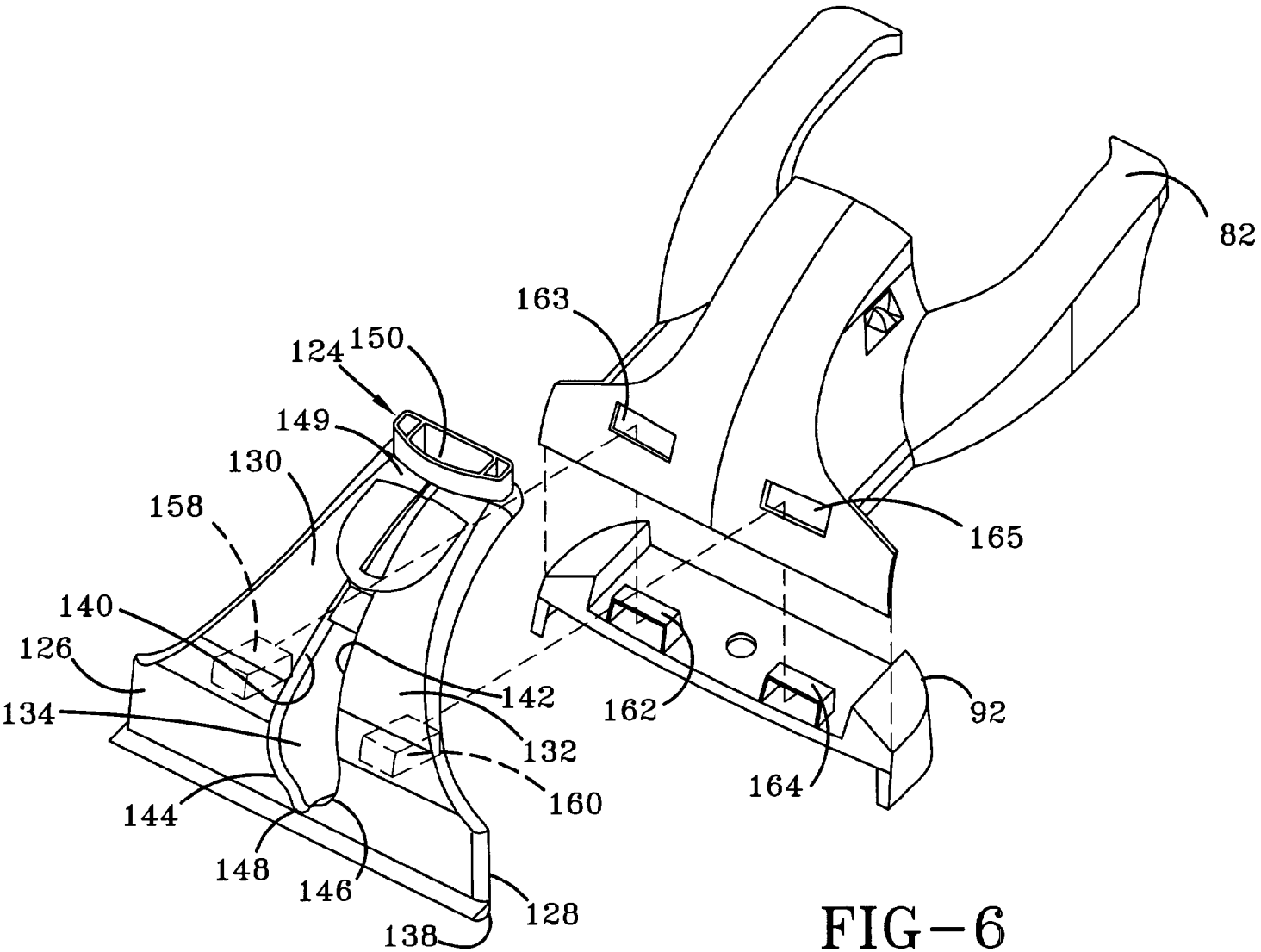
FIG. 6 is an exploded view of the combined suction nozzle, hood, and front body illustrating the principal elements thereof.

Turning to FIGS. 3 and 6, a floor suction nozzle 124 assembly is removably mounted to the hood portion 82 of the base assembly 64 (FIG. 3). In particular, the floor suction nozzle assembly 124 includes a front plate 126 secured to a rear plate 128 that in combination define dual side ducts 130, 132 separated by a tear drop shaped opening 134. The opening 134 extends down from an accessory hose opening 136 (FIG. 3), formed in the front portion 126, to a predetermined distance above the suction inlet 138 of the suction nozzle 124. The front and rear plates or portions 126, 128 are secured to one another by ultrasonic welding and screw fasteners, however, other types of ways to secure them such as for example, by adhesive, can be used. The distance above the suction inlet 138 for the opening 134 is about one fourth of an inch, which provides a flow path for liquid and dirt pick up in the center of the suction inlet 138 of the nozzle 124.

As best seen in FIG. 6, the opposite side walls 140, 142 surrounding the tear drop shaped opening 134 converge downwardly into s-shaped curves 144, 146 that terminate into a lower curved front end 148. This shape helps smooth the airflow thereby reducing any back flow, eddies, or recirculation. The side ducts 130, 132 are symmetrical which produces a more uniform distribution of suction across the suction inlet 138. In particular, a computer simulation shows the velocity variation across the suction inlet 138 to improve from 75 percent (from the left side to the center) for the prior art one duct nozzle design to about 16 percent for this dual side duct nozzle. The side ducts 130, 132 converge upstream into a recessed throat portion 149, which terminates into an upwardly extending rear duct 150.

Figure 7:
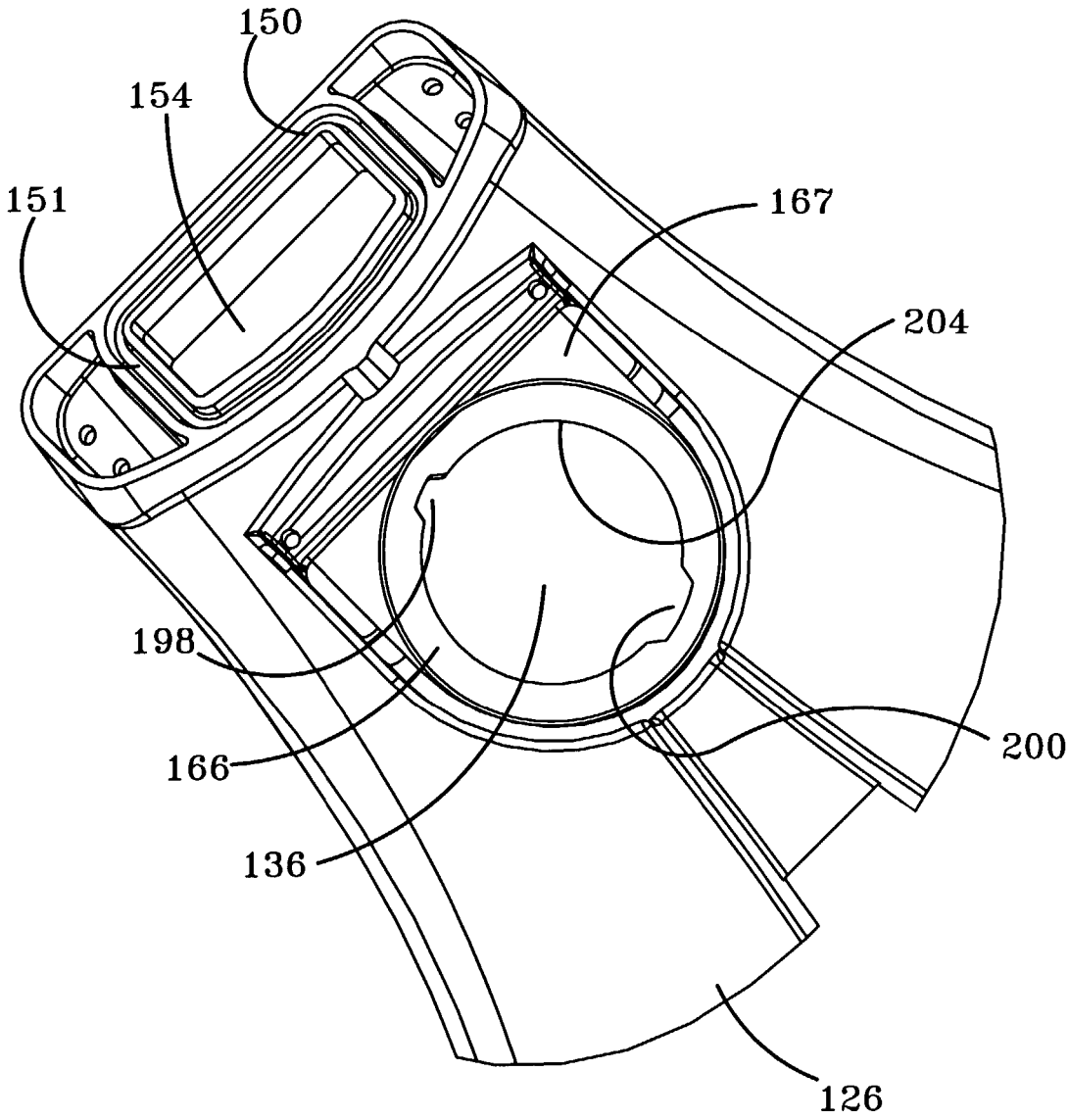
FIG. 7 is a partial, front and top perspective view of the front portion of the suction nozzle of the carpet extractor of the present invention.
Figure 15A:
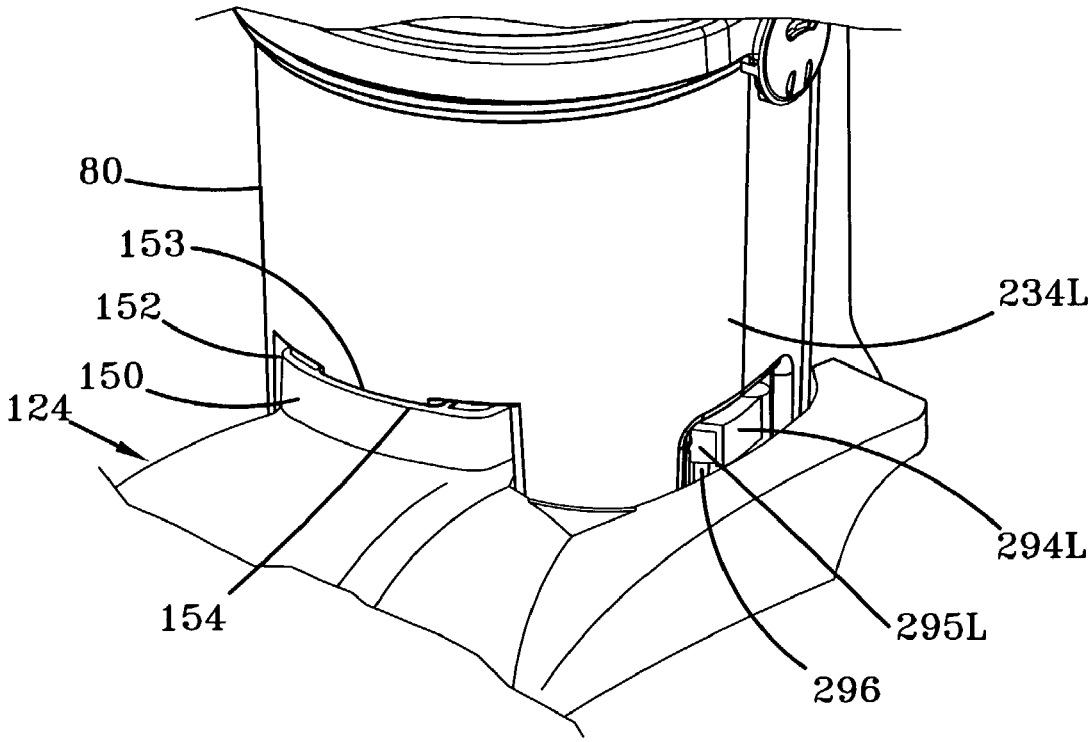
FIG. 15A is a partial front perspective view of the recovery tank and related elements locked upon the base assembly of the carpet extractor of the present invention.
Figure 15B:
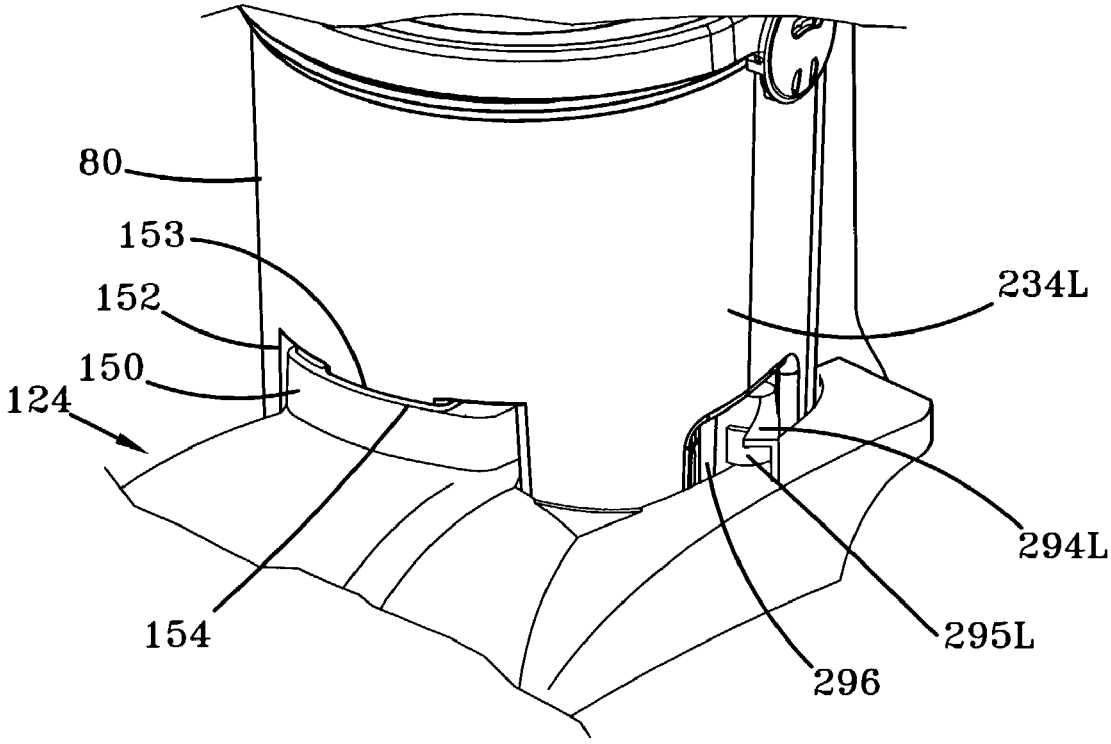
FIG. 15B is a view similar to FIG. 15A but with the latch in a position that unlocks the recovery tank.

As shown in FIG. 7, a seal 151 is disposed around the outlet 154 of the rear duct 150. As illustrated in FIGS. 3, 15A and 15B, the rear duct 150 is positioned in a complementary recess portion 152 formed in the front lower portion of the recovery tank 80. The outlet 154 of the duct 150 aligns and fluidly connects with the inlet 153 (FIGS. 15A and 15B) of a front vertical duct 156 (FIG. 3) of the recovery tank 80.

Referring back to FIG. 6, the suction nozzle 124 includes two projections 160, 158 extending rearwardly from the rear side of the rear portion 128. The projections 160, 158 extend into apertures 163, 165 formed in the hood 82 and slidably engage complimentary unshaped holders 162, 164 integrally formed on the front body 92. To remove the suction nozzle 124, the recovery tank 80 (FIG. 2) must first be removed from the rear body of the 84 of the frame 83. Then, the nozzle is slid or pulled forward disengaging the projections from the holders 162, 164.

Figure 8:
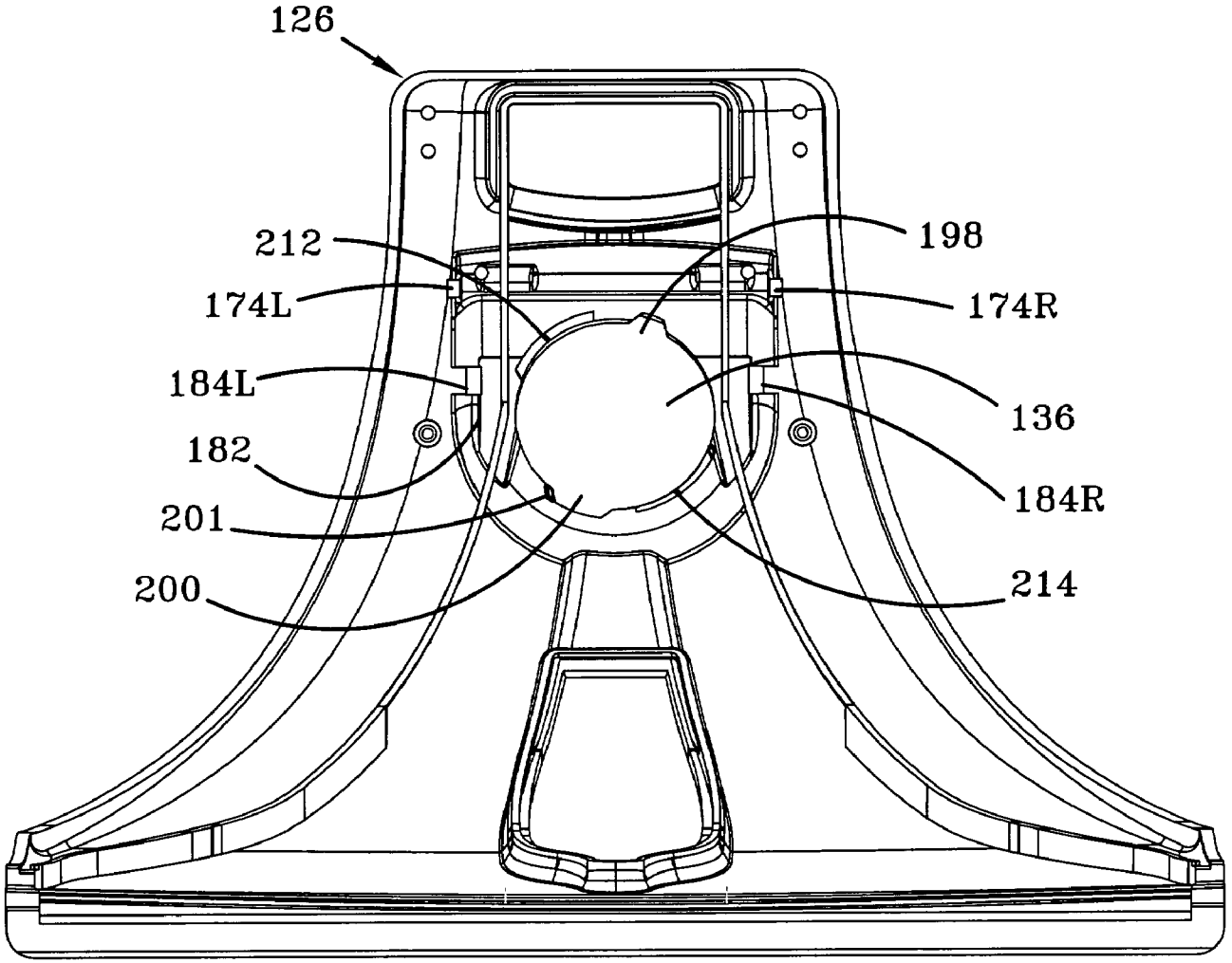
FIG. 8 is a bottom view of the front plate of the suction nozzle assembly of the carpet extractor of the present invention.

Turning to FIG. 7, as previously stated, the accessory hose opening 136 is formed in a recess 167 of the front portion 126 of the suction nozzle 124. An elastomeric circular seal 166 is attached upon the top of the edge 204 of the opening 136. As illustrated in FIG. 3, a door 168 is pivotally connected to the front portion 126 and releasbly fits into the complimentary recess 167 to cover the opening 136 when the carpet extractor 60 is used to clean the floor. In more detail, integrally formed lateral pins 170 (only one shown in FIG. 3) on opposite sides of the door 168 are received in respective journals 174L, 174R (FIG. 8) to form the pivotal connection. To releasably lock the door 168, two lateral tabs 178 (only one shown) extending outwardly from opposite sides of the door 168 deflect and engage lateral notches 184L, 184R (FIG. 8) formed in the underside of the side wall 182 (FIG. 8) of the recess 167, when the door 168 closes with sufficient force to overcome the elasticity of the tabs 178. To unlock the door 168, the front of the door 168 is pulled with sufficient force to deflect the tabs 178 and disengage them from the notches 184.

Figure 9:
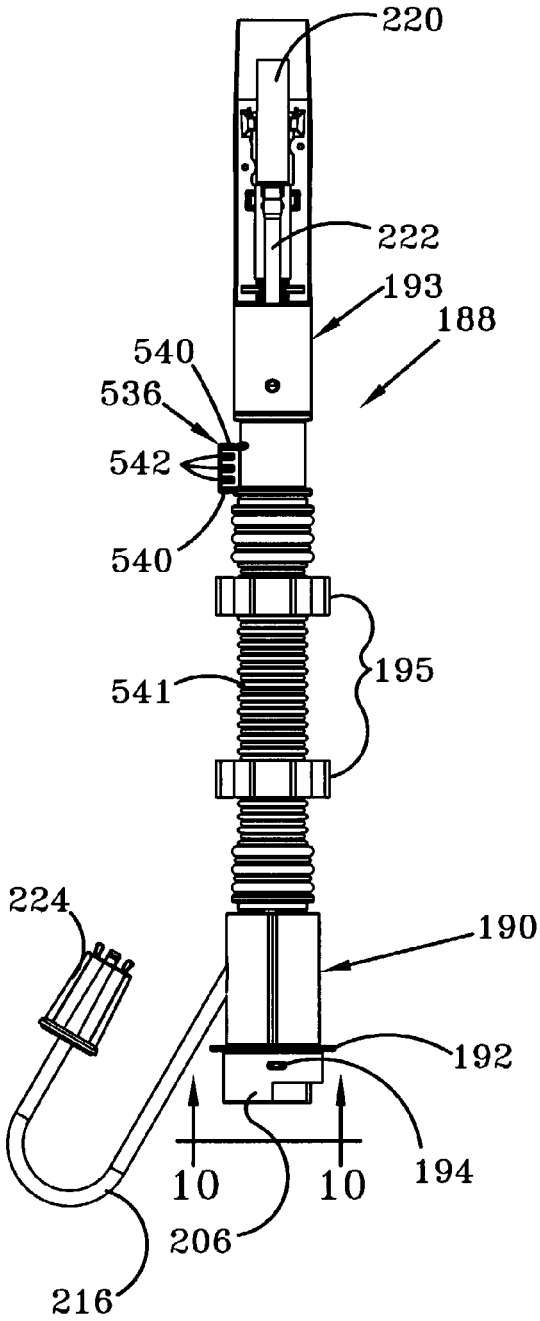
FIG. 9 is side elevational view of the accessory hose of the carpet extractor of the present invention.
Figure 10:
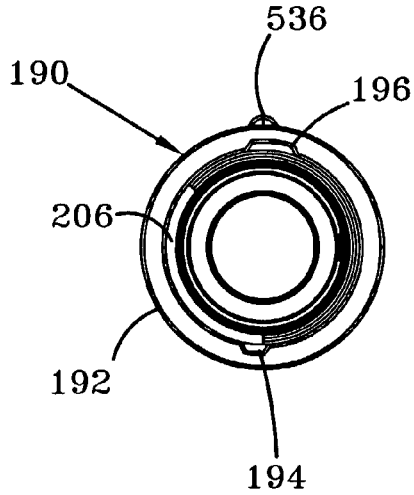
FIG. 10 is an elevational view taken along line 10-10 of FIG. 9.

An accessory hose 188 (FIG. 9) cooperates with the opening 136 so that the carpet extractor 60 can be used, for example, to clean upholstery and/or stairs. In particular, as shown in FIGS. 9 and 10, the hose end 190 includes a flange portion 192 and a pair of projections 194, 196 (FIG. 10) located on opposite sides of the hose end 190 for alignment and insertion into respective complementary slots 198, 200 (FIG. 7) formed at the edge 204 (FIG. 7) of the hose opening 136 (FIG. 7). The projection 196 and its respective slot 200 is of a larger size than the projection 194 and its respective slot 198 to ensure that the hose end is inserted in the proper position to block the suction to the suction nozzle 124 which will be explained as follows.

Figure 11A:
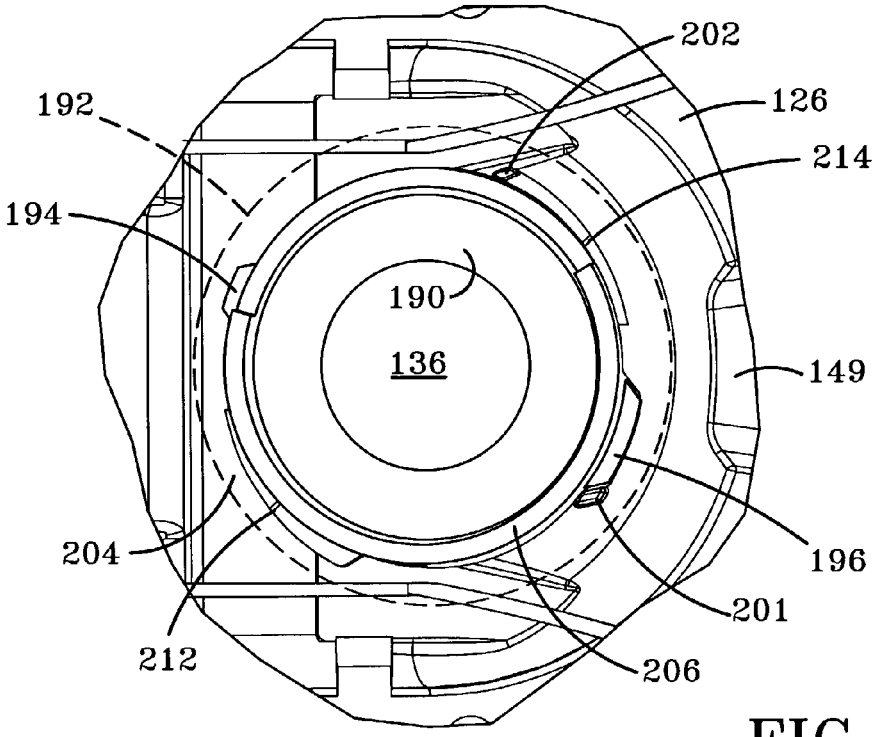
FIG. 11A is a partial view of FIG. 8 and with the accessory hose of FIG. 9 inserted in the hose opening.
Figure 11B:
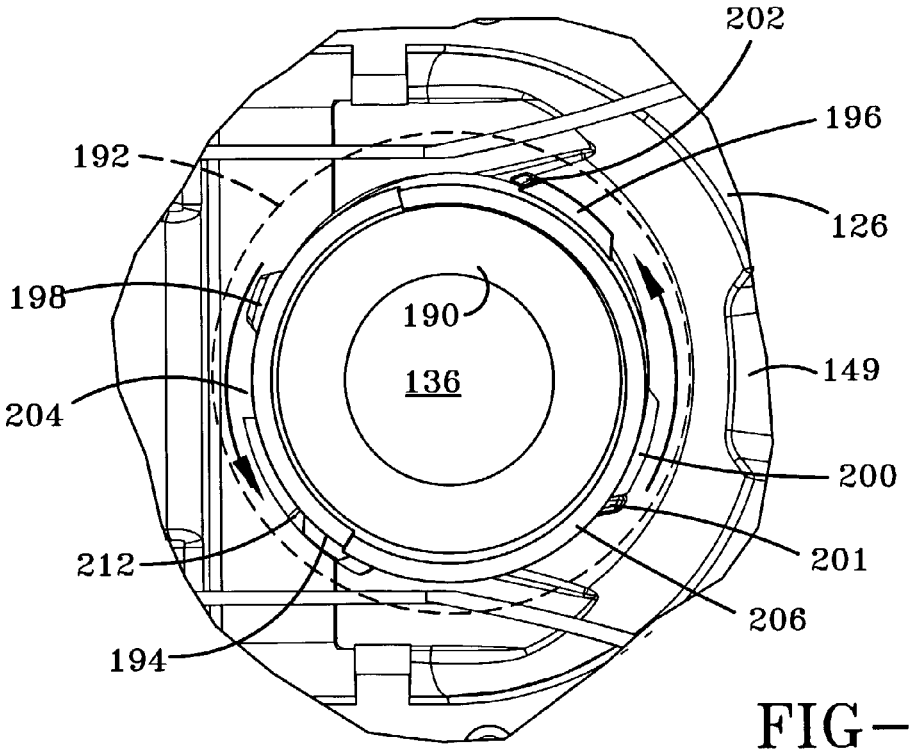
FIG. 11B is view similar to FIG. 11A but showing the accessory hose in a position to block suction to the suction nozzle.

Referring to FIGS. 11A and 11B, the hose end 190 is inserted into the hose opening 136 until the projections 194, 196 are below the edge 204 as seen in FIG. 11A and then rotated clockwise (when viewed from the top) until the projection 196 abuts against a stop member 202, extending downward from the underside of the edge 204 of the opening 136, as seen in FIG. 11B. In this position, a front wall 206 extending down from the hose end 190 contacts the recessed top surface 208 (FIG. 3) of the rear portion of the floor suction nozzle 124 at the throat portion 149. The front wall 206 extends across the throat portion 149 thereby blocking vacuumized air from the suction inlet 138 and side ducts 130, 132 of the suction nozzle 124 and thus preventing the floor suction nozzle 124 from picking up liquid and dirt. However, in this mode, working air including entrained liquid is drawn through the hose 188 by a suitable upholstery nozzle attachment 446 (FIG. 24) traveling through the throat portion 149 and upwardly extending duct 156 and into the recovery tank 80.

Also as shown in FIGS. 11A and 11B, during the rotation of the hose end 190, the projections 194, 196 cam against respective ramp portions 212, 214 (FIG. 11A) formed on the underside of the edge 204 of the opening 136, riding over the ramp portions 212, 214, which action is allowed by sufficient force to overcome the elastic force of the elastomeric seal 166 (FIG. 7). The hose end 190 is held in place by the ramp portions 212, 214 until the hose end 190 is rotated back with sufficient force again to compress the seal 166 thereby allowing the projections 194, 196 to ride over the ramp portions 212, 214. Further, a stop portion 201 located adjacent the left edge of the slot 200 will abut against the projection 196 preventing the hose end 190 from inadvertently rotating counter clockwise after initial insertion of the hose end 190 into the opening 136.

Figure 30:
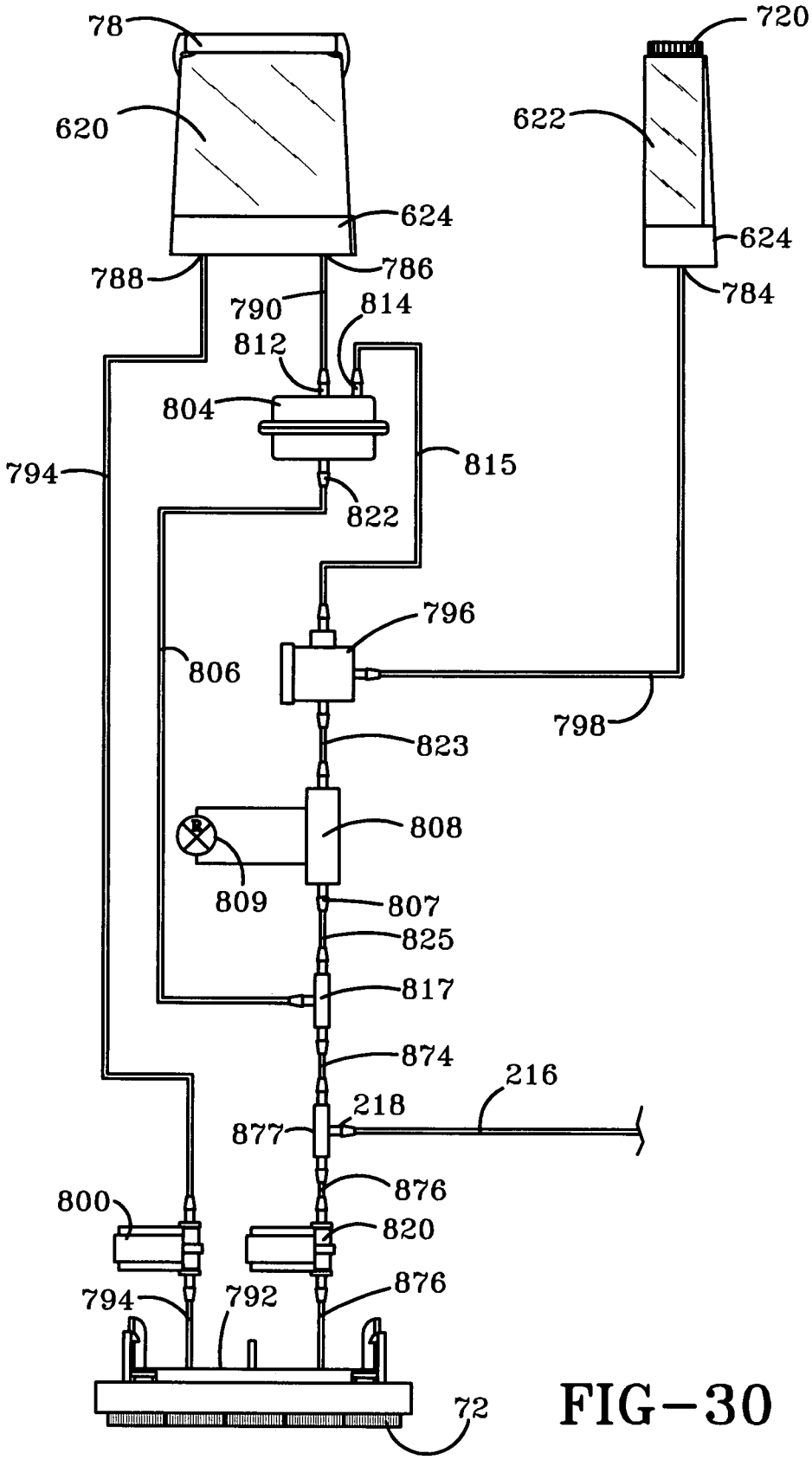
FIG. 30 is a schematic view of the fluid distribution system of the embodiment shown in FIG. 1.

As depicted in FIG. 30, the accessory hose 188 (FIG. 9) includes a solution tube 216, which fluidly connects to a discharge nipple 218 of control valve 877. The discharge nipple 218 is positioned in an opening formed in the left side of the base assembly 64 as seen in FIG. 1. The control valve 877 allows mixed detergent and clean water to flow through the solution tube 216 and dispense by typical spray means 220 (FIG. 9). A typical on-off trigger operated valve 222 (FIG. 9) is provided to control the amount of solution dispensed. A quick disconnect coupling 224 (FIG. 9) removably attaches to the discharge nipple 218 similar to that disclosed in U.S. Pat. No. 5,500,977, the disclosure of which is incorporated by reference.

Figure 44:
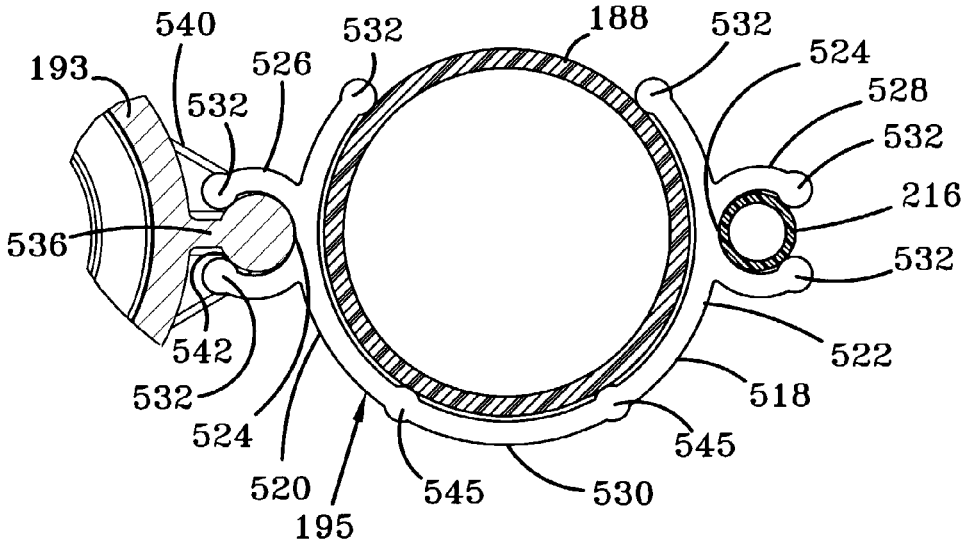
FIG. 44 is a partial cross-sectional view of the hose clip assembly secured to the accessory hose, hose end, and solution tube.

As seen in FIG. 9, a pair of hose clips 195 is clipped on the hose 188 at the corrugated portion 541 for releasably securing the solution tube 216 and/or one of the hose ends 190, 193 to the hose 188. In particular, as depicted in FIG. 44, the clip 195 has C-shaped inner clip 518 that receives the corrugated portion 541 of the hose 188 and a pair of outer c-shaped clips 526, 528 integrally formed on respective opposite legs 520, 522 of the inner clip 518. The outer clips 526, 528 are oriented such that the middle or bight portion 524 of each of the outer clips 526, 528 are integrally formed on the opposite legs 520, 522. Specifically, the middle portions 524 are oriented at a location along the legs 520, 522 such that a line connecting the two middle portions 524 of the clips 526, 528 is perpendicular to a line bisecting the inner clip 518 at its middle portion 530. The outer clip 528 receives the solution tube 216. The outer clip 526 receives a projection 536 formed at the hose end 193 connected to the accessory tool. A similar projection 536 is also formed at the hose end 190 for connection to the opening 136. Each projection 536 has a three integrally molded curved ribs 542 (see also FIG. 9) extending around the longitudinal axis of the projection 536 that cooperatively snap fit into the outer clip 526

Triangularly shaped reinforcement plates 540 are integrally molded to the ends of the projection 536 and hose end 193 or 190. As should be apparent due to the fact that the clips are of similar shape and size, the solution hose 216 can be received by the outer clip 526 and the projection 536 can be received by the outer clip 528. Further, the hose clip 195 can be used to secure the hose end 190 or 193 and solution tube 216 with only the outer clips 526, 528, without the hose 188 being attached to the inner clip 518, or alternatively, only the inner clip 518 and one of the outer clips 526, 528 can used to secure the hose 188 and either the solution tube or hose end 193 or 190. All of the clips have integrally formed rounded nub portions 532 at their free ends for addition securement of their respective objects. Also, the inner clip 518 has a pair of nubs 545 along its middle portion for addition reinforcement. The inner clip 518 can slide along the hose 188 and the outer clips 526, 528 can slide along the solution tube 216 at desired positions.

As depicted in FIG. 3, the recovery tank 80 is configured to include a raised portion 260 defining a generally concave bottom whereby tank 80 sets down over and surrounds a portion of the motor cover 230 of base frame assembly 64. It is preferred that recovery tank 80 set atop and surround a portion of the motor fan assembly 90 thereby providing sound insulating properties and assisting in noise reduction of the extractor.

Figure 12:
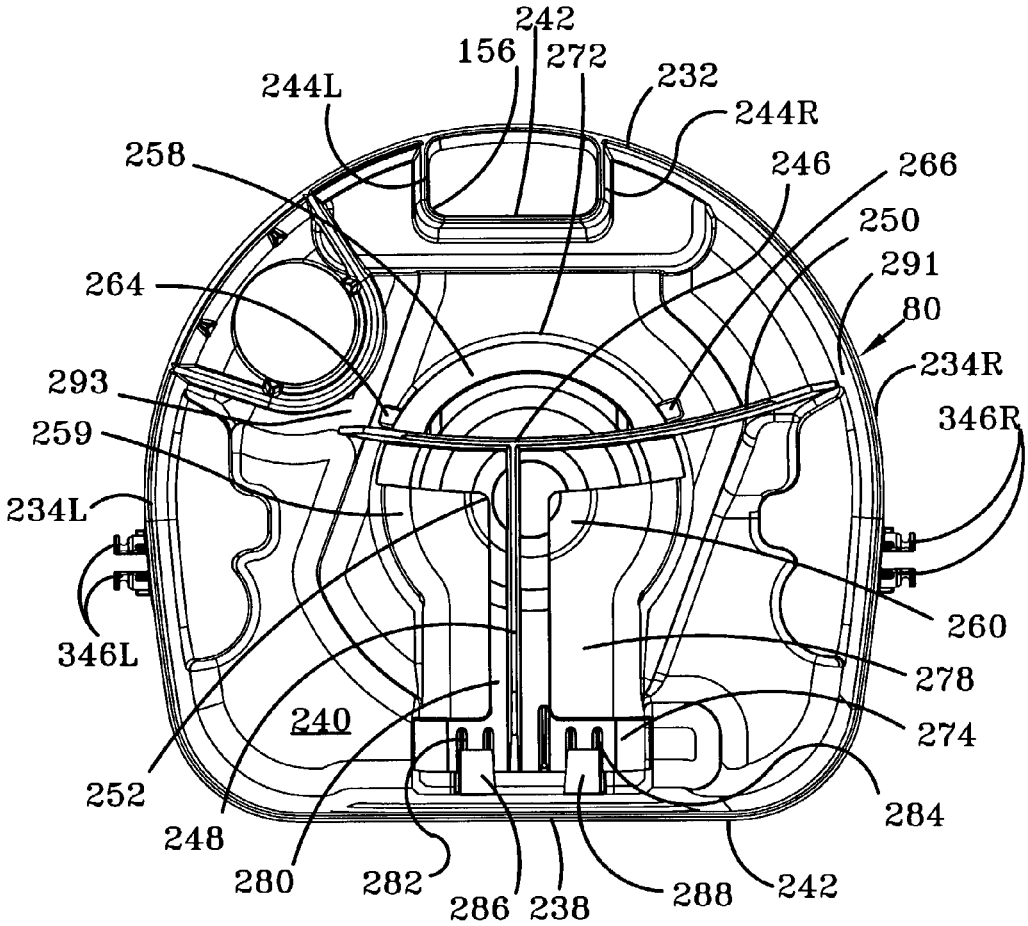
FIG. 12 is a top view of the recovery tank with the lid assembly removed for illustrative purposes.
Figure 13:
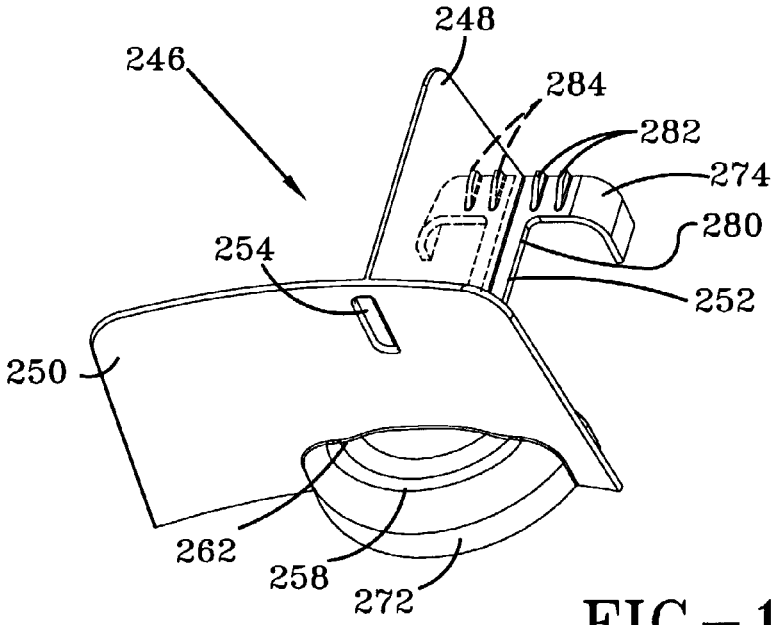
FIG. 13 is a perspective view of the baffle assembly for the recovery tank.
Figure 14:
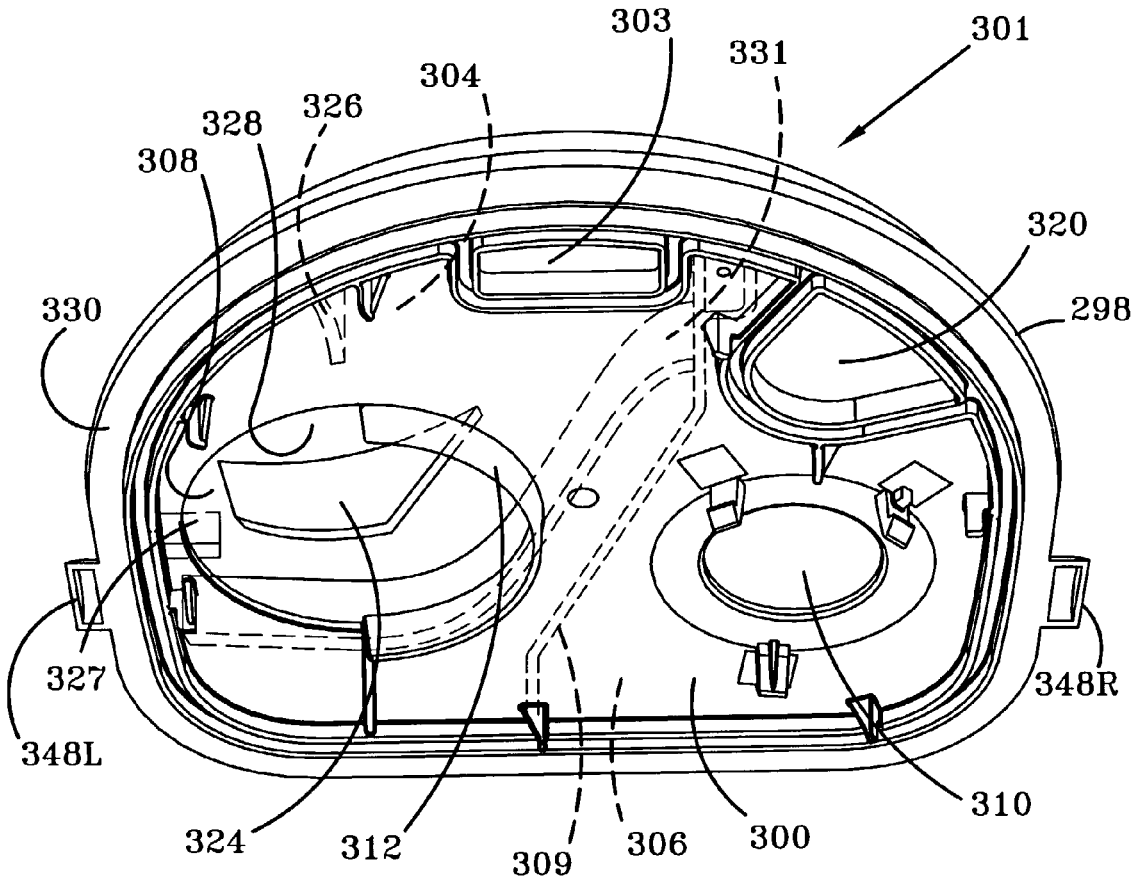
FIG. 14 is a bottom and front perspective view of the lid assembly for the recovery tank of FIG. 12.

Referring to FIG. 12, the recovery tank has a front arcuate wall 232, opposite sidewalls 234L, 234R and rear wall 238 integrally formed around the bottom 240. The vertical rectangular duct 156, formed with the inner surface of the front wall 232, includes a rear wall 242 and opposite sidewalls 244L and 244R. Positioned inside tank 80 is a T-shaped baffle assembly 246 comprising two vertical upstanding baffles 248 and 250 welded to a bottom base portion 252. As depicted in FIG. 13, the baffle 250 has an opening 254 formed near the intersection of the two baffles 248, 250. The opening 254 is located to the left of the intersection underlying the inlet chamber 304 (FIG. 14). The bottom base portion 252 includes a semicircular cap portion 258 that fits over the front arcuate part 259 of the raised portion 260 of the bottom wall 240 of the recovery tank 80 as seen in FIG. 12. The baffle 250 is slightly curved and has a cut out portion 262 (FIG. 13) formed on its lower edge to conform to fit around the width of the cap portion 258. A pair of retaining ribs 264, 266 is integrally formed on opposite sides of the front part 259 of the raised portion 260. The upper end of each of the ribs 264, 266 is spaced from the raised portion 260 thereby defining a notch for receiving a lower peripheral wall 272 of the cap portion 258. The rear portion 280 of the base 252 includes an integrally formed u-shaped clip 274 that grasps around the width of the rear part 278 of the raised portion 260. Integrally formed on the upper surface of the clip 274 are two pairs of ribs 282, 284, each pair being located on opposite sides of the baffle 248. The ribs 282, 284 slidably engage respective pairs of locking tabs 286, 288, which extend over the ribs.

The baffle assembly 246 is removably mounted upon the raised portion 260 by sliding the ribs 282, 284 under the tabs 286, 288 and then inserting the peripheral wall 272 of the cap portion 258 between the retaining ribs 264, 266 and front portion 259 such that the baffle is positioned just behind the retaining ribs 264, 266 in abutment with them. In this position, the retaining ribs 264, 266 act as stops to prevent the ribs 282, 284 on the clip 274 from slidably disengaging from the locking tabs 286, 288 and inadvertently disconnecting the baffle assembly 246 from the recovery tank 80. To remove the baffle assembly 246, a user simply pulls the baffle assembly 246 upwardly with sufficient force to overcome the frictional force between the retaining ribs 264, 266 and baffle 250 and slide the ribs 282, 284 out of the locking tabs 286, 288. The baffles 248, 250 act to limit the degree of fluid sloshing during the forward and reverse push-pull operation of the extractor in the floor cleaning mode and assists in separation of liquid from the working air as described further below.

In addition to their function as anti-slosh baffles, baffles 248 and 250 also serve to prevent the establishment of a "short circuited" working airflow from the exit opening 308 (FIG. 14) of inlet chamber 304 directly to inlet opening 310 of exit chamber 306. Baffles 248 and 250 act to disburse the incoming working air over that portion of the recovery tank's volume upstream of baffles 248 and 250 by forcing the working air to pass through openings 254, 291 and 293. Thus, the velocity of the air as it passes through the recovery tank 80 is slowed to a minimum value and the time that the working air spends within tank 80 is at a maximum thereby providing for more complete liquid precipitation.

It is preferred that baffles 248 and 250 are free standing with the opening 254 there between and openings 291 and 293 between the tank side walls 234L, 234R and baffle 250 to permit the free flow of recovered fluid there past. As shown in FIG. 2, the recovery tank 80 is releasably affixed to motor cover 230 by two rotatable latches 294L and 294R (FIG. 2) having curved tangs 295L and 295R. As depicted in FIGS. 15A and 15B, the latches 294 (the left one shown in these figures) are slidingly received within slots 296, in the left and right side walls 234 of the tank 80. FIG. 15A illustrates the latch 294L received in the slot 296 to affix the tank 80 to the motor cover 230 and FIG. 15B shows the latch 294L disengaged from the slot 296 to unlatch the tank 80 from the motor cover 230.

Referring to FIG. 14, the recovery tank lid assembly 301 incorporates therein an air/fluid separator comprising a hollowed lid 298 and bottom plate 300 sealingly welded together forming a plenum therebetween. The plenum is divided into two separate and distinct chambers, inlet chamber 304 and exit chamber 306, by separator wall 309 integrally molded into lid 298 and extending between the lid 298 and bottom plate 300. Inlet chamber 304 fluidly communicates with the front duct 156 (FIG. 3) through inlet opening 303 in the bottom plate 300. An inlet chamber exit passageway 308 in bottom plate 300 provides fluid communication between tank 80 and inlet chamber 304. Similarly, exit chamber 306 includes entrance passage 310, in bottom plate 300 providing fluid communication between tank 80 and exit chamber 306. An integrally formed arcuate lip or wall 312 extends down from the bottom surface of the bottom plate 300 and surrounds the inner semicircular edge of the passageway 308. The wall 312 prevents drops of liquid on the upper surface of the bottom plate from traveling through the passageway 308 and across the lower bottom surface of the bottom plate 306 to the entrance passage 310 of the exit chamber 306, where the drops can be drawn into the motor fan assembly 90 (FIG. 3). Instead, any drops passing through the passageway 308 will drip off the lower edge of the wall 312 and into the tank 80 (FIG. 12).

As seen in FIG. 3, it is preferable to provide a float 314 within a suitable float cage 316 to choke the flow of working air through passage 310 when the reclaimed fluid within recovery tank 80 reaches a desired level. A raised portion or nub 318 on the lid 298 is aligned over the float 314 to enhance the viewing of the float 314 when raised to indicate that the recovery tank 80 is full. Exit chamber 306 (FIG. 14) further includes discharge opening 320 for fluid communication with an integrally molded stand pipe 322 of tank 80 when lid assembly 301 is attached to the open top of tank 80.

Referring back to FIG. 14, integrally molded into lid 298 so as to be positioned about the periphery of exit opening 308 in bottom plate 300 are two vortex impeding arcuate baffles 324 and 326. The rear baffle 324 is attached to the bottom surface of the top wall 328 of the lid 298 and extends almost across the exit opening 308 such that it is spaced from the outer edge of the opening 308 near the side wall 330. The rear baffle 324 is also positioned a small distance in front of the center of the exit opening 308. Front baffle 326 attaches to the bottom surface of the top wall 328 of the lid 298 and extends from the side wall 330 to the edge of opening 308. A second flat rear baffle 327, attached to the side wall 330 and bottom surface of top wall 328, is oriented perpendicular with the side wall 330 and extends a partial distance across the exit opening 308. As viewed from the front of the opening, the front baffle 326 is oriented convexly and the rear baffle 324 is oriented concavely. The baffles 324, 326 are generally oriented perpendicularly with respect to each to other. An s-shaped rib 331, integrally formed on the bottom surface of the top wall 328, extends partially down a distance therefrom. The distance is about half of that between the bottom plate 300 and top wall 328 of the lid 301. The air and soiled liquid is extracted from the carpet and drawn through the suction nozzle 124 and side suction ducts 130, 132 to the inlet 303 by the motor/fan assembly 90 (FIG. 3).

Figure 16:
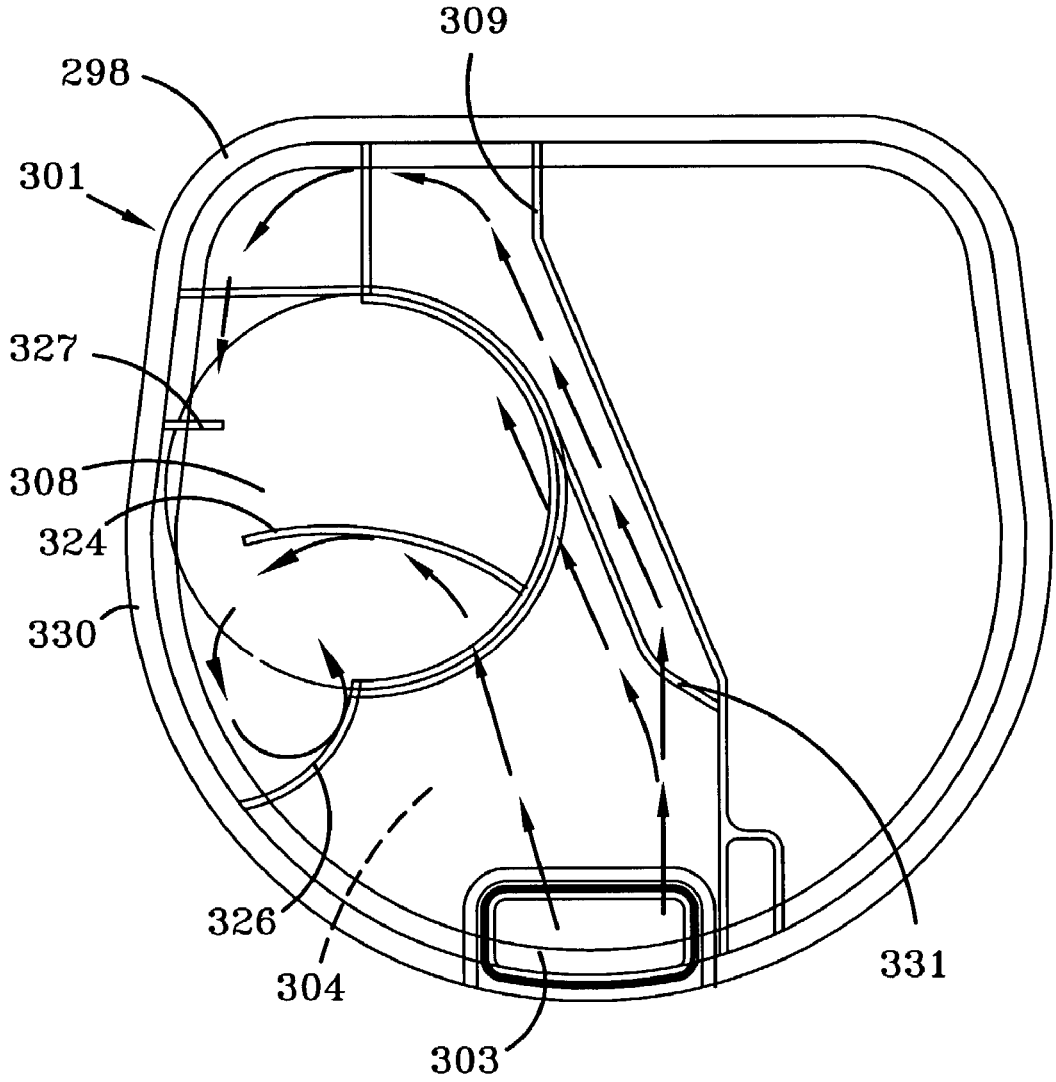
FIG. 16 is a top view of the lid assembly for the recovery tank of FIG. 12.

Then, as indicated by the arrows shown in FIG. 16 through the translucent lid 298, the stream of air and water coming from the inlet 303 impinges on the rear baffle 324 directing it to the front baffle 326 where a portion of it is then deflected to the center of the rear baffle 324. The air and liquid stream circulates around the front portion of the opening 308, due to concave nature of the baffle 324, and thus allows more separation of air from the water. In particular, the deflection of the air from the baffles 324, 326 and the re-circulation of the stream facilitates separation of the liquid from the air, due to the slowing of the stream, thereby allowing more time for the air to separate from the liquid. Further, when the stream of air is forced to turn, the relatively lighter air is able to negotiate the turn, where as the heavier liquid does not, thereby causing further separation. The rib 331 is located and oriented to deflect the air downward to slow it down and also direct a portion of the stream into the rear corners of the inlet chamber 304. There, the stream stalls allowing further separation, where it is also deflected by baffle 327. Also, the position of the baffle 324 near the center of the exit opening 308 causes the air and liquid stream to flow into a smaller portion of the opening 308 thereby minimizing splashing as the liquid collects on the bottom 240 of the tank 80. This reduces the possibility of liquid entering the motor area. With reference to FIGS. 3 and 14, the liquid enters the inlet chamber exit passageway 308 and travels down into the bottom of the tank 80. The separated air travels through the float cage 316 and into the stand pipe 322 exiting out the bottom of the rear body 84 of the frame assembly 83 as seen in FIG. 3.

As seen in FIG. 4, the working air exits along a pair of vents 335 formed on the bottom plate 333 of the extractor 60. The vents 335 are oriented such that a line extending between them is parallel to the front body 92. In effect, the exiting working air provides heat to the cleaning path of the carpet created by the extractor 60.

Figure 17:
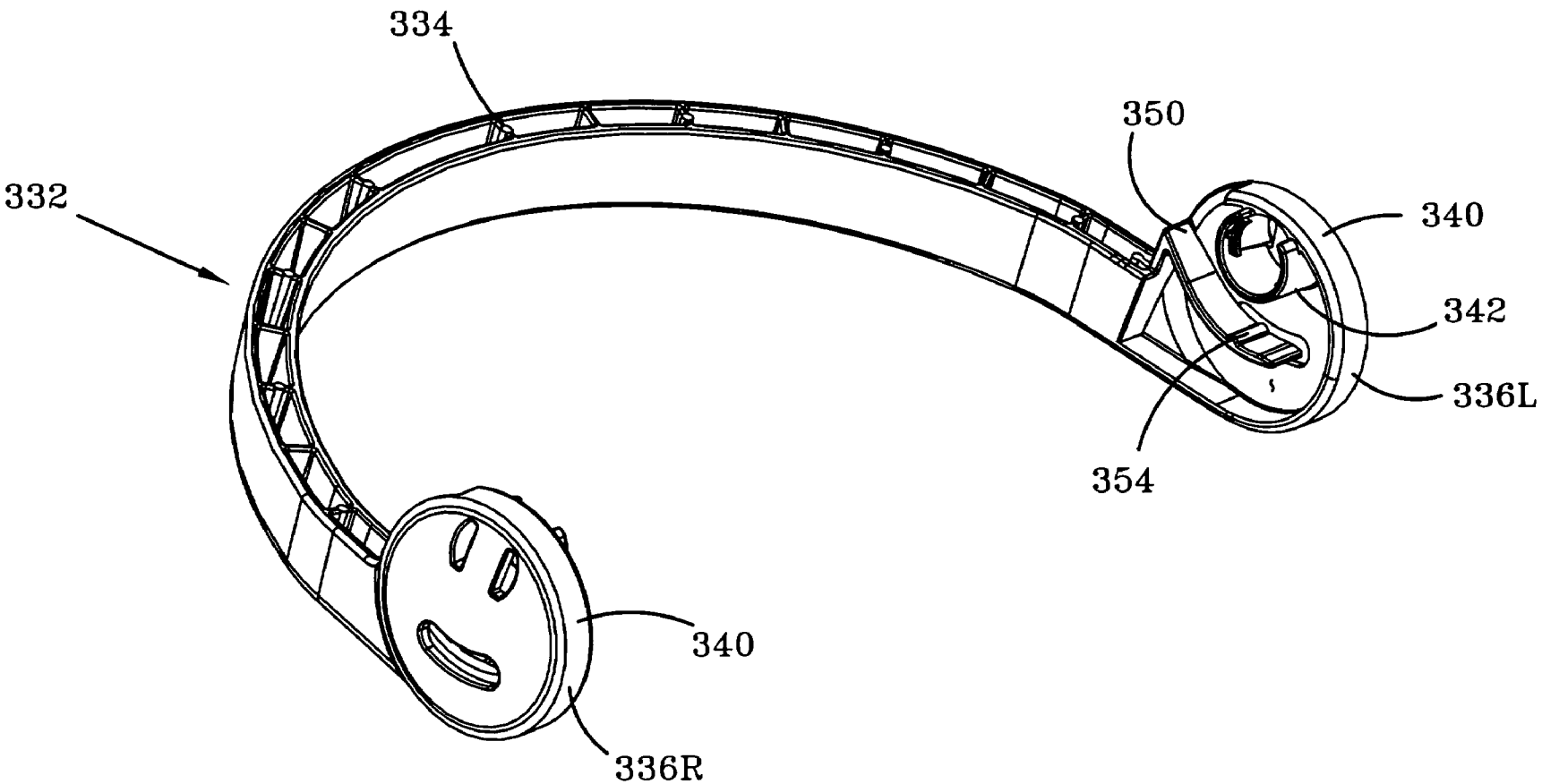
FIG. 17 is a perspective view of the handle of the recovery tank.

A u-shaped carrying handle 332 is pivotally connected to the upper portion of the recovery tank 80 as seen in FIG. 2. In particular, as depicted in FIG. 17, the carrying handle 332 includes a transverse curved portion 334 and a pair of circular end portions 336L, 336R, each integrally formed on respective opposite free ends of the curved portion 334. Each of the end portions 336 has an inwardly extending curved wall 340 that extends circumferentially around the outer edge of the end portion 336.

The carry handle 332 is pivotally attached to the tank 80 (FIG. 12) by mounting C-shaped sleeves 342, that extend inward from inner surfaces of the ends 336 of the leg portions 344L, 344R of the handle, over respective pivot posts 346L, 346R (FIG. 12) that extend out from opposing sides of the recovery tank 80. The carry handle 332 is pivotable into a forward, generally horizontal latched position (FIG. 18A), a generally upright carry position (FIG. 18B), and a rearward tank discharge position (FIG. 18C).

Figure 18A:
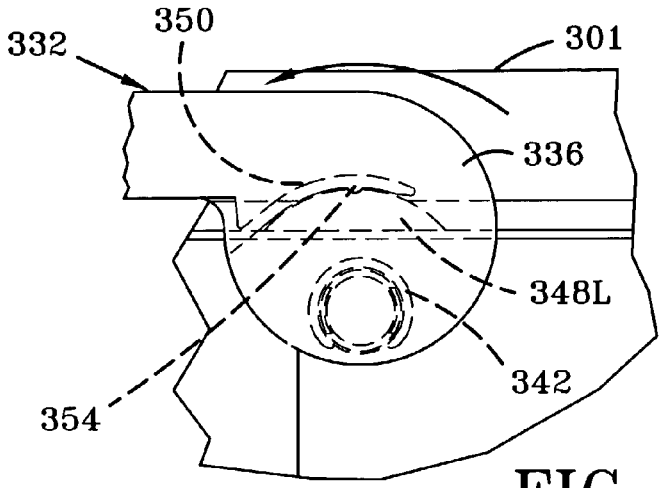
FIG. 18A is a sectional view taken along line 18A-18A.
Figure 18B:
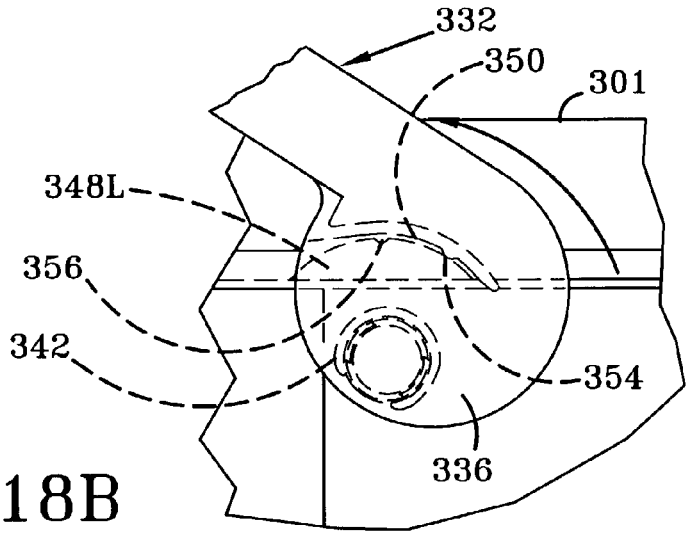
FIG. 18B is a view similar to FIG. 18A but with the handle of the recovery tank in a carry position.
Figure 18C:
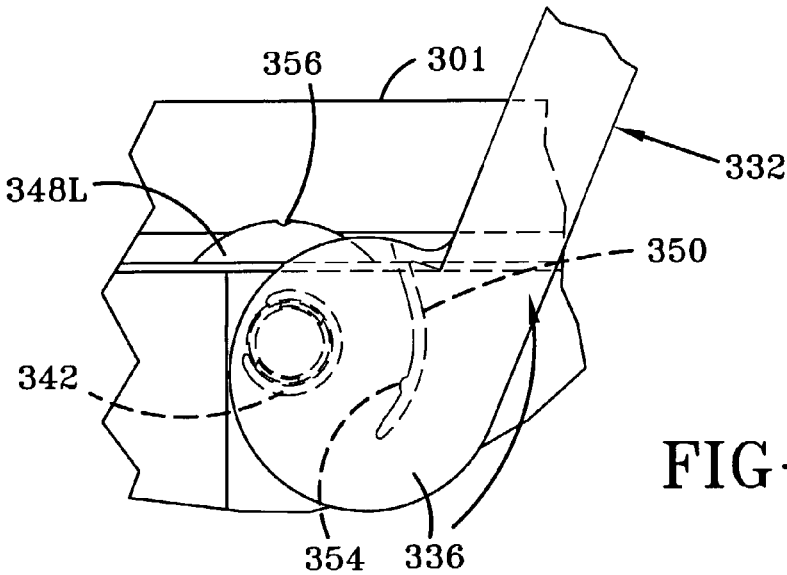
FIG. 18C is a view similar to FIG. 18A but with the handle of the recovery tank in a rearward discharge position.

With reference to FIGS. 18A, 18B, and 18C, the carrying handle 332 locks the recovery tank lid 301 to sealingly close the top of the recovery tank 80. Lid retaining members 348L, 348R (only the left one is illustrated in these figures, but the right one is similar) are preferably located on opposing outer edges of the lid 301 to engage respective lid latching members 350 on inner surfaces of the ends 336 of the carry handle 332 to securely latch the lid 301 onto the recovery tank 80. The lid latching members 350 are preferably sized and arranged on the carry handle 332 such that the lid latching members 350 engage the lid retaining members 348 and latch the lid 301 on the recovery tank 80 when the handle 332 is in the latched position (FIG. 18A) and when the handle 332 is in the carry position (FIG. 18B), but not when the handle 332 is in the discharge position (FIG. 18C).

A typical boss 354 and recess 356 detent arrangement is provided on the lid latching members 350 and the lid retaining members 348, respectively, to releasably retain the carrying handle 332 in the latched position. Such a latching arrangement and carrying handle design is similar to that of U.S. Pat. No. 5,901,408, the disclosure of which is hereby incorporated by reference.

Referring to FIG. 2, the handle assembly 62 basically comprises an upper handle portion 358 and lower body portion 360. The lower body portion 360 has a pair of trunnions 362L, 362R that are received in complementary journals 364L, 364R formed in the rear body 84 of the frame assembly 83 of the base 64. Trunnion brackets 366L, 366R are mounted over the trunnions to cover them, thereby pivotally securing the handle assembly 62 to the base 64. A handle release pedal 368 is pivotally connected to the rear center portion of the rear body 84 between the journals 364. The pedal 368 includes a head portion 370 for depression by a foot or other object. The pedal 368 further includes an elongated pivot rod 371, which extends longitudinally and is integrally formed with the head portion 370. Ears 372L, 372R, integrally formed with the body and extending rearwardly, are provided on opposite sides of the head portion 370. A hook shaped spring arm 374, integrally formed with the head portion 370, extends forwardly and bears against the rear body 84 of the frame 83.

Figure 19A:
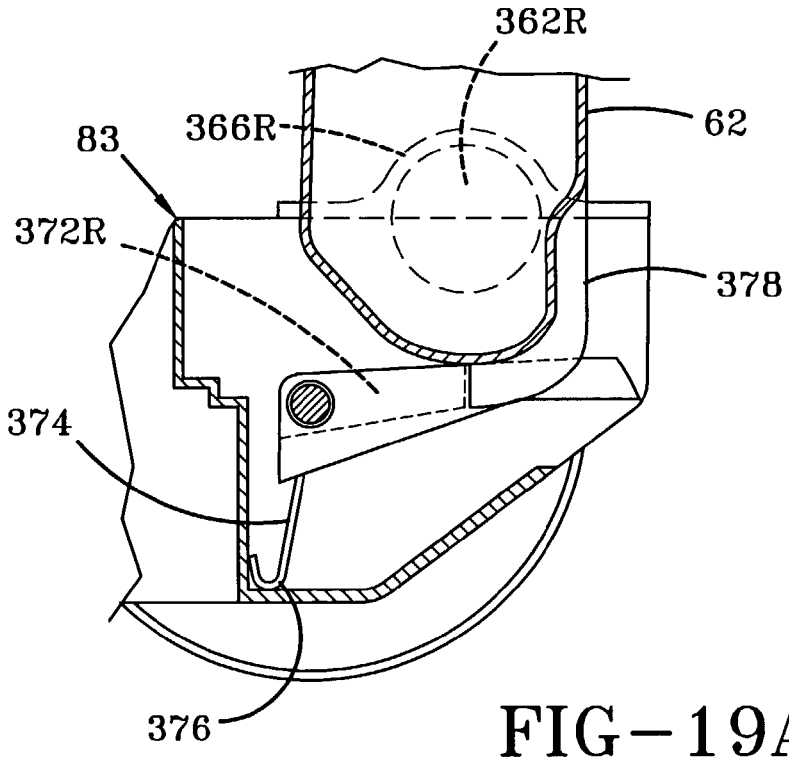
FIG. 19A is a partial side sectional view taken vertically through the carpet extractor of FIG. 1.
Figure 19B:
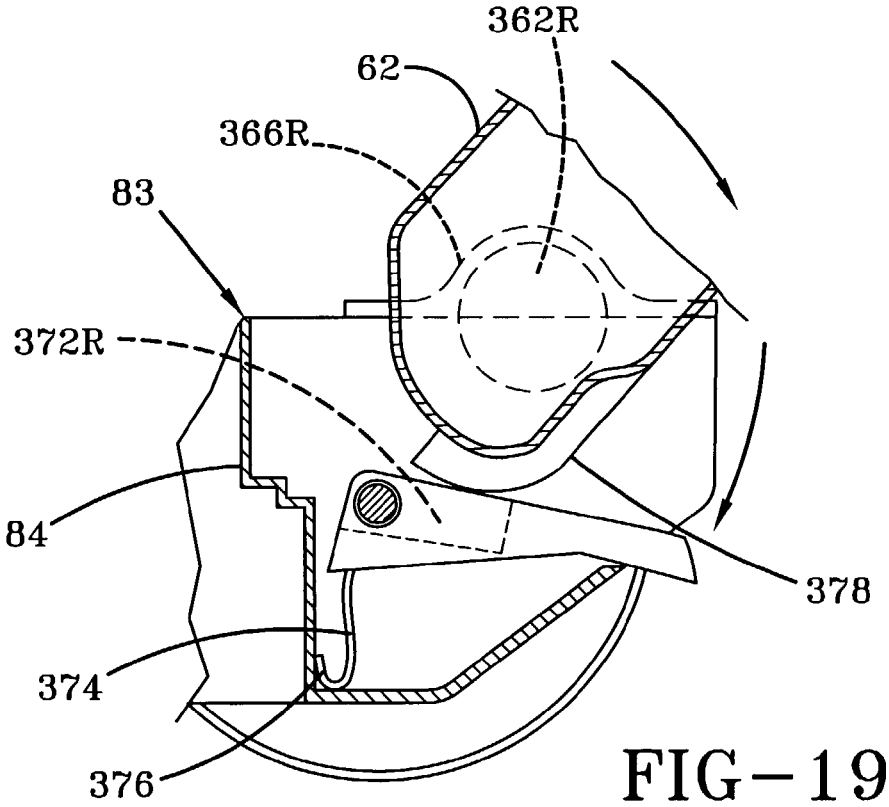
FIG. 19B is a view similar to FIG. 19A but with the handle assembly pivoted down.

As depicted in FIG. 19A, the arcuate end 376 of the arm 374 bears against the rear body 84 and urges the ears 372 (only the right one of which is shown) upwardly such that they are positioned and aligned behind respective rear stops 378 (only one of which is shown), integrally formed on the outer surface of the lower body portion 360 of the handle assembly 62. Thus, the ears 372 will engage the stops 378, thereby preventing the handle assembly 62 from pivoting down. However, when the pedal 368 is depressed as seen in FIG. 19B, the elastic spring arm 374 bends to allow the ears 372 to pivoted down and away from the stops 378 and thus, the handle assembly 62 is permitted to pivot down.

Figure 20:
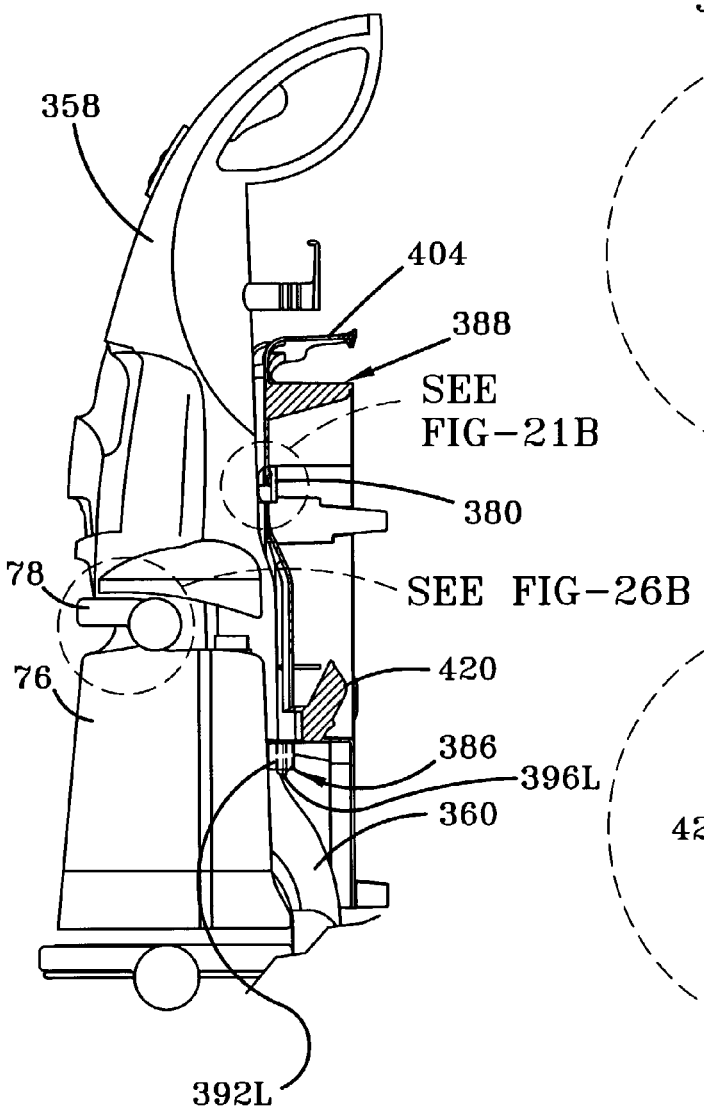
FIG. 20 is a partial side sectional view of the carpet extractor without the accessory hose and other tools.
Figure 21A:
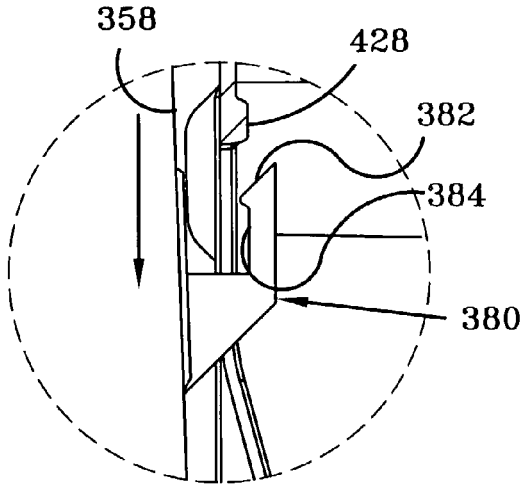
FIG. 21A is a view similar to FIG. 21B but with the nub of the slot of the tool caddy disengaged from the hook of the upper handle portion of the carpet extractor.
Figure 21B:
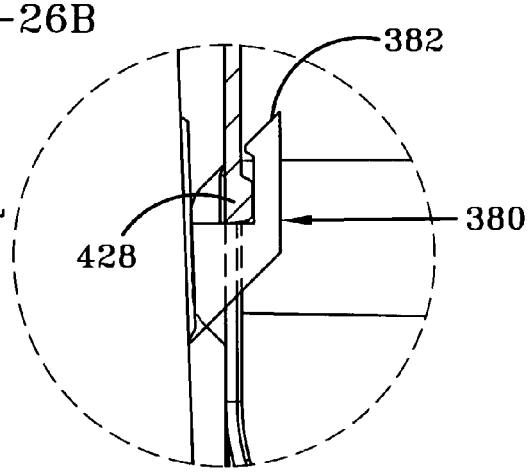
FIG. 21B is an enlarged sectional view of the portion of the carpet extractor as indicated in FIG. 20.
Figure 22:
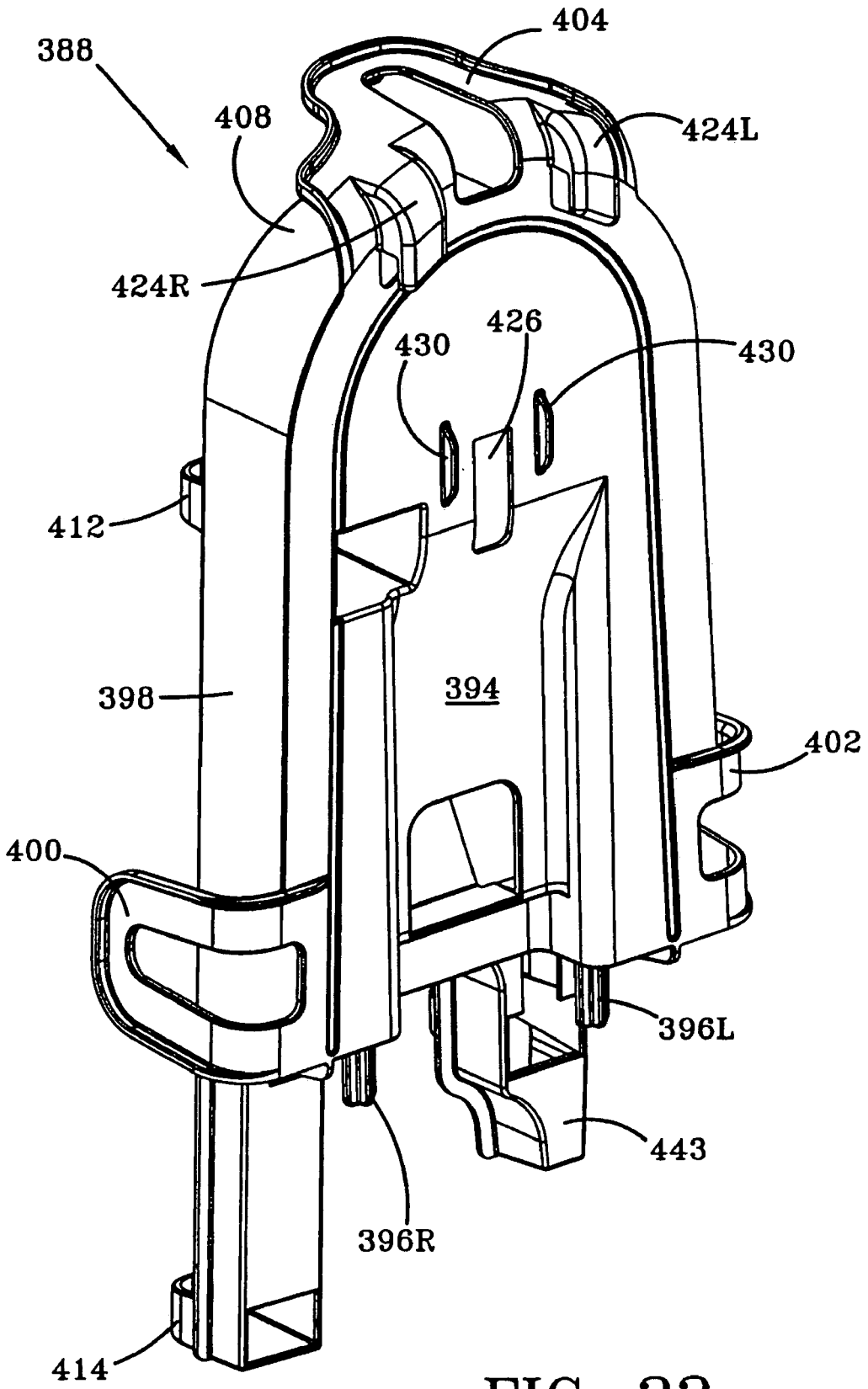
FIG. 22 is a front and right perspective view of the accessory tool storage caddy.
Figure 23:
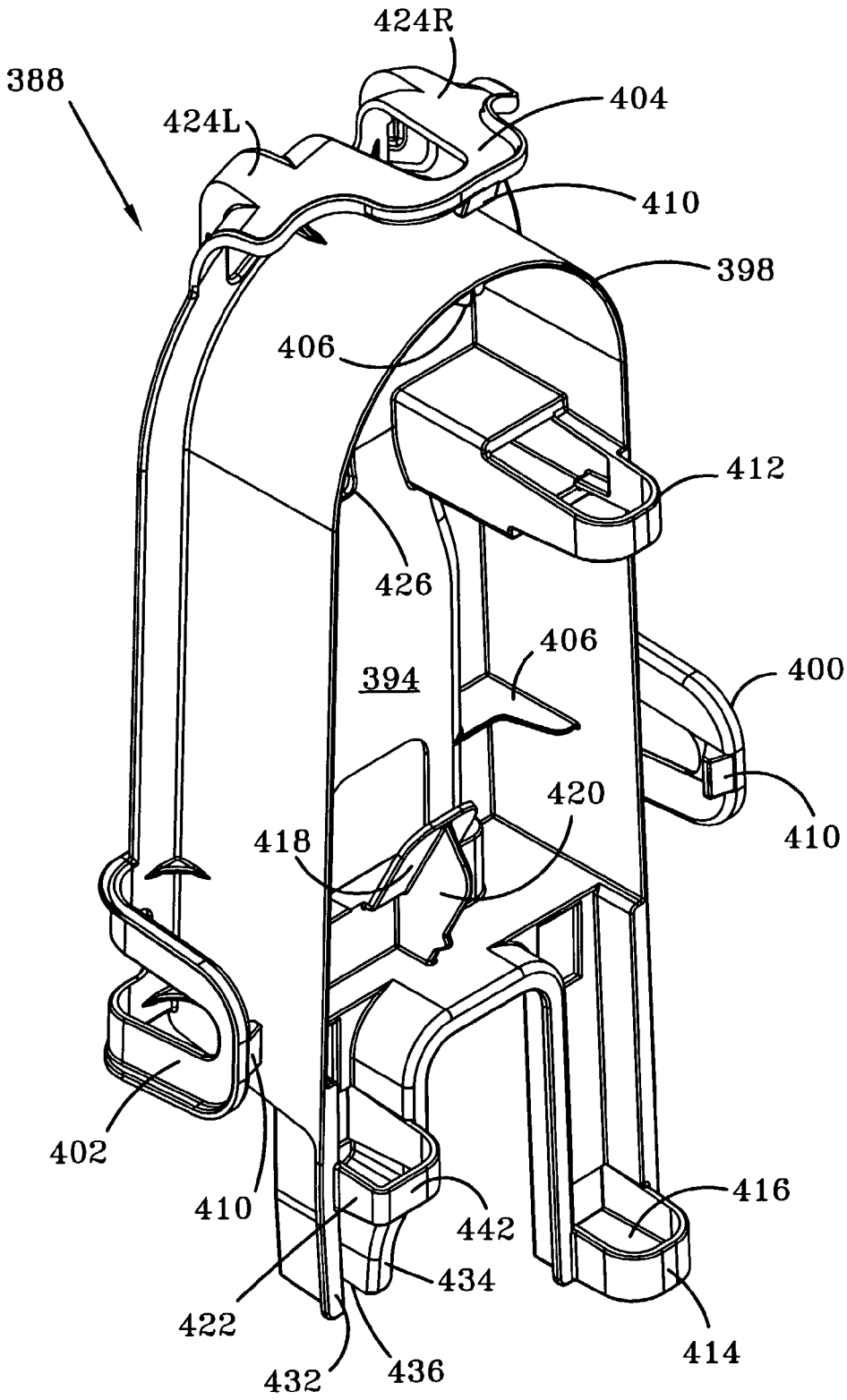
FIG. 23 is a rear and left perspective view of the accessory tool storage caddy.

As seen in FIGS. 20, 21A and 21B, the upper handle portion 358 has an integrally formed hook 380 extending upwardly. As best seen in FIGS. 21A and 21B, just below the nose 382 of the hook 380 is a notch 384. As seen in FIG. 2, a wire cover 386 (a portion of which is shown in FIG. 2) is mounted within the lower body portion 360 and includes an integrally formed rear flange portion 390 having a pair of tubular receptacles 392L, 392R formed on opposite ends thereof. As depicted and seen in FIG. 20, an accessory tool storage caddy 388 is removably mounted to the rear of the handle assembly 62. In particular, as shown in FIG. 22, the caddy 388 comprises a body 394 having a pair of posts 396L, 396R extending down from the bottom of the body 394. The rear side of the caddy 388, depicted in FIG. 23, includes an inverted u-shaped support wall 398 extending rearwardly upon which the accessory hose 188 (FIG. 24) is wound around. Integrally formed stiffening ribs 406 positioned between the body 394 and inner surface of the support wall 398 provide additional support to the support wall 398. The hose 188 releasably snap fits into clips 400, 402, and 404 formed on the body 394.

Figure 24:
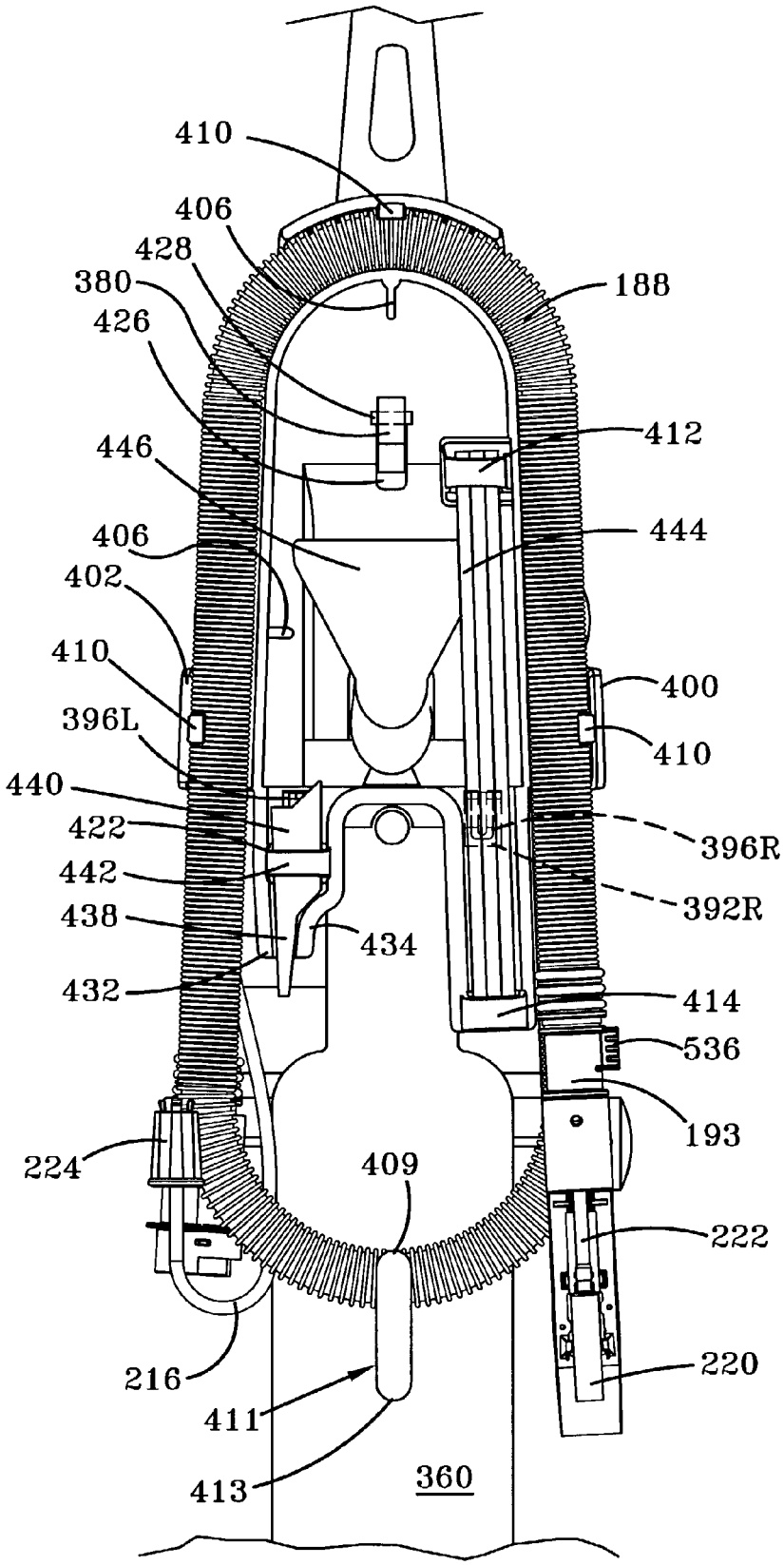
FIG. 24 is a partial rear elevational view of the carpet extractor with the accessory tool caddy mounted thereon and including the related tools on the caddy.

In particular, the pair of side clips 400, 402 located on opposite sides of the body 394 extend rearwardly from the body 394 over the support wall 398. The top clip 404 extends rearwardly from the body 394 over the bight portion 408 of the support wall 398. The clips 400, 402, and 404 include nubs 410 that further secure the hose 188 to the body 394 and support wall 398. As shown in FIG. 24, the hose 188 also is received by the upper hook 409 of a dual cord and hose hook assembly 411 with the lower hook 413 for receiving the cord (not shown). The hook assembly 411 is snap connected to the lower part of the lower body 360 of the handle assembly 62.

Integrally formed to the body 394 are aligned upper and lower enclosed u-shaped holders 412, 414 extending outwardly from the rear side of the body 394 for receiving an accessory tool such as a bare floor cleaning tool 444. The lower holder 414 has a bottom wall 416 (FIG. 23) to support the bare floor cleaning tool 444. Referring back to FIG. 23, in the center of the caddy 388 is formed a tongue member 418 that extends upwardly and outwardly at a slight angle. An upstanding fin portion 420 is integrally formed with the tongue member at the center of its rear surface and extends perpendicular to the tongue member 418. The fin portion 420 is also integrally formed with the body 394 to provide reinforcement to the tongue member 418. The tongue member 418 and fin portion 420 receive the hose end of an upholstery hand tool 446 for storage as seen in FIG. 24. Near the left of the tongue member 418 is a pocket holder 422 that has opposing end members 432, 434 that define a channel 436 for slidingly receiving the tapered working end 438 of a crevice tool 440 as seen in FIG. 24. The end member 434 is convexly curved, when viewed from the rear, to guide the working end 438 of the crevice tool into the channel 436. A looped piece 442 laterally extends over the crevice tool, which in combination with a front plate 443 (FIG. 22) extending across the front of the working end 438, provides for additional securement. As best shown in FIG. 22, integrally formed with the top clip 404 and extending forward and down from the front side of the top clip 404 is a pair of hooks 424L, 424R for hooking the caddy 388 around a coat hanger or the like for storage.

A vertical slot 426 is formed in the middle of the body 394. Just above the top edge of the slot on the rear side is a projection or nub 428 formed on the body as best seen in FIG. 24. The caddy 388 is mounted to the rear of the handle assembly 62 by inserting the hook 380 into the slot 426 as shown in FIG. 21A, until the nub 428 seats securely into the notch 384 under the nose 382 of the hook 380 as seen in FIG. 21B, and slidably inserting the posts 396 into their respective tubular receptacles 392 as seen in FIGS. 20 and 24. As shown in FIG. 22, spacers 430 are integrally formed on the front surface of the body 394 on opposite side of the slot 426 to provide additional stability to the caddy when mounted to the handle assembly 62.

To remove the caddy, a user grasps the caddy 388 and pulls upward, which cause the nub 428 to cam against the nose 382 so that the nub 428 unseats from the notch 384 of the hook 380, and slides the posts 396 out of the tubular receptacles 392.

Figure 25:
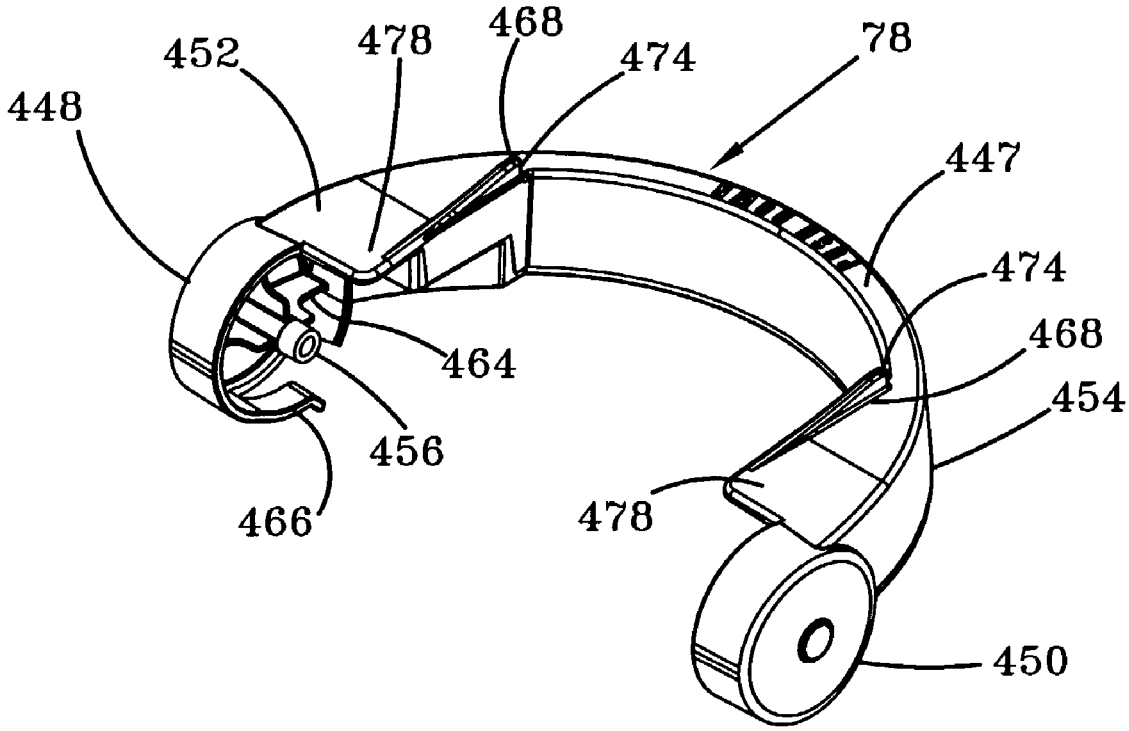
FIG. 25 is a top and rear perspective view of the carrying handle for the supply tank assembly.

The supply tank assembly 76 comprises a clean water supply tank 620 and a detergent supply tank 622 adhesively mounted to the clean water supply tank 620 as depicted in FIG 1. The supply tank assembly 76 includes a combination carrying handle and tank securement latch 78 providing a convenient means for carrying the tank and/or securing the tank to the extractor handle assembly 62. As seen in FIG. 25, tank handle 78 comprises a generally u-shaped plastic handle bar 447 having circular camming ends 448 and 450 integrally attached at each leg thereof 452, 454. The two camming ends 448 and 450 are generally parallel with respect to each other and each has an integrally formed pivot pin 456 extending inwardly into respective lateral recesses 460, 462 (FIG. 27) formed in the water tank for rotatable attachment of the carry handle 78 to the tank assembly 76. Each pin 456 includes a lateral webbed offset 464 which cams upon the surface 480 (FIG. 2) of the water tank 620 as the handle 78 rotates counter clockwise about the pins 456. Further, as the handle 78 rotates counterclockwise, integrally molded cantilever springs 466 (one associated with each end portion) acting upon the surface of the water tank bends, thereby storing energy therein biasing the carrying handle 78 clockwise.

Figure 26B:
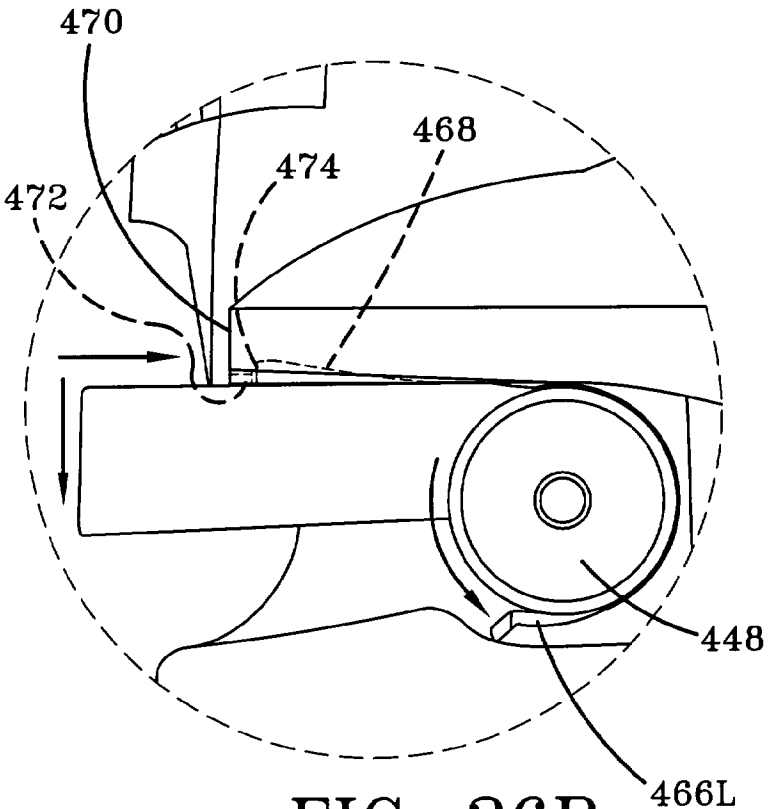
FIG. 26B is an enlarged sectional view of the portion of the carpet extractor as indicated in FIG. 20.

When tank assembly 76 is placed upon support shelf 743 of handle assembly 62 and rotated clockwise (as viewed in FIG. 26A) into the installed position, camming ribs 468 (provided upon each arm 434 and 436) engage and cam upon the edge 472 of hood 470 of the upper handle 358 forcing handle 78 downward until the notch or rear end 474 of the rib 468 entraps the edge 470 therein thereby securing tank 40 in place as depicted in FIG. 26B. As seen in FIG. 2, the edge 472 jogs or dips thereby defining grooves 476 which receive the ribs 468 to guide the carrying handle 78 during installation. To release tank assembly 76 the operator grasps handle bar 447 pulling it downward against the retarding force of cantilever springs 466, thereby releasing the notch or rear end 474 from locking engagement with edge 472 of hood 470 and removes the tank assembly 76 from the support shelf 743 of extractor handle assembly 62. Lateral offsets 478 (FIG. 25) on each of the legs 452, 454 of the handle 78 provide rotational stops which engage the tank surface 480 thereby preventing over travel of handle 78 and inadvertent removal of the handle from pins 456.

Figure 27:
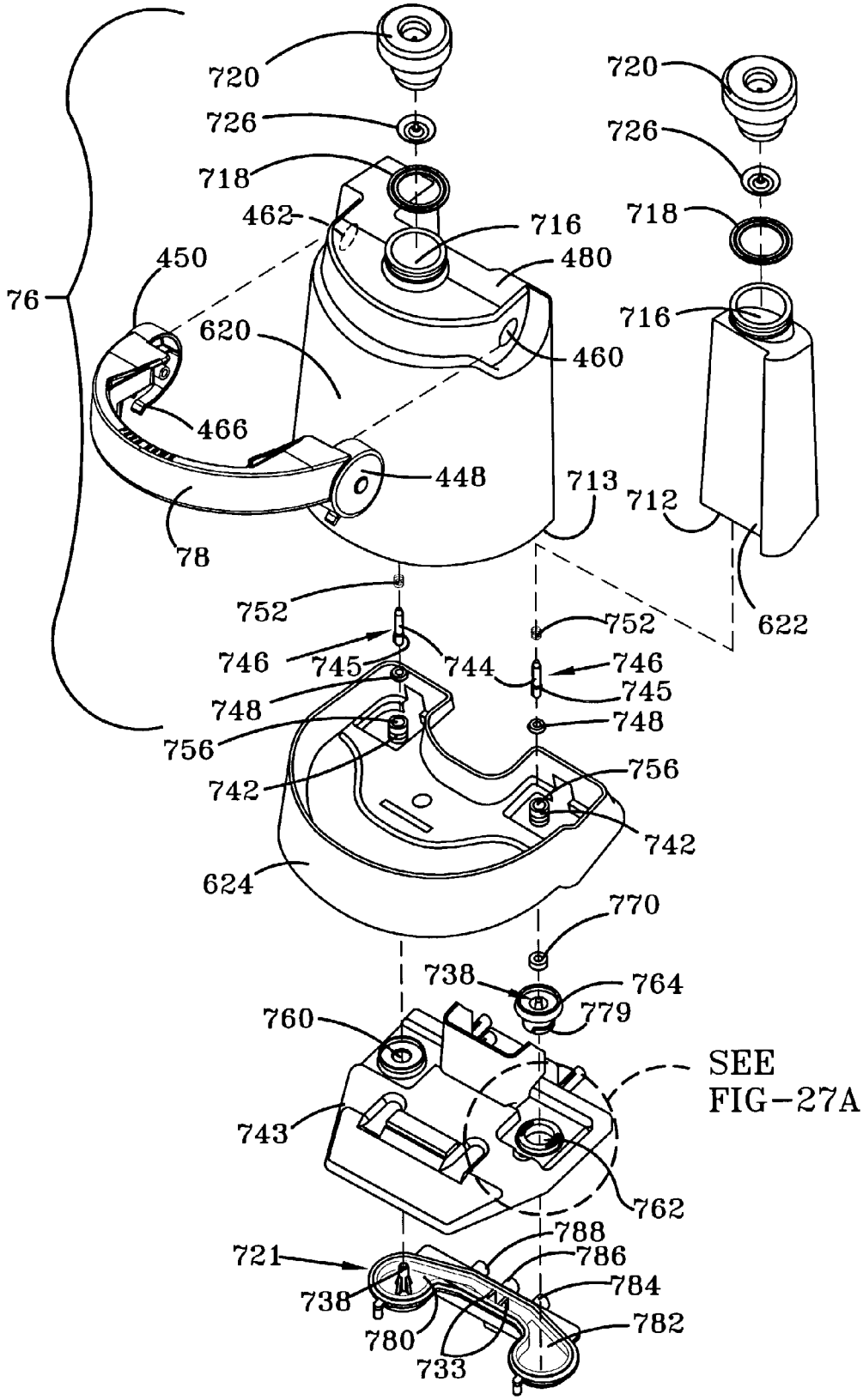
FIG. 27 is an exploded view of the upper portion of the fluid distribution system of the FIG. 16.

As depicted in FIG. 27, the supply tank assembly 76 is positioned upon a bottom base 624, which with the tank assembly 76 is removably mounted to a support shelf 743, which is secured to the lower body 360 (FIG. 2) of handle portion 62 (FIG. 2), and fluidly connected to a u-shaped reservoir 721 underneath the support shelf 743 via respective solution release valves 746. The reservoir 721 is vibrationally welded to the underside of the support shelf 743. Each of the supply tanks 620, 622 includes a solution release valve 746. The solution release valve 746 is normally in the closed position. However, as the tank assembly 76 is placed upon the reservoir 721, the solution release valve 746 in each of the supply tanks 620, 622 opens permitting clean water from the clean water supply tank 620 and detergent from the detergent supply tank 622 to flow into the reservoir 721. Upon removal of the tank assembly 76 from the reservoir 721, the solution release valves 746 close prohibiting liquid from flowing out of the supply tanks 620, 622.

Figure 28:
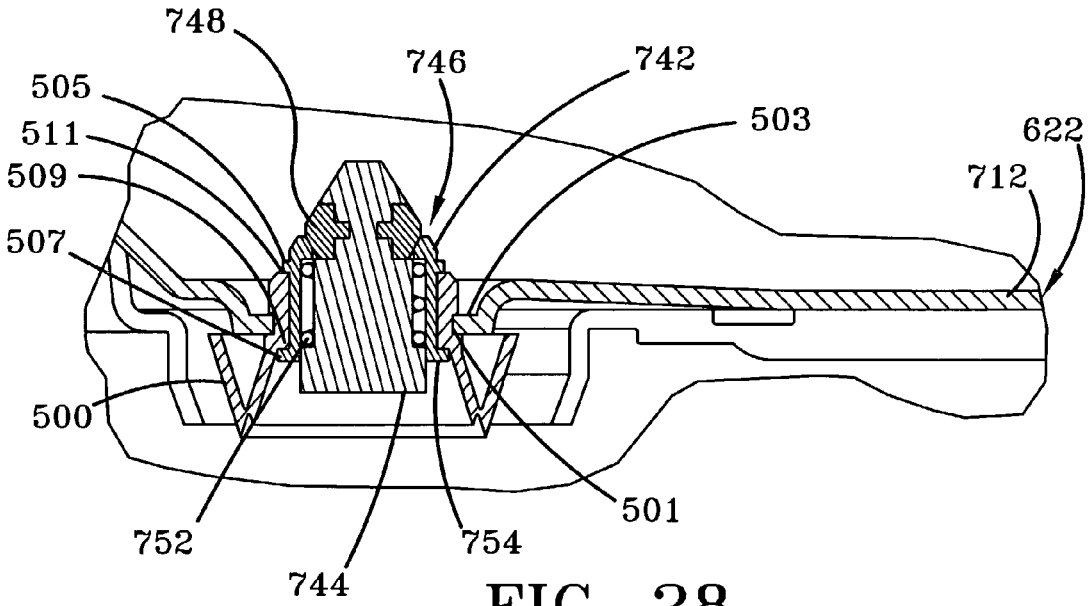
FIG. 28 is a partial sectional view taken along line 28-28 of FIG. 1.

As seen in FIG. 28, the solution release valve 746 is incorporated into bottom plate 712 of the detergent tank 622. The other solution release valve 746 is incorporated into the bottom plate 713 of the clean water tank 620, which is of similar construction. Thus, only the one for the detergent tank 620 will be described in more detail. The solution release valve 746 comprises a valve body 742 having an elongate plunger 744 extending coaxially upward therethrough. The plunger 744 having an outside diameter less than the inside diameter of the valve body 742 is provided with at least four flutes 745 (FIG. 27) to maintain alignment of the plunger 744 within the valve body 742 as the plunger 744 axially translates therein and permits the passage of fluid therethrough when the plunger 744 is in the open position.

The valve body 742 having a vertically extending bore 756 (FIG. 27) slidingly receives therein the upper shank portion of the plunger 744. An elastomeric circumferential seal 748 circumscribes plunger 744 for sealingly engaging valve body 742. The seal 748 is urged against the valve body 742 by action of the compression spring 752, circumscribing plunger 744. The spring 752 is positioned between the body 742 and the seal 748. The solution release valve 746 is normally in the closed position. However, with reference to FIG. 27, as the supply tank assembly 76 is placed upon the support shelf 743 of the handle 612, the pin 738 of the reservoir 721 aligns with plunger 744, thereby forcing plunger 744 upward to separate the seal 748 from the valve body 742, compressing spring 752, and opening the valve body 742 permitting detergent from the detergent supply tank 622 to flow through bore 756 of the valve body 742 into the reservoir 721. Upon removal of supply tank assembly 76 from the support shelf 743, the energy stored within compression spring 752 urges the seal 748 down against the valve body 742 to close the valve 746.

As depicted in FIG. 28, an elastomeric tank seal 500 has an annular groove 501 that receives the edge 503 of the outlet opening of the bottom plate 712 to secure it to the edge 503. Upper and lower annular ribs 505, 507 formed on the outer surface of the valve body 742 secure the elastomeric seal 500 to the valve body 742. In particular, the lower rib 507 engages the underside of a lip 509 on the seal and the upper rib extends over and engages the top edge 511 of the outlet opening.

Turning to FIG. 27, the support shelf 743 includes two circular openings 760, 762 that align with their respective solution release valves 746 associated with the corresponding clean water and detergent tanks 620, 622. The pin 738 associated with the solution release valve 746 of the clean water tank 620 is integrally formed on the reservoir 721 and extends through the opening 760. The pin 738 associated with the solution release valve 746 of the detergent tank 622 is integrally formed on a metering plate 764, which covers the opening 762.

Figure 27A:
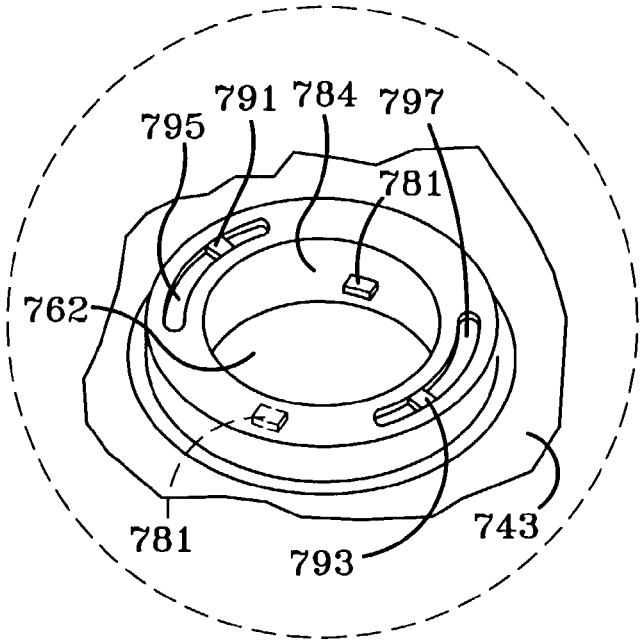
FIG. 27A is an enlarge view of the section of the support shelf circled in FIG. 27.
Figure 41:
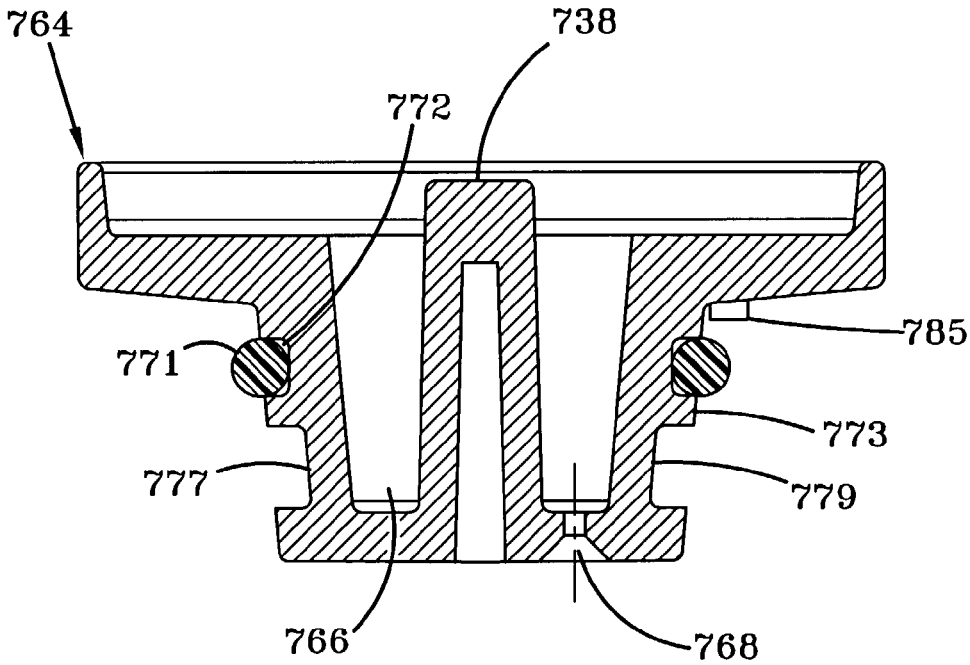
FIG. 41 is a vertical side sectional view through the center of the metering plate shown in FIG. 27.

As seen in FIG. 41, the metering plate 764 is generally circular in shape and includes a channel 766 circumferentially extending around the pin 738. The bottom of the channel 766 has an orifice 768 which meters the detergent solution at a value for the desired mix with the clean water. A toroid or donut shaped filter 770 (FIG. 27) is inserted into the channel for filtering out particles of the detergent. The metering plate 764 has an outer groove 772 extending around the wall 773 surrounding the channel 766 that receives a seal 771. A pair of L-shaped grooves 777, 779 are also formed on opposite sides of the wall 773. Referring to FIG. 27A, a pair of lateral projections 781 extending from the inner wall 784 (FIG. 27A) of the opening 762 (FIG. 27A) in the support shelf 743 each slidably engage a respective groove 777 or 779 (FIG. 41) to secure the metering plate 764 (FIG. 41) to the support shelf 743 within the opening 762, as the metering plate 764 is inserted into the opening 762 and turned. Also, as the metering plate 764 is turned, a pair of protrusions 785 (FIG. 41) extending down from the upper portion of the metering plate 764 ride up respective ramps 791, 793 formed in respective recesses 795, 797 and seat down behind the ramps to additionally secure the metering plate 764 to the support shelf 743 within the opening 762.

Figure 29:
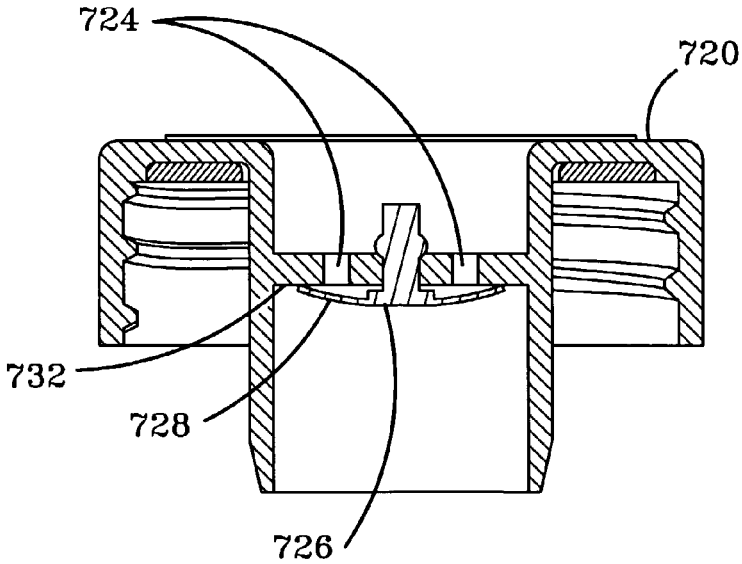
FIG. 29 is a vertical sectional view of the cap and valve provided therein for either the clean water supply tank or detergent tank shown in FIG. 27.

As also depicted in FIG. 27, each of the tanks 620, 622 has a cap 720 covering a top opening for filling the corresponding clean water tank 620 or detergent tank 622 with liquid. As best seen in FIG. 29, the top of cap 720 comprises a multiplicity of air breathing orifices 724. An elastomeric umbrella valve 726 is mounted to the underside of the top of the cap 720 under the orifices 724. As the ambient pressure within the associated tank 620 or 622 drops, by discharge of cleaning solution from therein, atmospheric pressure acting upon the top side of umbrella valve 726 causes the peripheral edge 728 to unseat from the surface 732 of cap 720 thereby permitting the flow of atmospheric air into the associated tank 620 or 622 until the ambient pressure therein equals atmospheric.

Once the pressure on both sides of the umbrella valve 726 equalize due to the shut off valves 800, 820 (FIG. 30) closing, the energy stored by deflection of the umbrella valve causes the peripheral edge 728 to reseat itself against surface 732 thereby preventing leakage of cleaning solution through the outlet of the associated tank 620 or 622. In effect, this prevents cross flow between the two tanks 620, 622, when the extractor unit 60 is turned off, thereby prohibiting mixing of the solutions in the tanks 620, 622. Referring to back to FIG. 27, cap 720 and flat circular seal 718 sealingly close fill opening 716. Liquid pressure against umbrella valve 726 further urges peripheral edge 728 against surface 732 thereby providing a leak free container. Such a valve is disclosed in co-owned U.S. Pat. No. 5,500,977, the disclosure of which is hereby incorporated by reference.

The reservoir 721 has a pair of dividing plates 733 which separates into a first compartment 780 fluidly connected to the clean water tank 620 and a second compartment 782 fluidly connected to the detergent tank 622. The first compartment 780 includes inner and outer outlet ports 786, 788. The second compartment 782 includes an outlet port 784.

FIG. 30 illustrates the overall solution distribution system, which will be described below. The inner outlet port 786 (FIG. 27) of the first compartment 780 (FIG. 27) is fluidly connected to a shut off valve 804 via a flexible hose 790 and the outer outlet port 788 (FIG. 27) is fluidly connected to a distributor 792 via a flexible hose 794. The outlet port 784 (FIG. 27) of the second compartment 782 (FIG. 27) is fluidly connected to the mixing Tee 796 via a suitable flexible hose 798. The shut off valve 800 is connected between the outer outlet port 788 of the first compartment 780 and the inlet 105R (FIG. 5) of the distributor 792 for turning on and off the flow of clean water used for rinsing. This shut off valve 800 is in the form of a solenoid valve, however, other types of valves also could be used.

Figure 31:
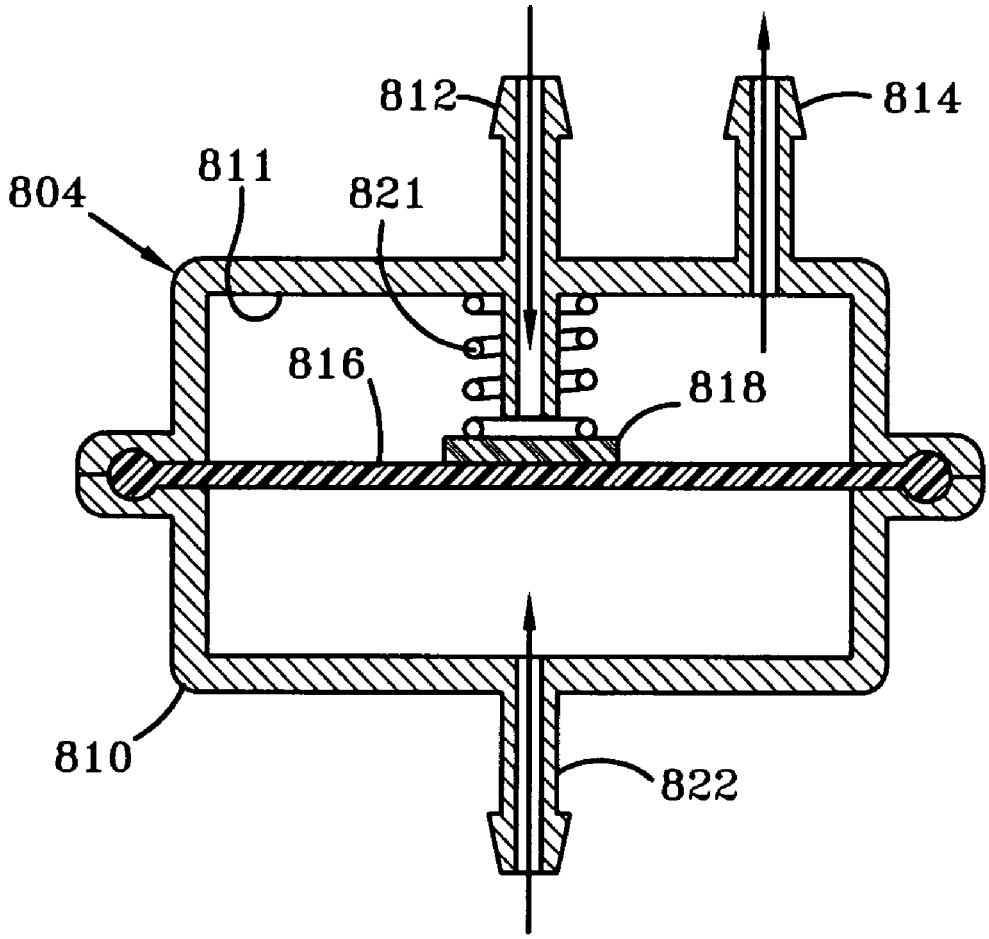
FIG. 31 is a vertical front section of the pressure-actuated shut off valve shown in FIG. 30.

A pressure actuated shut off valve 804 is connected between the inner outlet port 786 of the first compartment 780 and the mixing Tee 796 for turning off and on the flow of water. This shut off valve 804 is opened and closed by outside pressure via a conduit 806 connected between it and the outlet 807 of a pump 808 through a Tee 817. In particular, as shown in FIG. 31, the pressure actuated shut off valve 804 comprises a valve body 810 having a first port 812 fluidly connected to the clean water tank 620 and a second port 814 fluidly connected to the mixing Tee 796 via a flexible hose 815. A flexible rubber diaphragm 816 extends generally horizontally across the center of the valve body 810. The diaphragm 816 includes a valve seal 818 integrally formed on the diaphragm 816 at its center. The valve 804 includes a pressure port 822 fluidly connected to the outlet 807 (FIG. 30) of the pump 808.

In operation, when the pressure at the pressure port 822 is below a predetermined value such as between 7 to 10 psi, the valve seal 818 is spaced from the pressure port 822 to allow water to flow in both directions. Such a pressure value at the pressure port 822 occurs when the main shut off valve 820 is opened. The pump 808 also pressurizes the water mixed with detergent to draw it to the distributor 792. In this example, water flows to the inlet 105L (FIG. 5) of the distributor 792 due to gravity and the pressure produced by the pump 808. However, in this open position, the pressure actuated shut off valve 804 could allow detergent to flow in the opposite direction, if for example, the pump 808 were placed between the valve 804 and the clean water tank 620 to draw the detergent to the clean water tank 620 by pressure.

When the pressure exerted on the diaphragm 816 exceeds a second predetermined value such as between 20 to 30 psi, it flexes the diaphragm 816 towards the first port 812, urging the valve seal 818 against the first port 812, thereby sealing the first port 812 to close the valve 804. Thus, with the valve 804 closed, clean water or detergent is prevented from flowing through it. When the pressure lowers below the predetermined value, the diaphragm 816 flexes back to unseal the valve seal 818 from the first port 812 thereby opening the valve 804. Optionally, a spring 821, inserted around the portion of the first port 812 extending into the valve body 810, can be positioned between the inner upper wall 811 of the valve body 810 and diaphragm 816 to urge the valve seal 818 to unseal quicker.

Referring back to FIG. 30, the outlet of the mixing Tee 796 is fluidly connected via flexible hose 823 to the inlet of the pump 808, which provides pressure to draw the cleaning solution to the distributor 792 via the inlet 105L (FIG. 5). A relief valve 809 is fluidly connected across the pump 808 to limit the pressure at the outlet 807 of the pump 808 to a predetermine value. The outlet 807 of the pump 808 is fluidly connected to the main shut off valve 820 via flexible hoses 825, 874 and 876. This shut off valve 820 is in the form of a solenoid valve, however, other electrical actuated valves could be also used.

Figure 32:
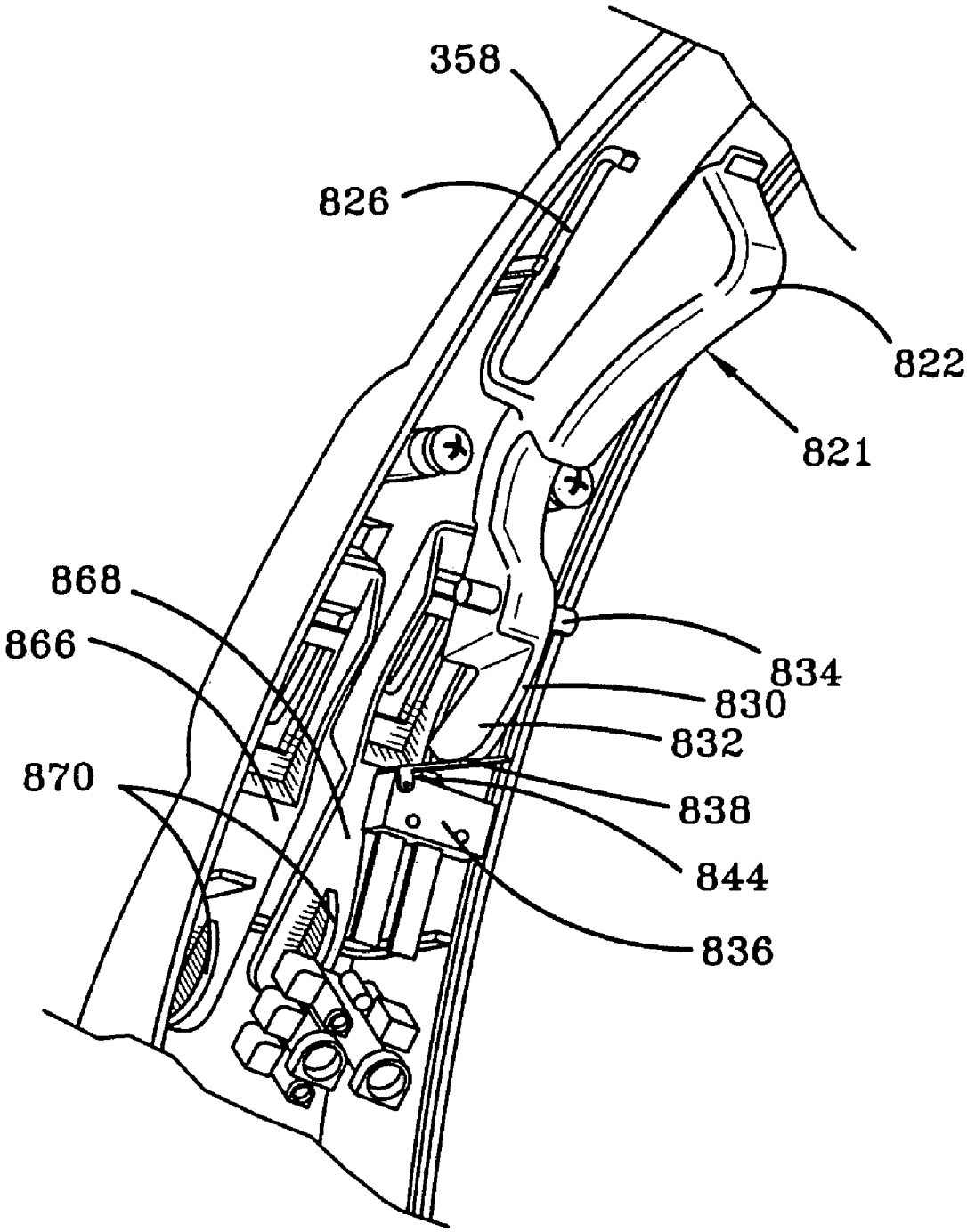
FIG. 32 is a fragmentary rear perspective view of an upper portion of the handle of FIG. 1 with portions cut away to show elements of the trigger switch and actuating rods for the cleaning mode switch assembly.
Figure 33:
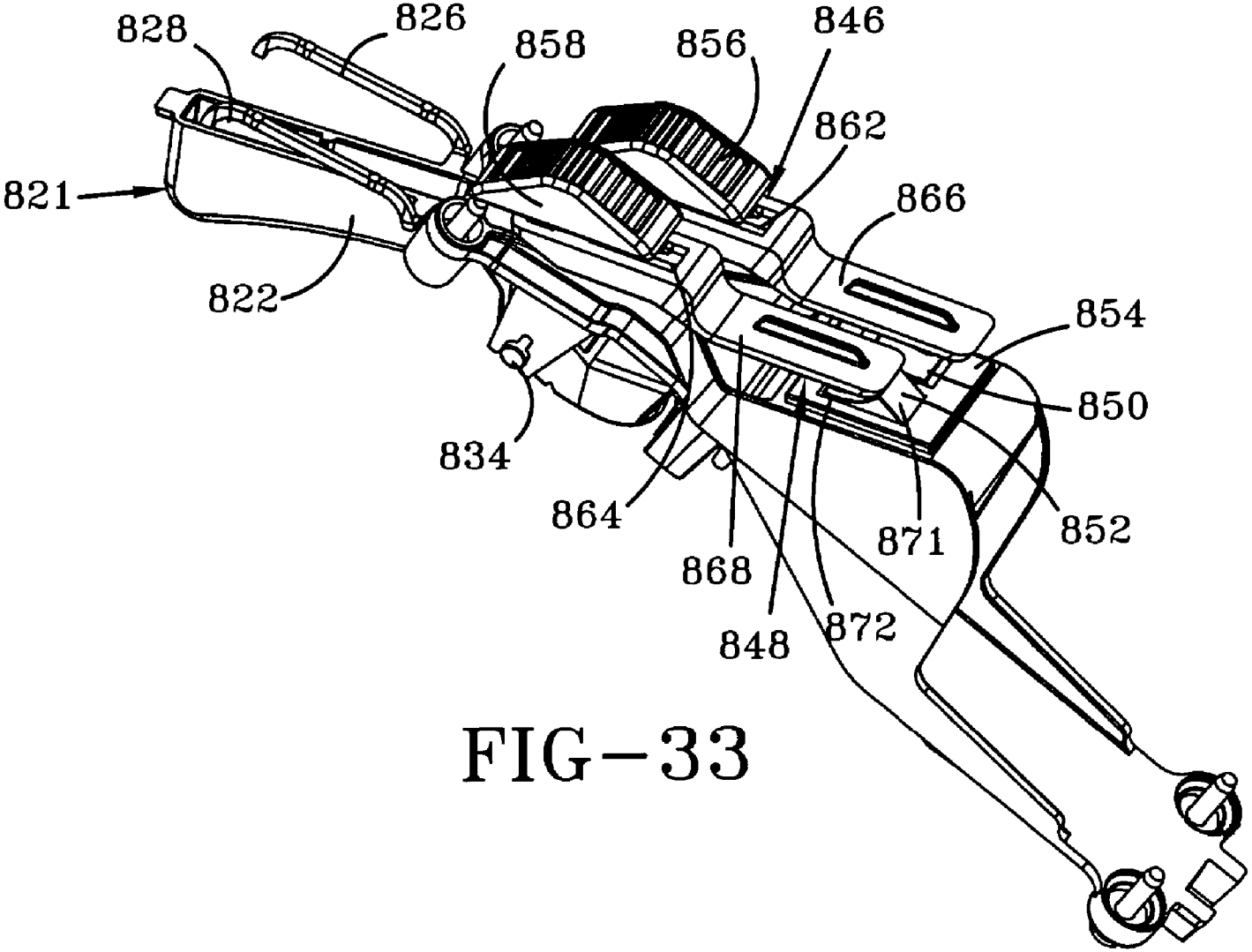
FIG. 33 is a fragmentary front rear perspective view of an upper portion of the handle of FIG. 1 with portions cut away to show the cleaning mode switch assembly and related parts.

Referring to FIGS. 32 and 33, a trigger switch 821 is used to dispense either mixed detergent and clean water or only clean water. The trigger switch 821 includes a trigger 822 pivotally connected to the upper handle portion 358 approximately near a closed looped hand grip 824 (FIG. 1) of the upper handle portion 358 at a pivot 834. Integrally molded onto the trigger 822 are two cantilever springs 826, 828 (FIG. 33), one on each lateral side thereof. The cantilever springs 826, 828 urge the trigger 822 outwardly or downwardly which places one of the selected shut off valves 800, 820 (FIG. 30) in the closed position. In particular as depicted in FIG. 32, an arm 830 having a curved end portion 832 extends downwardly from the pivot 834 of the trigger 822 terminating adjacent a microswitch 836 of the trigger switch 821.

A lever arm 838 is connected to the microswitch 836 and extends over a spring-loaded push button 844 on the microswitch 836. When the upper portion of the trigger 822 is positioned downwardly, the curved end portion 832 is spaced from the lever arm 838.

Figure 34:
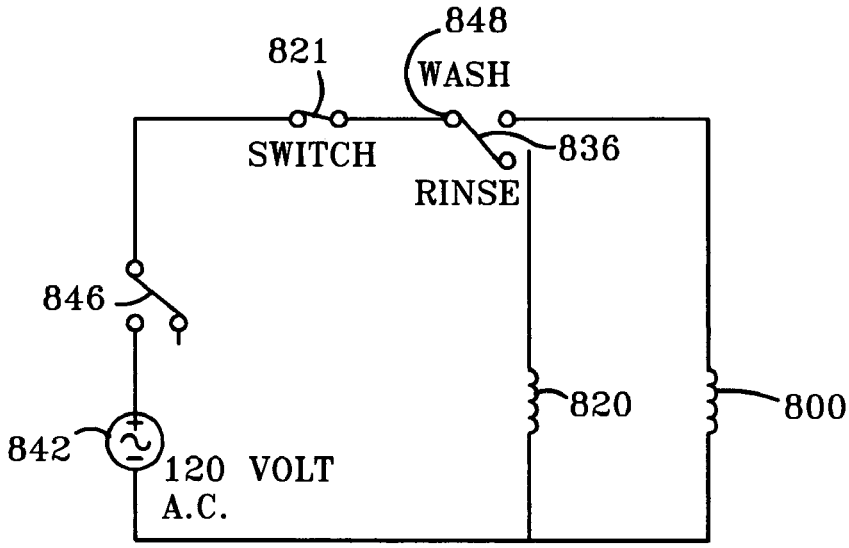
FIG. 34 is a schematic diagram showing the electrical circuit for the fluid distribution system used in the embodiment shown in FIG. 1.

In this position with reference to FIG. 34, the microswitch 836 opens the circuit between one of the solenoid shut off valves 800, 820 and the main power source 842, thereby denergizing the selected valve 800 or 820 and closing it. When the upper portion of the trigger 822 is squeezed or depressed, the curved end portion 832 cams against the lever arm 838 such that the lever arm 838 depresses the push button 844 on the microswitch 836. Upon depression of the push button 844, the microswitch 836 closes the circuit as depicted in FIG. 34 between one of the solenoid shut off valves 800, 820 and the main power switch assembly 846 (FIG. 34). If the main power switch assembly 846 is switched on to connect the power source 842 to the selected solenoid shut off valve 800 or 820 and the trigger 822 is squeezed or depressed, the selected solenoid shut off valve energizes and opens.

A cleaning mode switch assembly 848 is connected between the microswitch 836 and the water and main solenoid shut off valves 800, 820 to select the mode of cleaning. As shown in FIG. 33, the cleaning mode switch assembly 848 and main power switch assembly 846 include respective rocker arms 850, 852 positioned adjacent each other and mounted in a module 854 which is mounted in the upper handle portion 358. The rocker arms 850, 852 are actuated by corresponding slide switches 856, 858 which are received in a recess 860 (FIG. 1) just below the hand grip 824. The slide switches 856, 858 snap connect into corresponding slots 862, 864 formed on the upper portions of respective actuating rods 866, 868. Cam portions 870 are formed on lower portions of the actuating rods 866, 868 for engaging their corresponding rocker arms 850, 852. When one of the slide switches 856, 858 is slid downwardly, the cam portion 870 depresses the lower portion 871 of the rocker arm 850 or 852 to switch it in one position. This action also raises the upper portion 872 of the rocker arm 850 or 852. Then, when the slide switch 856 or 858 is then slid upwardly back, the cam portion 870 depresses the upper portion of the rocker arm 850 or 852 to switch it in another position and thereby raise the lower portion 971 of the rocker arm 850 or 852. It should be noted that the locations of cleaning mode switch assembly 848 and main power switch assembly 846 in the recess 860 can be switched. In other words viewed from FIG. 33, the cleaning mode switch assembly 848 can be located on right portion of the recess 860 instead of the left portion and the main power switch assembly 846 can be located on the left portion of the recess 860 instead of the right portion.

In operation, a user slides the slide switch 856 of the main power switch assembly 846 down to electrically connect the power source 842 to the microswitch 836, suction motor 90, and pump 808, turning them on. Referring to FIG. 30, the pump 808 conducts the pressurized cleaning solution through a flexible hose 874 to the control valve 877 which selectively allows the liquid to flow to either the inlet 105L (FIG. 5) of the cleaning distributor via supply tube 876 or the hand-held cleaning attachment 188 (FIG. 9) via the solution tube 216. The cleaning liquid distributor 792 evenly distributes the cleaning liquid to each of the rotary scrub brushes 72. The scrub brushes 72 then spread the cleaning liquid onto the carpet (or bare floor), scrub the cleaning liquid into the carpet and dislodge embedded soil. Such a distributor 792 and scrub brushes 72 are substantially disclosed in commonly owned U.S. Pat. No. 5,867,857, the disclosure of which is hereby incorporated herein as of reference.

Referring to FIG. 1, as is commonly known, the carpet extractor 60 distributes cleaning solution to the carpeted surface and substantially simultaneously extracts it along with the dirt on the carpet in a continuous operation. In particular, soiled cleaning liquid is extracted from the carpet by the suction nozzle 124, which communicates with the recovery tank 80. A vacuum is created in the recovery tank 80 by the motor fan assembly 90 (FIG. 3) that draws air from the recovery tank 80 and exhausts the air to the carpeted surface as previously described.

If the wash cleaning mode is desired, the user slides the slide switch 858 of the cleaning mode switch assembly 848 upwardly to the upper end of the recess 860 to electrically connect the microswitch 836 (FIG. 34) to the main solenoid shut off valve 820 (FIG. 34). With reference to FIG. 30, the control valve 877 is positioned to direct the cleaning solution to the distributor 792. Then, the user squeezes the trigger 822 (FIG. 1), which opens the main solenoid, shut off valve 820 to allow the cleaning solution composed of detergent mixed with clean water to flow to the distributor 792 and brushes 72, where it is distributed and scrubbed on the carpet. If rinsing is desired, the user slides the slide switch 858 of the cleaning mode switch assembly 848 downwardly to the lower end of the recess 860 to electrically connect the microswitch 836 to the water solenoid shut off valve 800. Then, the user squeezes the trigger 822, which opens the water solenoid shut off valve 800 to allow clean water from the clean water tank 620 to flow to the distributor 792 and brushes 72, where it is distributed and scrubbed into the carpet.

Figure 38:
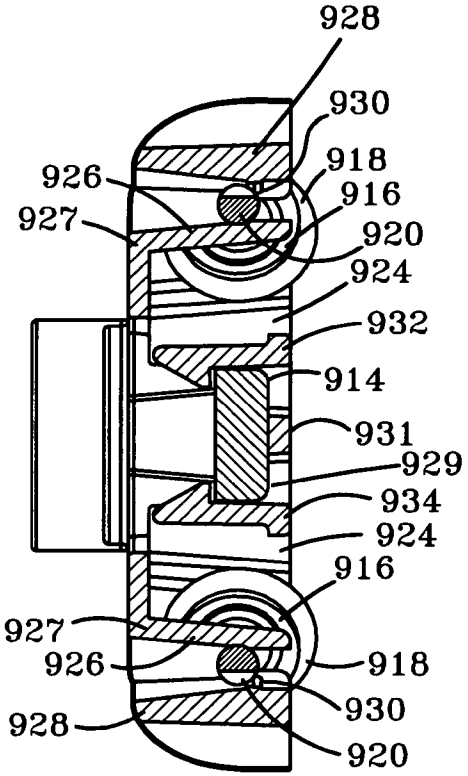
FIG. 38 is a sectional view taken along line 38-38 of FIG. 37.
Figure 37:
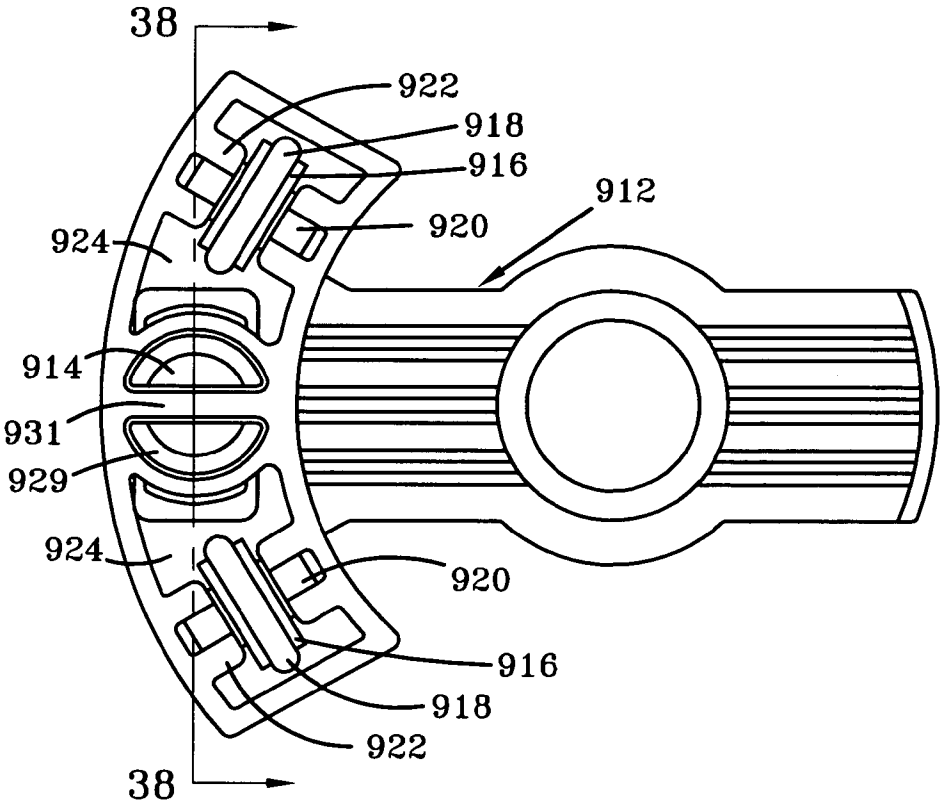
FIG. 37 is a side elevational view of another actuator lever and related parts used on the wheel rotation activating assembly of FIG. 35.

Alternatively, FIGS. 37 and 38 depict another actuation lever 912 with accompanying magnet 914 and rollers 916. These rollers 900 include rubber tires 918 secured around them and axles 920 extending through the center. The rollers 916 with the tires 918 are rotatably positioned in recesses 924 formed in the side 927 of the actuator lever 912 opposing the wheel disc 894. The axles 920 are snap connected into u-shaped holders 922 formed in the side of the actuator lever 912 opposing the wheel disc 894.

In particular with reference to FIG. 38, the axles 920 are slidably inserted between elastic legs 926, 928 of the holder 922, engaging a pair of opposing ledges or barbs 930 formed on the legs 926, 928 which cause the legs 926, 928 to deflect outwardly to allow the holder to pass through. After the holder is inserted beyond the barbs, the legs retract back so that the barbs secure the axles within the holder. The magnet 914 is seated into an opening 929 of the actuation lever 898 and held securely in place by elastic catches 932, 934 engaging it against the barbs 930 extending across the center of the opening 929.

Figure 26A:
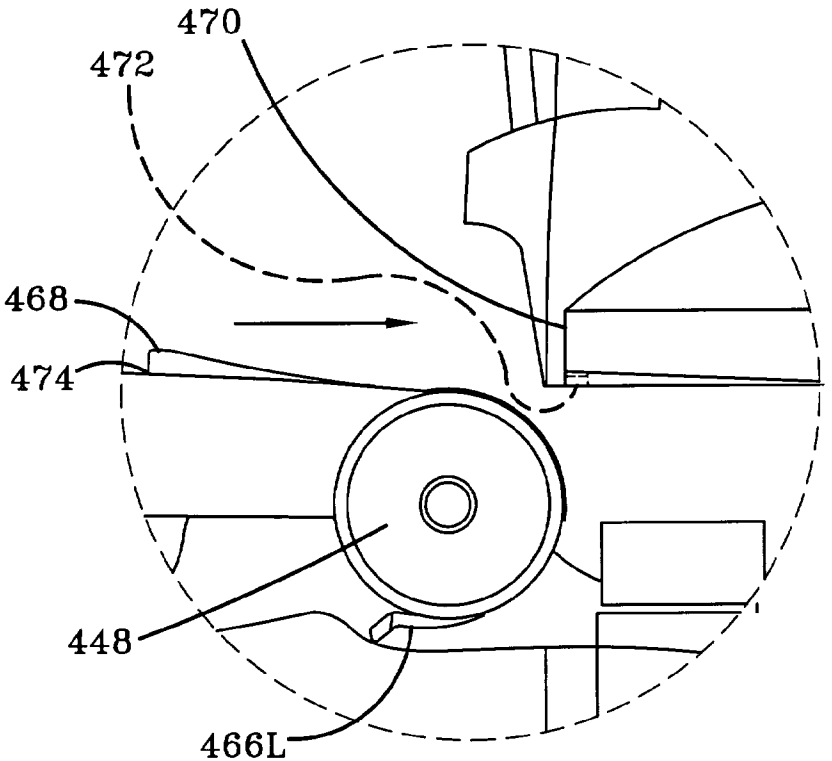
FIG. 26A is a view similar to FIG. 26B but with the carrying handle unlatched from the edge of the hood of the upper handle portion of the handle assembly of the carpet extractor.
Figure 35:
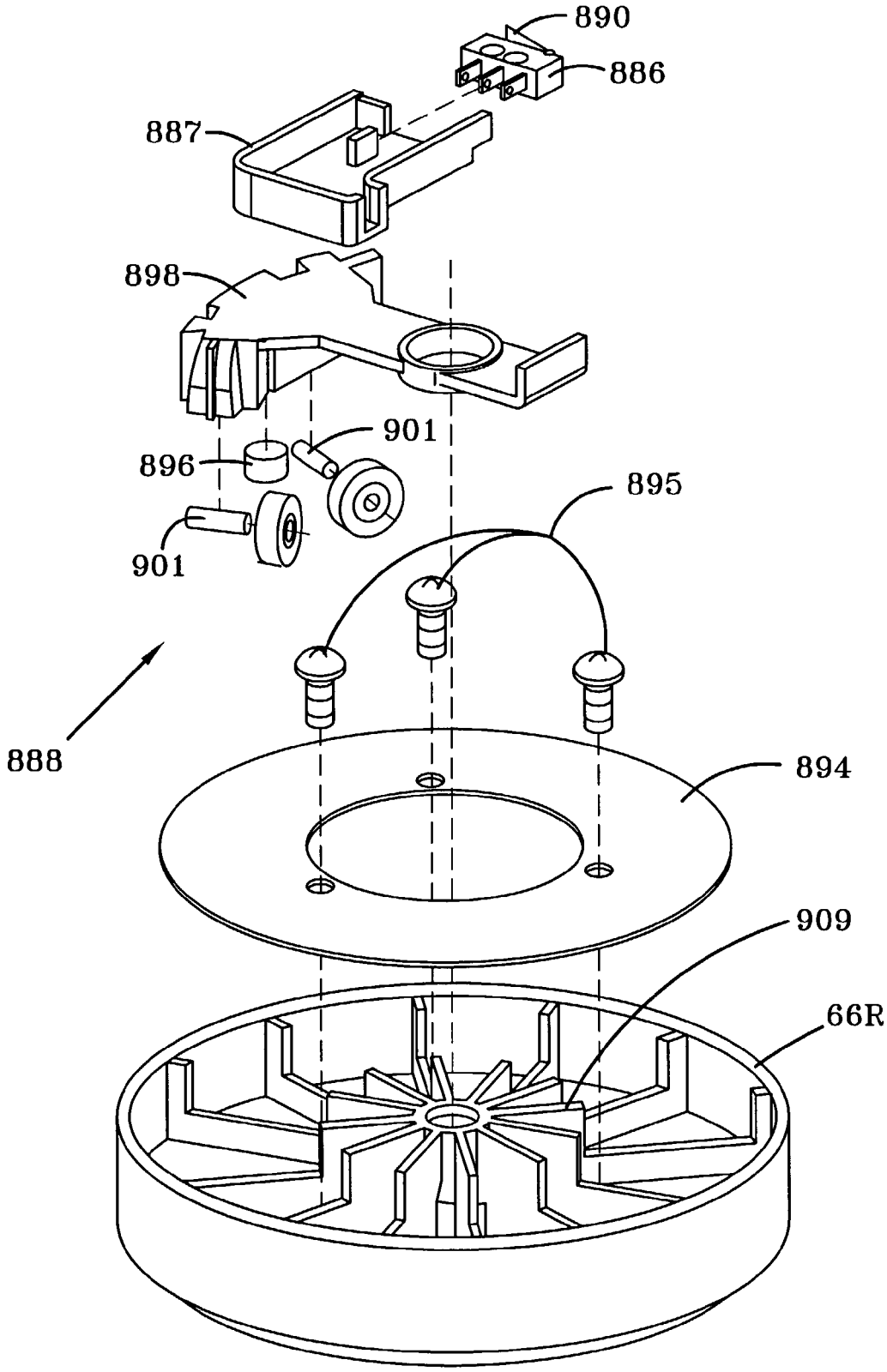
FIG. 35 is an exploded view of the wheel rotation activating assembly and left rear wheel of the embodiment shown in FIG. 1, which uses the electrical circuit of FIG. 34A.
Figure 36A:
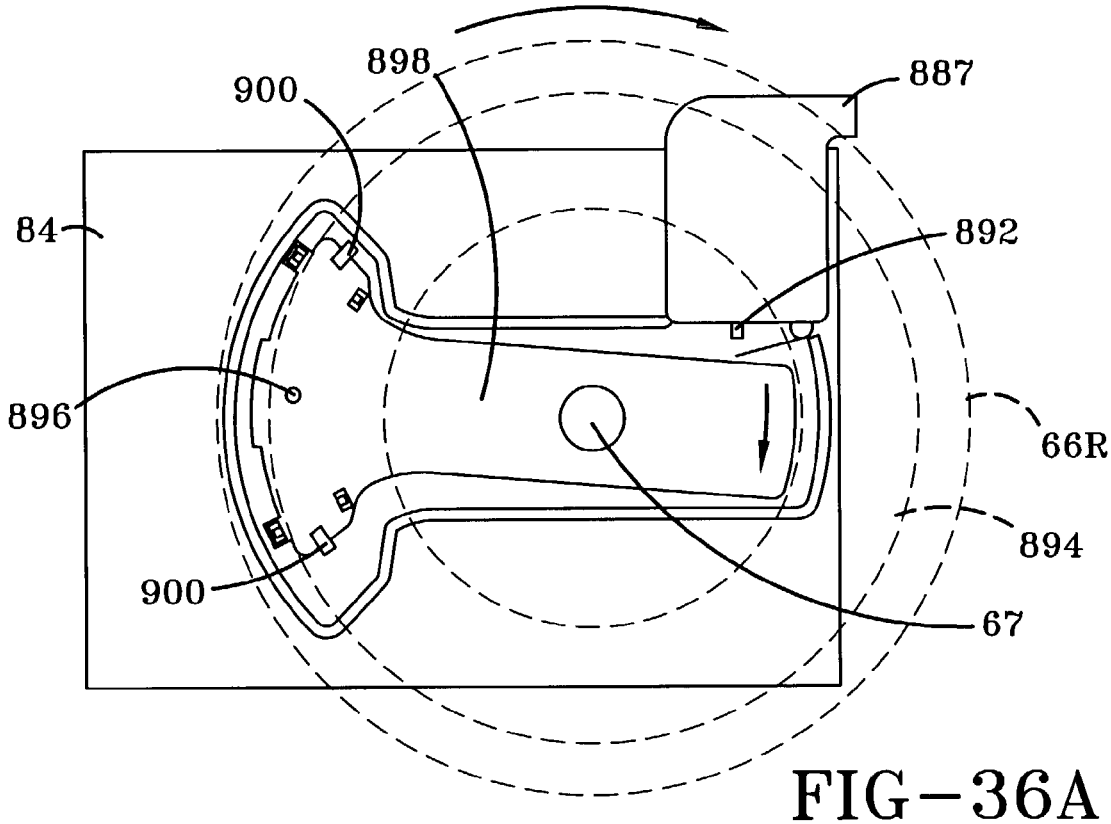
FIG. 36A is a partial left side view of the base of the carpet extractor of FIG. 1 showing the wheel rotation activating assembly of FIG. 35 operating to wash the carpet or floor during the forward stroke.
Figure 36B:
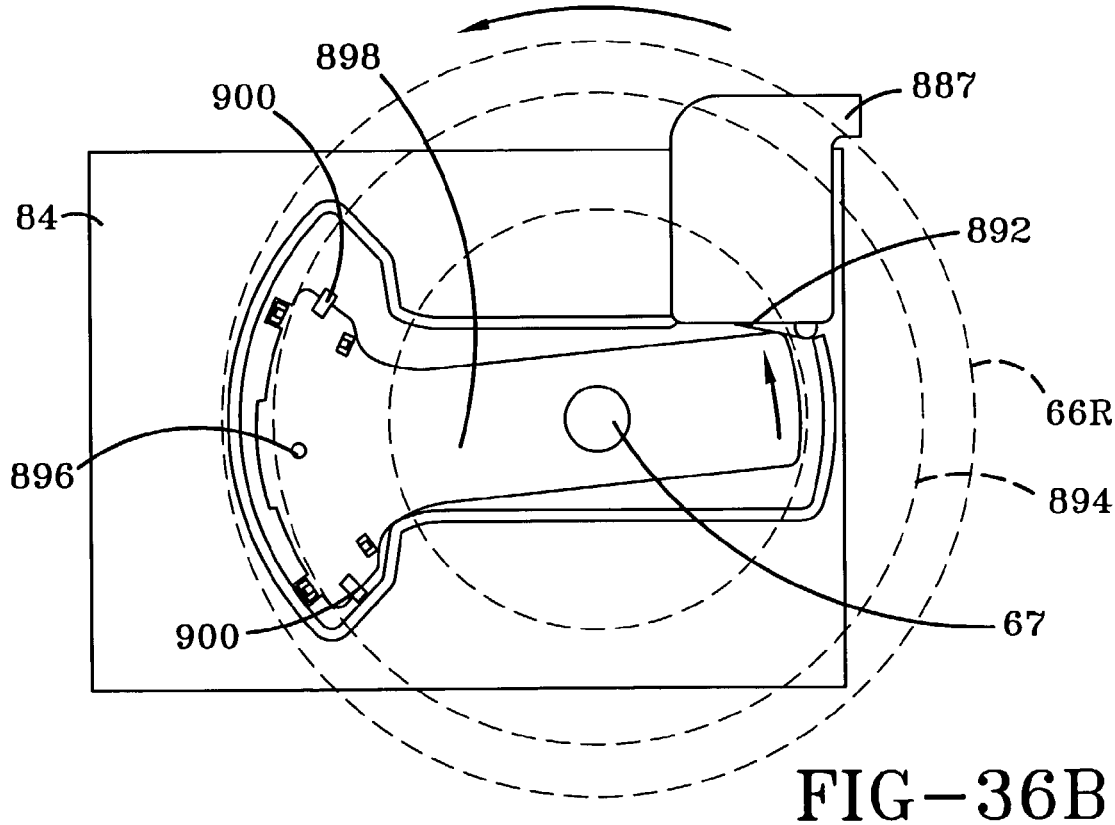
FIG. 36B is as a view similar to FIG. 36A but with the wheel rotation activating assembly being operated to rinse the carpet or floor during the reverse stroke.

As depicted in FIG. 35, the microswitch 886 is part of a wheel rotation activating assembly 888 associated with the right rear wheel 66R on the right side of the foot portion base assembly 64 (FIG. 2). A lever arm 890 is connected to the microswitch 886 and extends over a spring-loaded push button 892 (FIGS. 36A and 36B) on the microswitch 886. A microswitch cover 887 covers the microswitch 886 and this assembly is mounted to the rear body 84 (FIGS. 26A and 26B). The wheel rotation activating assembly 888 further includes a magnet 896 secured to an actuation lever 898 positioned spacedly adjacent a steel wheel disc 894 mounted to the rear extractor wheel 66R by screws 895. As depicted in FIGS. 36A and 36B, rollers 900, having axles 901 (FIG. 35) extending therethrough, are rotatably mounted to the actuation lever 898. The rollers 900 ride on the wheel disc 894 to ensure clearance between the magnet 896 and wheel disc 896. The axle 67 of the rear extractor wheel 66R slidably extends through the actuation lever 898 such that the actuation lever 898 is allowed to pivot or rotate around it. The actuation lever 898 is further positioned in a recess of the rear body 84 adjacent the microswitch 886. The magnets 896 follow the direction of rotation of the wheel 66R due to the magnetic attraction between them, thereby causing the actuation lever 898 to rotate.

Alternatively, FIGS. 37 and 38 depict another actuation lever 912 is with accompanying magnet 914 and rollers 916. These rollers 900 include rubber tires 918 secured around them and axles 920 extending through the center. The rollers 916 with the tires 918 are rotatably positioned in recesses 924 formed in the side 926 of the actuator lever 912 opposing the wheel disc 894. The axles 920 are snap connected into u-shaped holders 922 formed in the side of the actuator lever 912 opposing the wheel disc 894.

In particular with reference to FIG. 38, the axles 920 are slidably inserted between elastic legs 926, 928 of the holder 922, engaging a pair of opposing ledges or barbs 930 formed on the legs 926, 928 which cause the legs 926, 928 to deflect outwardly to allow the holder to pass through. After the holder is inserted beyond the barbs, the legs retract back so that the barbs secure the axles within the holder. The magnet 914 is seated into an opening 929 of the actuation lever 898 and held securely in place by elastic catches 932, 934 engaging it against a rib 930 extending across the center of the opening 929.

Figure 34A:
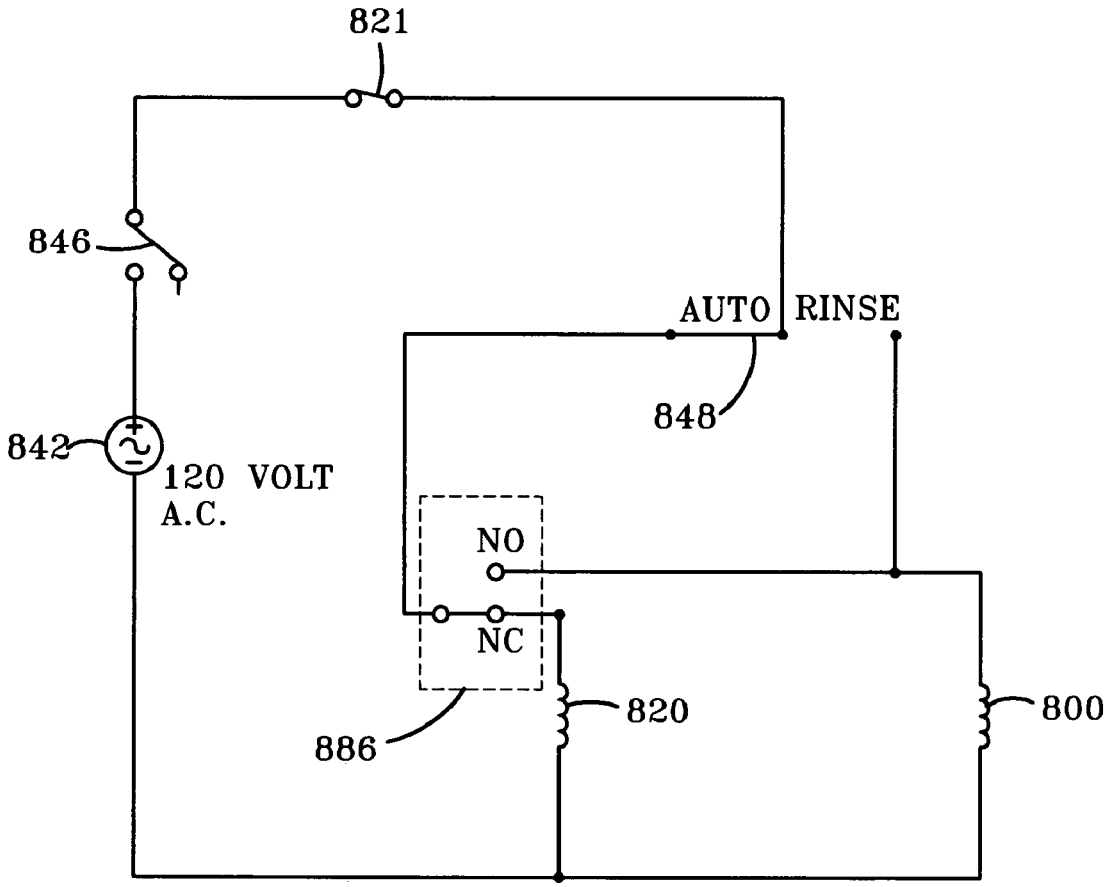
FIG. 34A is a schematic diagram showing another electrical circuit for the fluid distribution system used in the embodiment of FIG. 1 that automatically cleans the carpet or floor using one cleaning mode on the forward stroke of a cleaning cycle and another cleaning mode for the reverse stroke of the cleaning cycle.

When the carpet extractor unit 60 (FIG. 1) goes forward as indicated by the rotation of the rear wheel 66R in FIG. 36A, the actuation lever 898 and lever arm 890 are disengaged from the push button 892 of the microswitch 886. In this position, the microswitch 886 electrically connects the power source 842 to the main solenoid shut off valve 820, depicted in FIG. 34A. Thus, when the trigger 822 is squeezed, the main solenoid shut off valve 820 energizes and opens, thereby allowing water mixed with detergent to be supplied to the distributor 792 or hand-held cleaning attachment. When the extractor unit 60 moves rearward as indicated by the rotation of the rear wheel 66R in FIG. 36B, the actuation lever 898 engages the lever arm 890, which depresses the push button 892. This causes the microswitch 886 to electrically connect the power source 842 to the water solenoid shut off valve 800 as shown in FIG. 34A, thereby energizing it to open. Also, in this position, the microswitch 886 disconnects the power source 842 to main solenoid shut off valve 820, thereby deenergizing it. Thus, clean water is automatically distributed on the floor surface.

Figure 39:
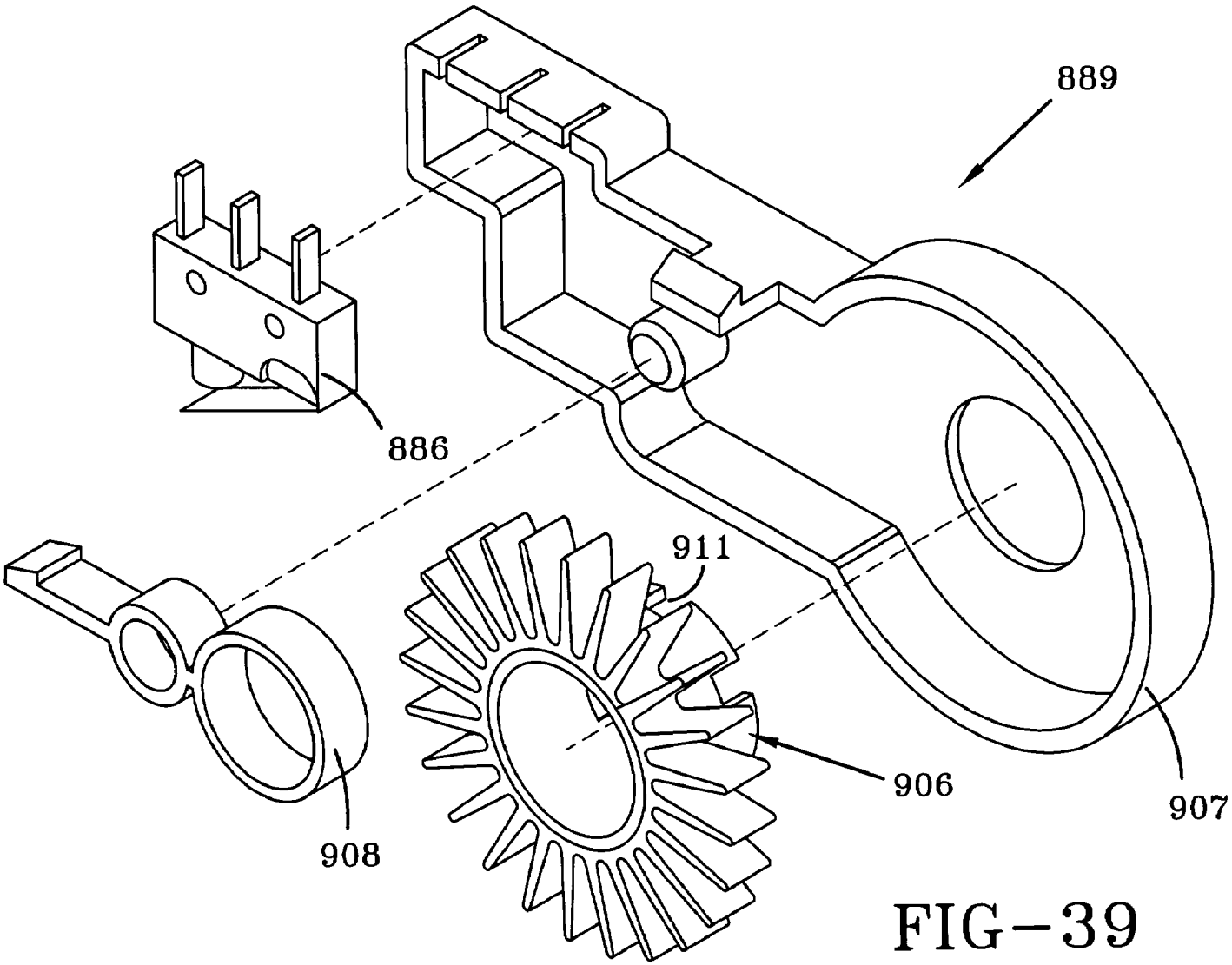
FIG. 39 is an exploded view of another version of a wheel rotation activating assembly used in the embodiment shown in FIG. 1.
Figure 40A:
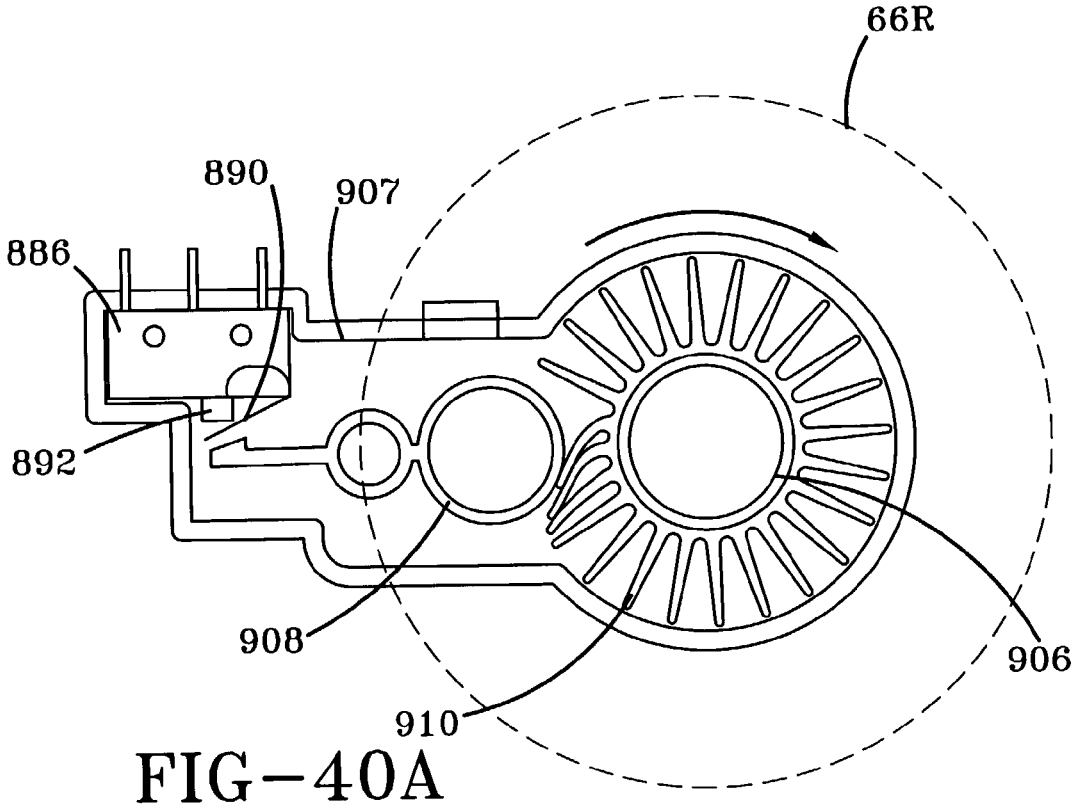
FIG. 40A is a partial left side view of the base of the carpet extractor of FIG. 1 showing the wheel rotation activating assembly of FIG. 39 operating to wash the carpet or floor during the forward stroke.
Figure 40B:
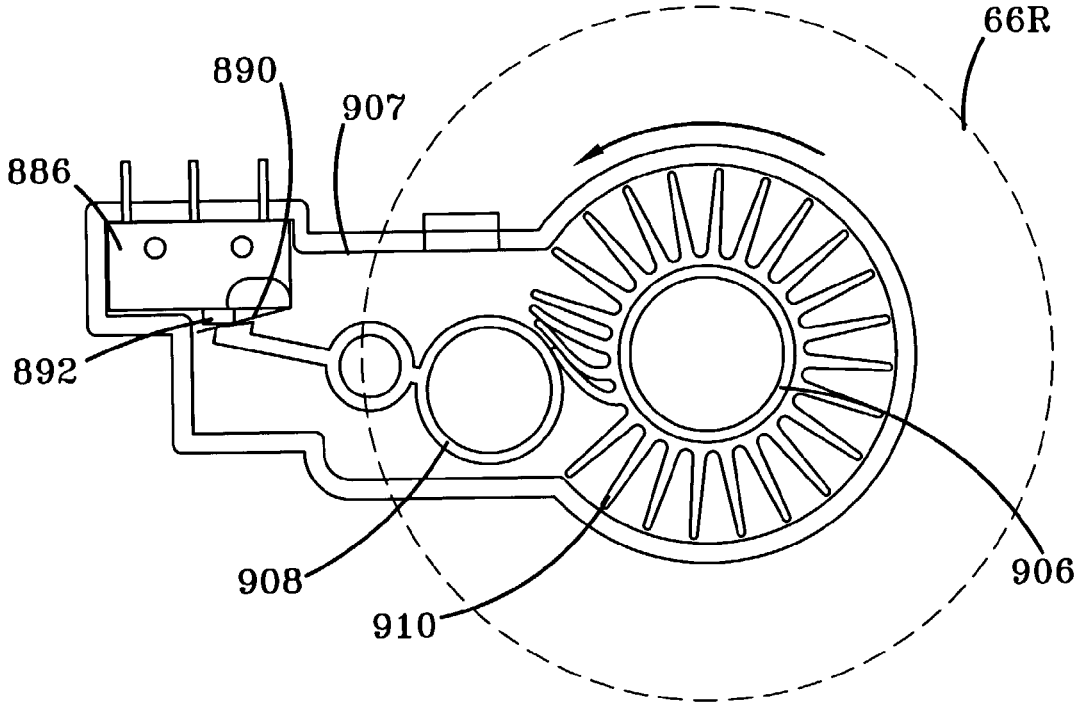
FIG. 40B is a view similar to FIG. 36A but with the wheel rotation activating assembly being operated to rinse the carpet or floor during the reverse stroke.

Another wheel rotation activating assembly 889 is shown in FIGS. 39, 40A, and 40B. It comprises a paddle wheel 906 that rotates an actuation lever 908 to activate the microswitch 886. The paddle wheel 906 and actuation lever 908 are rotatably mounted in a housing 907 and the microswitch is fixedly secured to the housing 907 as best seen in FIGS. 40A and 40B. This assembly is mounted to the rear body 84 (FIG. 3) of the extractor unit 60. The paddle wheel 906 has grooves 911 (FIG. 39) which frictionally engage ribs 909 (FIG. 35) on the right rear extractor wheel 66R (FIG. 35), securing it thereto. As shown in FIG. 40A, when the extractor unit 60 (FIG. 1) moves forward, the paddle wheel 906 rotates in the direction of the arrow such that the elastic paddles 910 on the paddle wheel 906 strike the actuation lever 908 causing it to rotate away from the lever arm 890, disengaging it from the push button 892 of the microswitch 886. As depicted in FIG. 40B, when the extractor unit 60 is moves rearward, the paddle wheel 906 rotates in the direction of the arrow such that the paddles 910 on the paddle wheel 906 strike the actuation lever 908 causing it to rotate and engage the lever arm 890 which depresses the push button 892 on the microswitch 886.

Figure 42:
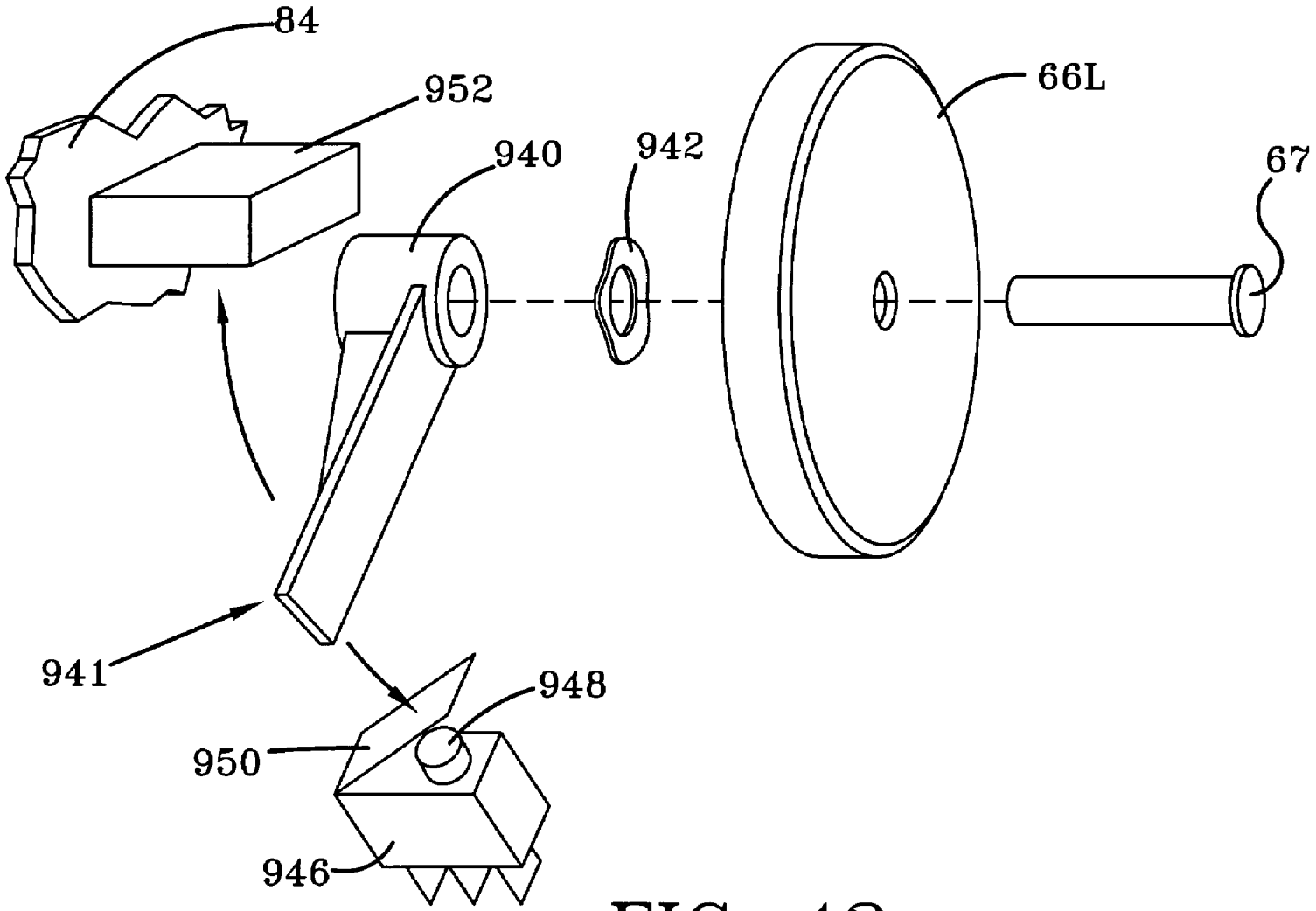
FIG. 42 is an exploded view of another version of a wheel rotation activating assembly and related elements used on the right rear wheel in the embodiment shown in FIG. 1.
Figure 43A:
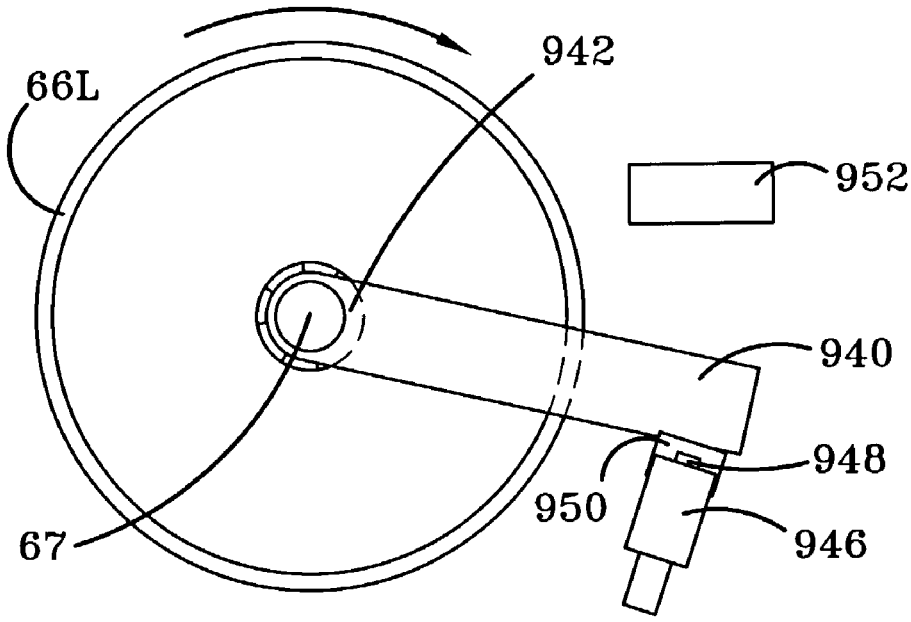
FIG. 43A is a partial left side view of FIG. 42 showing the wheel rotation activating assembly operating to wash the carpet or floor during the forward strike.
Figure 43B:
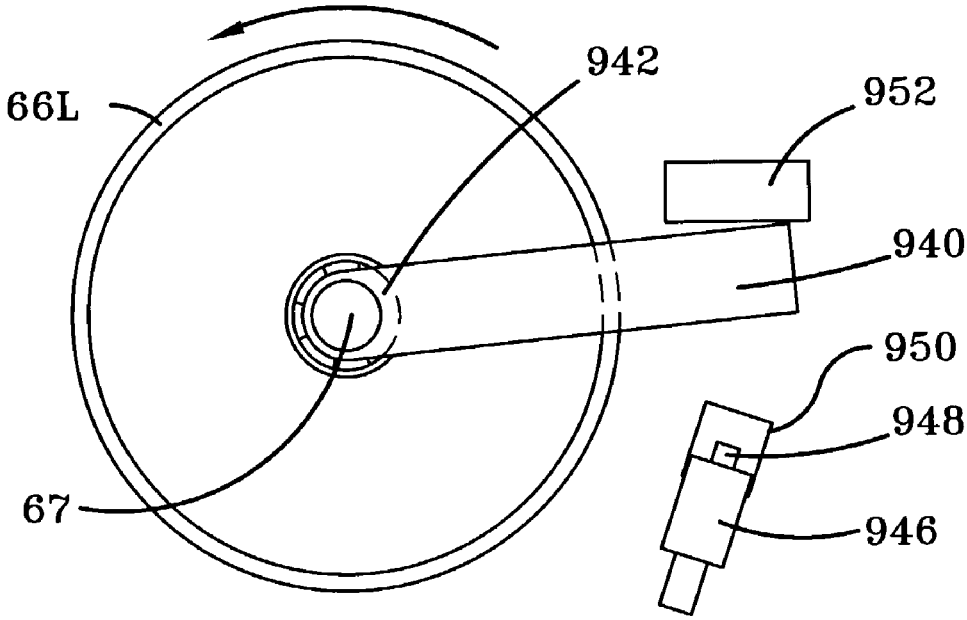
FIG. 43B is a view similar to FIG. 43A but with the wheel rotation activating assembly being operated to rinse the carpet or floor during the reverse stroke.

Still another wheel rotation activating assembly 941 is shown in FIGS. 42, 43A and 43B. The wheel rotation activating assembly 941 comprises an actuator lever 940, wave washer 942, and microswitch 946. In this assembly, the microswitch 946 is designed to electrically connect the power source 842 to the main solenoid shut off valve 820 (FIG. 34A) for washing, when its push button 948 is depressed, and to electrically connect the power source 842 to the water solenoid shut off valve 800, when the push button 948 is not depressed. The axle 67 extends through the wave washer 942 and actuator lever 940. The actuator lever 940 rotates with the left rear wheel 66L due to friction generated by the wave washer 942. When the extractor unit 60 moves forward as shown in FIG. 43A by the arrow indicating the direction of the wheel rotation, the actuator lever 940 rotates to engage the lever arm 950 and depress the push button 948 on the microswitch 946. When the extractor unit 60 (FIG. 1) moves rearward as shown in FIG. 43B by the arrow indicating the direction of the wheel rotation, the actuator lever 940 moves away from the microswitch 946 disengaging the lever arm 950 from the push button 948 and traveling until it strikes a stop 952 attached on the rear body 84 (FIG. 42). Upon engaging either the stop 952 or microswitch 946, the actuator lever 940 slips against the wheel hub, allowing the left rear wheel 66L to rotate and therefore allowing the unit to continue moving in the forward or rearward direction.

If rinsing is desirable on both the forward and reverse strokes the user slides the slide switch 858 of the cleaning mode switch assembly 848 downwardly to the lower end of the recess 860 to electrically connect the microswitch 886 to the water solenoid shut off valve 800. Then, the user squeezes the trigger 822, which opens the water solenoid shut off valve 800 to allow clean water from the clean water tank 620 to flow to the distributor 792 and brushes 72, where it is distributed and scrubbed into the carpet. Alternatively, if washing is desired on both the forward and reverse strokes, a three position cleaning mode switch assembly could be used instead of the two position cleaning mode switch assembly with the third position being directly connected to the main solenoid shut off valve 820 bypassing the second microswitch 886 of the wheel rotating activating assembly 888.

By incorporating a rinse application as shown in the embodiments, a higher concentration of detergent in the cleaning fluid, generally two or more times as much as the clean water, can be used to wash the carpet during the first forward stroke, since the rinse application will rinse or remove the detergent residue not extracted. In particular, the carpet extractor will distribute the cleaning solution having the high detergent concentration on the forward stroke as it substantially and simultaneously extracts it along with the dirt on the carpet in a continuous operation. Then, the carpet extractor will distribute the cleaning solution having the clean water on the reverse stroke to rinse the detergent residue not extracted as the carpet extractor substantially and simultaneously extracts it along with the dirt on the carpet in a continuous operation. Thus, cleaning performance is improved.

The present invention has been described by way of example using the illustrated embodiments. Upon reviewing the detailed description and the appended drawings, various modifications and variations of the embodiments will become apparent to one of ordinary skill in the art. All such obvious modifications and variations are intended to be included in the scope of the present invention and of the claims appended hereto. For example, clean water could be applied on the forward stroke and detergent solution on the reverse stroke. Also, a certain liquid might be added to the clean water or be used alone to improve the rinsing operation.

In view of the above, it is intended that the present invention not be limited by the preceding disclosure of the embodiments, but rather be limited only by the appended claims.

What is claimed is:

1. A cleaning apparatus for cleaning a surface in which cleaning solution is dispensed to the surface and substantially simultaneously extracted along with the dirt on the surface in a continuous operation comprising:

a) a source for providing said cleaning solution to be dispensed onto said surface;

b) a pump operatively connected to said source to draw under pressure said cleaning solution to said surface; and c) a valve connected to said source, said pump having an outlet connected to said valve, said valve being opened and closed in response to the change in pressure at the outlet of said pump.

2. The cleaning apparatus of claim 1 wherein said valve is in said open position upon the pressure at said outlet being below a predetermined value, said valve being in a closed position upon the pressure at said outlet of said pump being above said predetermined value.

3. The cleaning apparatus of claim 1 wherein said value is in said open position upon the pressure at said outlet being below a first predetermined value, said valve being in closed position upon the pressure at said outlet of said pump being above a second predetermined value.

4. The cleaning apparatus of claim 1 wherein said pump has an inlet, said valve having first and second ports, said first port fluidly connected to said source, said second port fluidly connected to said inlet of said pump.

5. The cleaning apparatus of claim 4 wherein said valve includes a valve part, said valve part being positioned to block the flow of said cleaning solution between said first and second ports upon said valve being closed.

6. The cleaning apparatus of claim 5 wherein said valve includes a valve body, said valve part being positioned within said valve body, said valve part comprising a flexible member, said flexible member being flexed against one of said first and second ports upon said valve being closed.

7. The cleaning apparatus of claim 6 wherein said valve part includes a seal provided on said flexible member, said seal sealing said one of said first and second ports upon said valve being closed.

8. The cleaning apparatus of claim 5 wherein said valve includes a valve body, a spring positioned between said valve part and said valve body biasing said valve part.

9. The cleaning apparatus of claim 1 including a second valve connected to said outlet of said pump, wherein the change in pressure at said outlet of said pump is caused by the opening and closing of said second valve.

10. The cleaning apparatus of claim 9 wherein said first mentioned valve is opened upon said second valve being opened, said first mentioned valve being closed upon said second valve being closed.

11. A cleaning apparatus for cleaning a surface in which cleaning solution is dispensed to the surface and substantially simultaneously extracted along with the dirt on the surface in a continuous operation comprising:

a) a first source for providing a first cleaning solution to be dispensed onto said surface;

b) a second source for providing a second cleaning solution to be dispensed onto said surface; and c) a distributor for dispensing said cleaning solution onto said surface, said distributor having a first inlet fluidly connected to said first source and said second source, said distributor having a second inlet fluidly connected to said second source but not said first source.

12. The cleaning apparatus of claim 11 including a pump fluidly connected to said first inlet to draw under pressure said first cleaning solution and said second cleaning solution to said cleaning surface.

13. The cleaning apparatus of claim 11 including a first valve fluidly connected between said first inlet and said first and second sources, and a second valve fluidly connected between said second inlet and said second source.

14. The cleaning apparatus of claim 13 including a valve actuating assembly selectively connected to one of said first valve and said second valve and operable upon actuation thereof to open said one of said first valve and said second valve thereby allowing said cleaning solution to flow to said distributor.

15. The cleaning apparatus of claim 11 wherein said first cleaning solution is detergent and said second cleaning solution is clean water.

16. A cleaning apparatus for cleaning a surface in which cleaning solution is dispensed to the surface and substantially simultaneously extracted along with the dirt on the surface in a continuous operation comprising:

a) a first source for providing a first cleaning solution to be dispensed onto said surface;

b) a second source for providing a second cleaning solution to be dispensed onto said surface;

c) a distributor for dispensing one of said first cleaning solution and said second cleaning solution to said surface, said distributor being fluidly connected to said first source and said second source;

d) a first valve fluidly connected between said distributor and said first source, e) a second valve fluidly connected between said distributor and said second source, f) a valve actuating assembly connected to one of said first valve and said second valve and operable upon actuation thereof to open said one of said first valve and said second valve thereby allowing said cleaning solution to flow to said distributor, and g) a switch assembly operatively connected to said first valve, said second valve, and said valve actuating assembly wherein said switch assembly includes a slide switch operatively connected to said switch assembly, said slide switch being slid to a first position to operate said switch assembly to connect said switch assembly to said mentioned valve, said slide switch being slid to a second position to operate said switch assembly to connect said switch assembly to said second valve.

17. A cleaning apparatus for cleaning a surface in which cleaning solution is dispensed to the surface and substantially simultaneously extracted along with the dirt on the surface in a continuous operation comprising:

a) a first source for distributing a first liquid onto said surface;

b) an activating device operatively connected to said first source to activate said first source to distribute said first liquid onto said surface;

c) a pump operatively connected to said first source to draw under pressure said first liquid to said surface;

d) a second source for distributing a second liquid onto said surface, wherein said second liquid from said second source is drawn to said surface by gravity alone; and e) a shut off valve connected to said first source, said pump having an outlet connected to said shut off valve, said pump operatively associated with said shut off valve to place said valve in one of a closed position and open position upon said pump being activated.

18. A cleaning apparatus for cleaning a surface in which cleaning solution is dispensed to the surface and substantially simultaneously extracted along with the dirt on the surface in a continuous operation comprising:

a) a first source for providing a first cleaning solution to be dispensed onto said surface;

b) a second source for providing a second cleaning solution to be dispensed onto said surface by gravity alone;

c) a pump operatively connected to said first source to draw under pressure said first cleaning solution to said surface;

d) a distributor for dispensing one of said first cleaning solution and said second cleaning solution to said surface, said distributor being fluidly connected to said first source and said second source;

e) a valve fluidly connected between said distributor and said first source;

f) a second valve fluidly connected between said distributor and said second source;

g) a valve actuating assembly connected to one of said first valve and said second valve and operable upon actuation thereof to open said one of said first valve and said second valve thereby allowing said cleaning solution to flow to said distributor; and h) a switch assembly operatively connected to said first valve, said second valve, and said valve actuating assembly, said switch assembly being operable to selectively connect said valve actuating assembly to one of said first mentioned valve and said second valve.

19. The cleaning apparatus of claim 18 wherein said switch assembly includes a slide switch operatively connected to said switch assembly, said slide switch being slid to a first position to operate said switch assembly to connect said switch assembly to said first mentioned valve, said slide switch being slid to a second position to operate said switch assembly to connect said switch assembly to said second valve.

20. A cleaning apparatus for cleaning a surface in which cleaning solution is dispensed to the surface and substantially simultaneously extracted along with the dirt on the surface in a continuous operation comprising:

a) a first source for providing a first cleaning solution to be dispensed onto said surface;

b) a second source for providing a second cleaning solution to be dispensed onto said surface;

c) a pump operatively connected to said first source to draw under pressure said first cleaning solution to said surface; and d) wherein said second cleaning solution from said second source is drawn to said surface by gravity alone; and e) a valve connected to said first source, said pump having an outlet connected to said valve, said valve being opened and closed in response to the change in pressure at the outlet of said pump.

* * * * *

UNITED STATES PATENT AND TRADEMARK OFFICE

CERTIFICATE OF CORRECTION

PATENT NO. : 7,617,563 B2
APPLICATION NO. : 10/165731
DATED : November 17, 2009
INVENTOR(S) : Hertrick et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2121 days.

Signed and Sealed this

Nineteenth Day of October, 2010

David J. Kappos

David J. Kappos
*Director of the United States Patent and Trademark Office*